US012383012B2

(12) United States Patent
Chen et al.

(10) Patent No.: US 12,383,012 B2
(45) Date of Patent: Aug. 12, 2025

(54) HELMET MOUNTING UNIT COMPRISED OF LINKS

(71) Applicant: T. A. R. IDEAL CONCEPTS LTD., Kfar Saba (IL)

(72) Inventors: Itay Shlomo Chen, Raanana (IL); Hadar Szpiro, Kfar Saba (IL)

(73) Assignee: T. A. R. IDEAL CONCEPTS LTD., Kfar Saba (IL)

( * ) Notice: Subject to any disclaimer, the term of this patent is extended or adjusted under 35 U.S.C. 154(b) by 111 days.

(21) Appl. No.: 17/964,966

(22) Filed: Oct. 13, 2022

(65) Prior Publication Data

US 2023/0125775 A1 Apr. 27, 2023

Related U.S. Application Data

(60) Provisional application No. 63/255,468, filed on Oct. 14, 2021.

(51) Int. Cl.
*A42B 3/04* (2006.01)

(52) U.S. Cl.
CPC ..... *A42B 3/0406* (2013.01)

(58) Field of Classification Search
CPC ..... A42B 3/0406; A42B 3/006; A42B 3/04; A44C 5/102; A44C 5/02; A44C 5/04; A44C 5/06; A44C 5/08
USPC ..... 2/422; 24/89, 364, 102 R; 59/80, 84
See application file for complete search history.

(56) References Cited

U.S. PATENT DOCUMENTS

| | | | | |
|---|---|---|---|---|
| 4,050,323 | A * | 9/1977 | l'Anson | F16G 13/07 198/853 |
| 4,597,747 | A | 7/1986 | Lapeyre | |
| 4,815,270 | A * | 3/1989 | Lapeyre | F16G 13/07 59/900 |
| 5,343,718 | A * | 9/1994 | Poll | A44C 11/007 63/26 |
| 6,473,945 | B1 * | 11/2002 | Draper | F16L 23/06 24/270 |
| 7,314,132 | B2 * | 1/2008 | Layne | B65G 17/08 198/852 |
| 9,622,553 | B2 * | 4/2017 | Lauren | A44C 11/00 |
| 2016/0192745 | A1 * | 7/2016 | Lauren | A44C 5/105 59/89 |
| 2018/0192727 | A1 * | 7/2018 | Chen | A45F 5/02 |

* cited by examiner

*Primary Examiner* — Timothy K Trieu
(74) *Attorney, Agent, or Firm* — SOROKER AGMON NORDMAN RIBA

(57) ABSTRACT

A link-based helmet mounting unit for attaching accessories onto a helmet is provided, the helmet mounting unit comprising a plurality of links connected to one another, to enable length adjustment, as well as versatility with respect to replacement, location and type of accessory adaptors that are to be carried by the link-based helmet mounting unit.

16 Claims, 46 Drawing Sheets

L4 GoPro

L6 No Screws

L2 No Screws

L1 No Screws

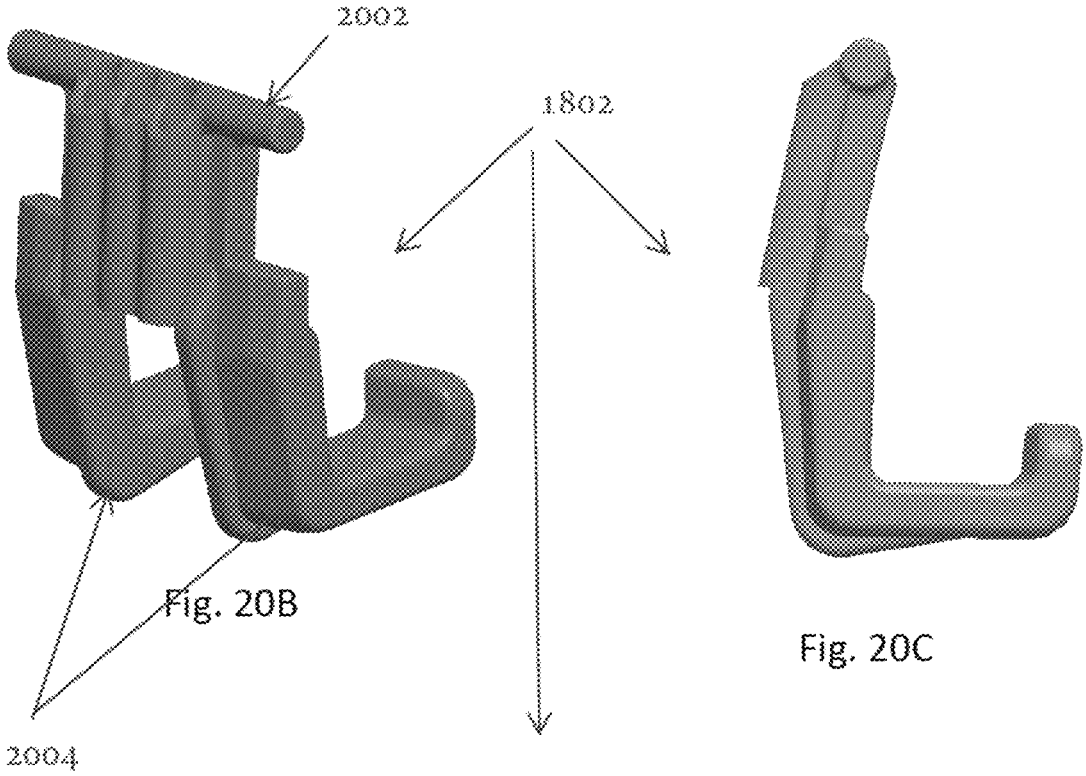
Fig. 20B
Fig. 20C
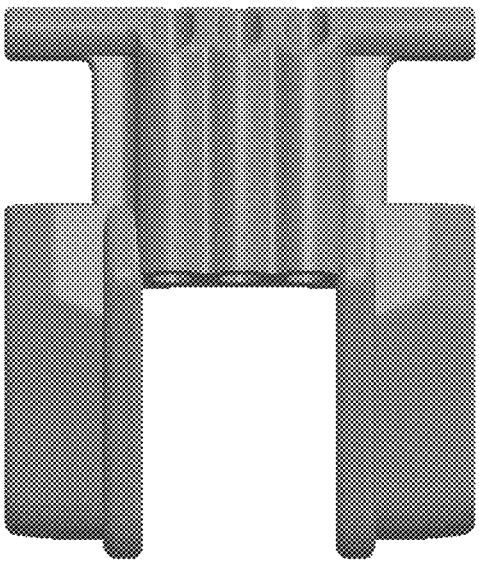
Fig. 20D 2200
2222
2224
2212
2210
2201

2200
2216
2214
2201

2240
2230

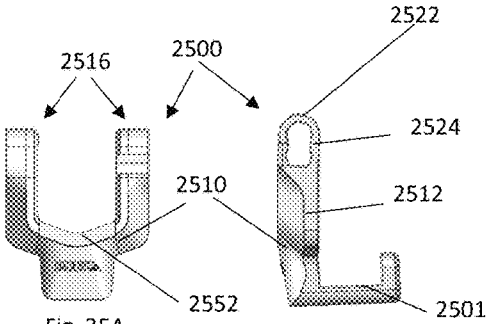
Fig. 25A
Fig. 25B
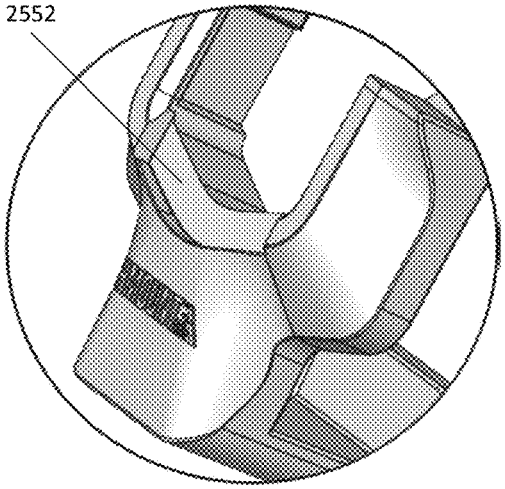
Fig. 25E
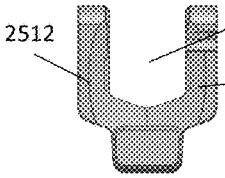
Fig. 25C
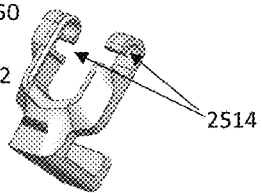
Fig. 25D
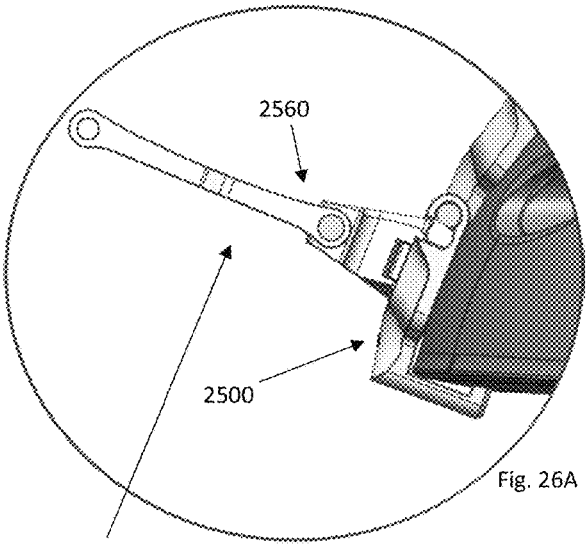
Fig. 26A
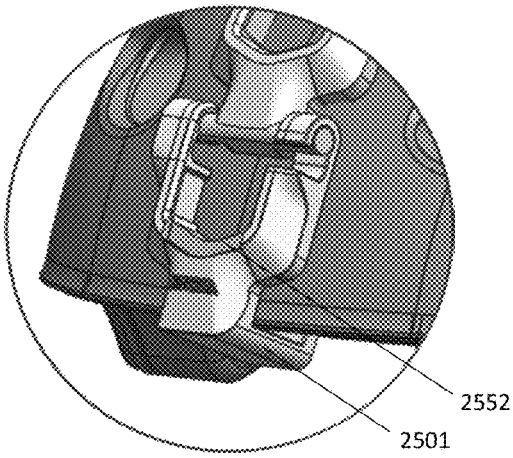
Fig. 25F
SEE PART #12 – NVG ADDON
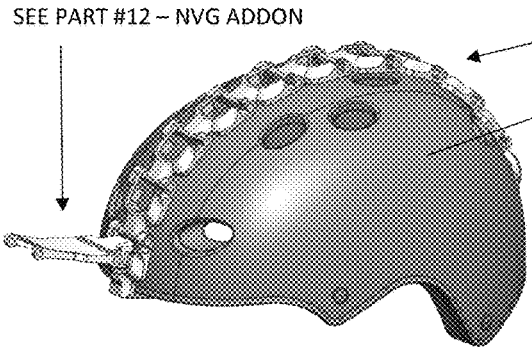
Fig. 26B
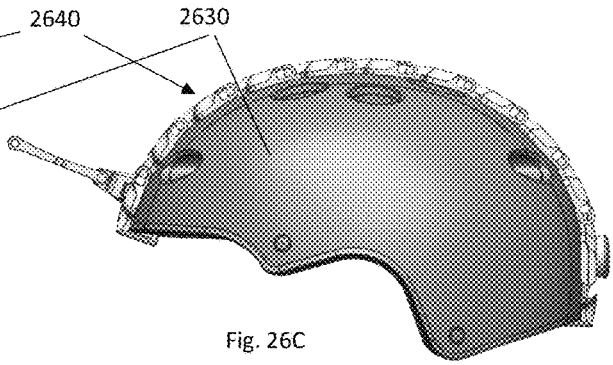
Fig. 26C

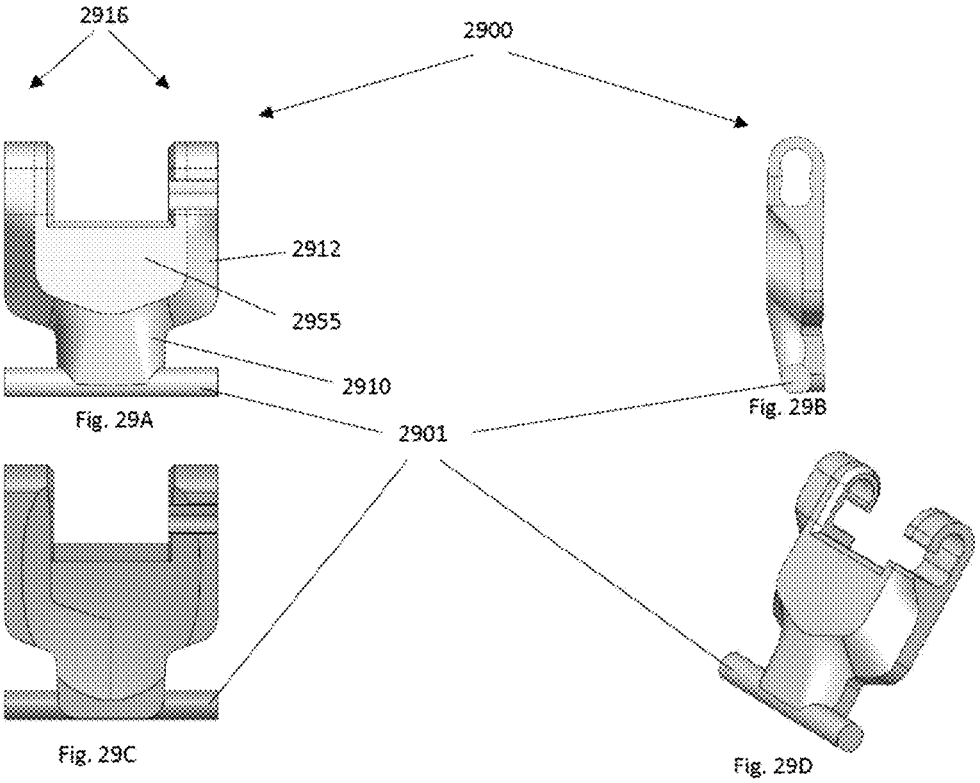
Fig. 29A
Fig. 29B
Fig. 29C
Fig. 29D
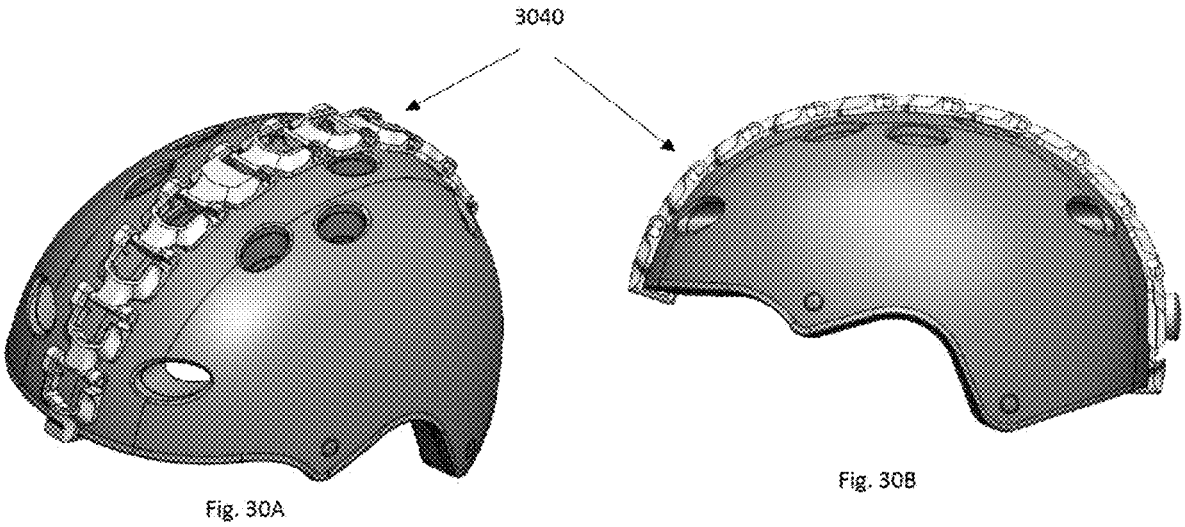
Fig. 30A
Fig. 30B

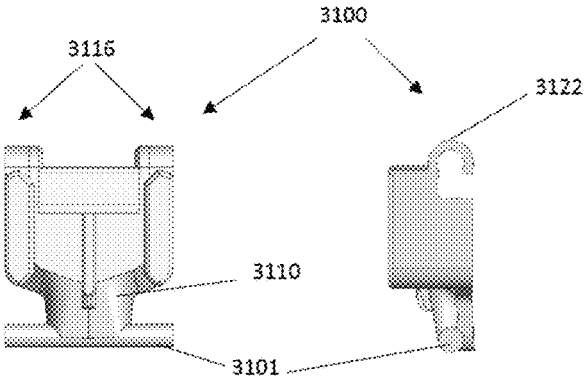
Fig. 31A
Fig. 31B
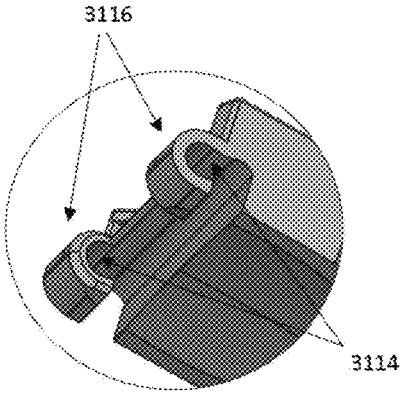
Fig. 31E
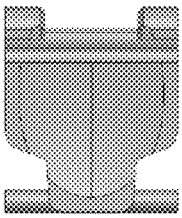
Fig. 31C
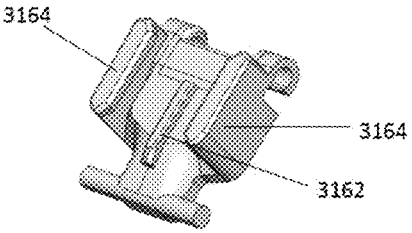
Fig. 31D
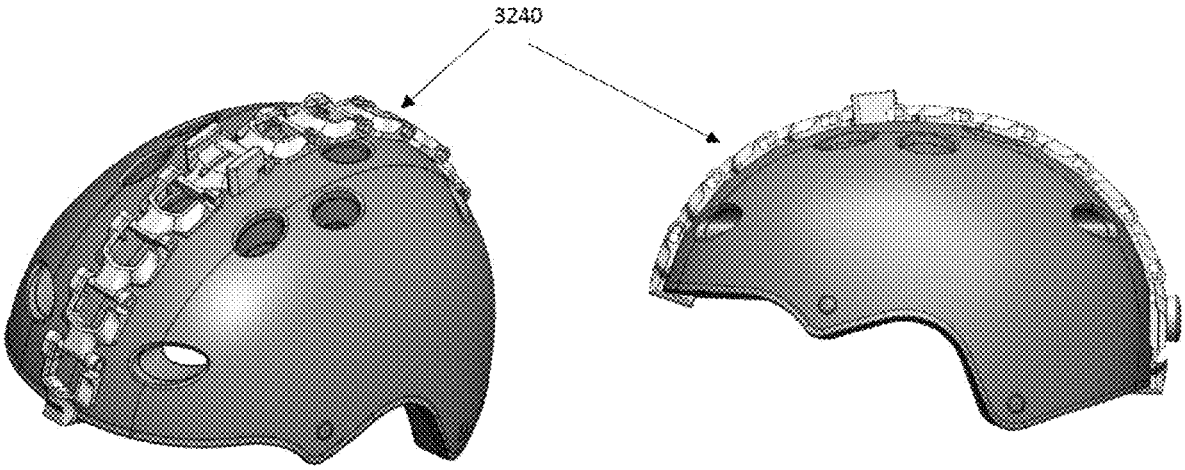
Fig. 32A
Fig. 32B

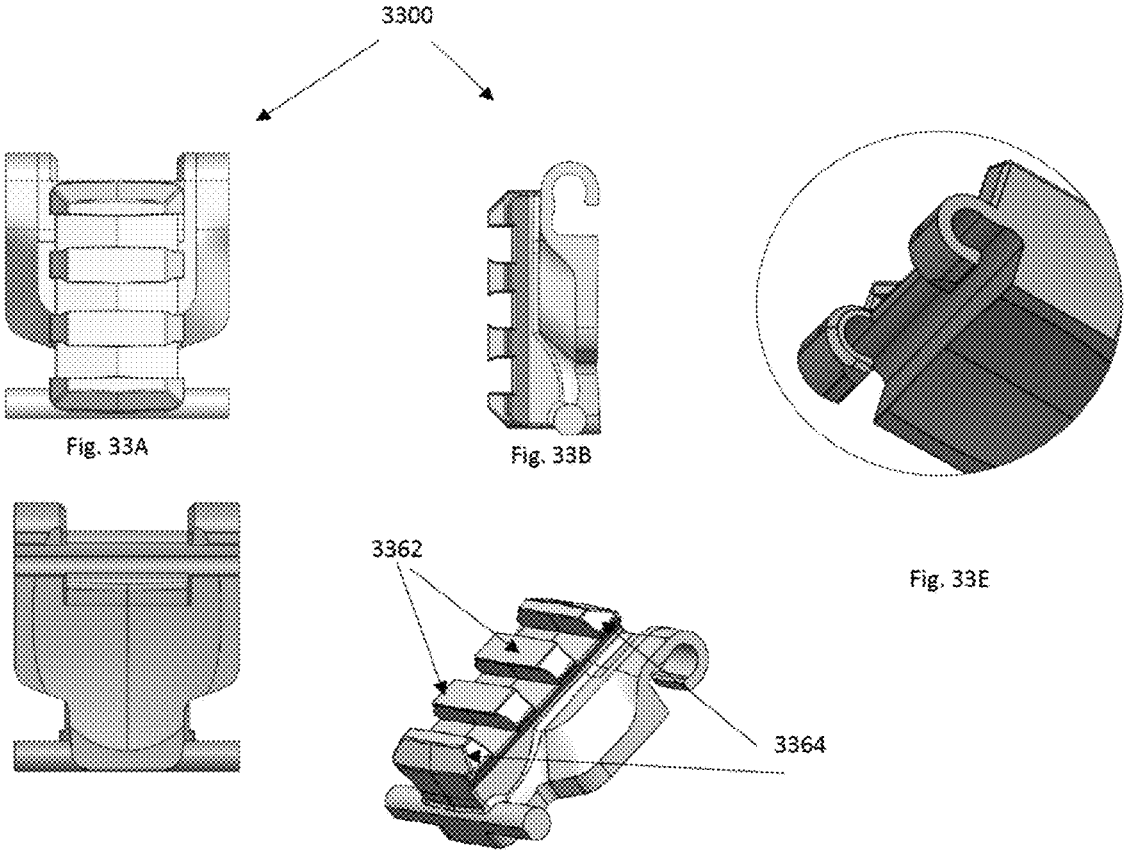
Fig. 33A
Fig. 33B
Fig. 33E
Fig. 33C
Fig. 33D
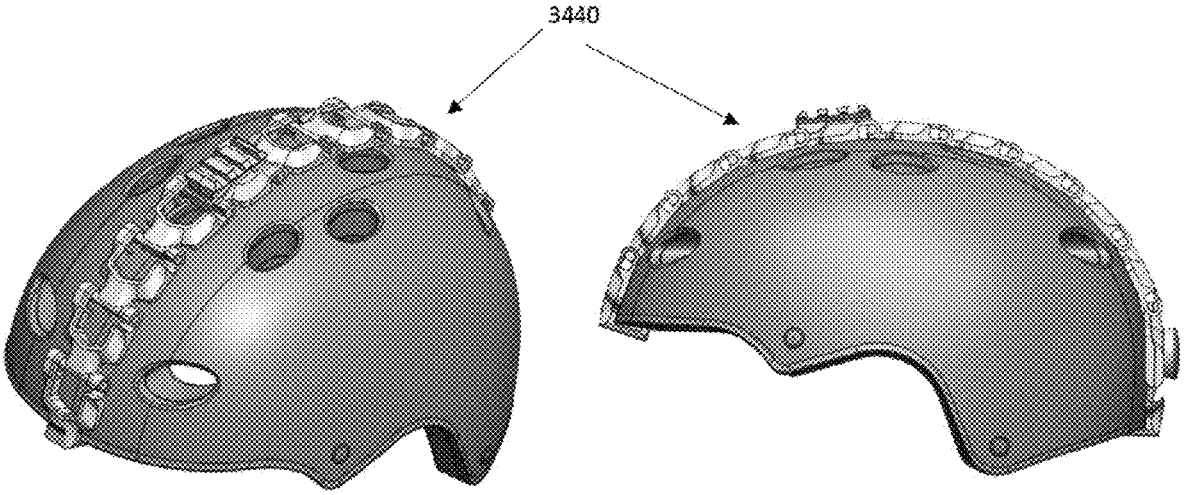
Fig. 34A
Fig. 34B

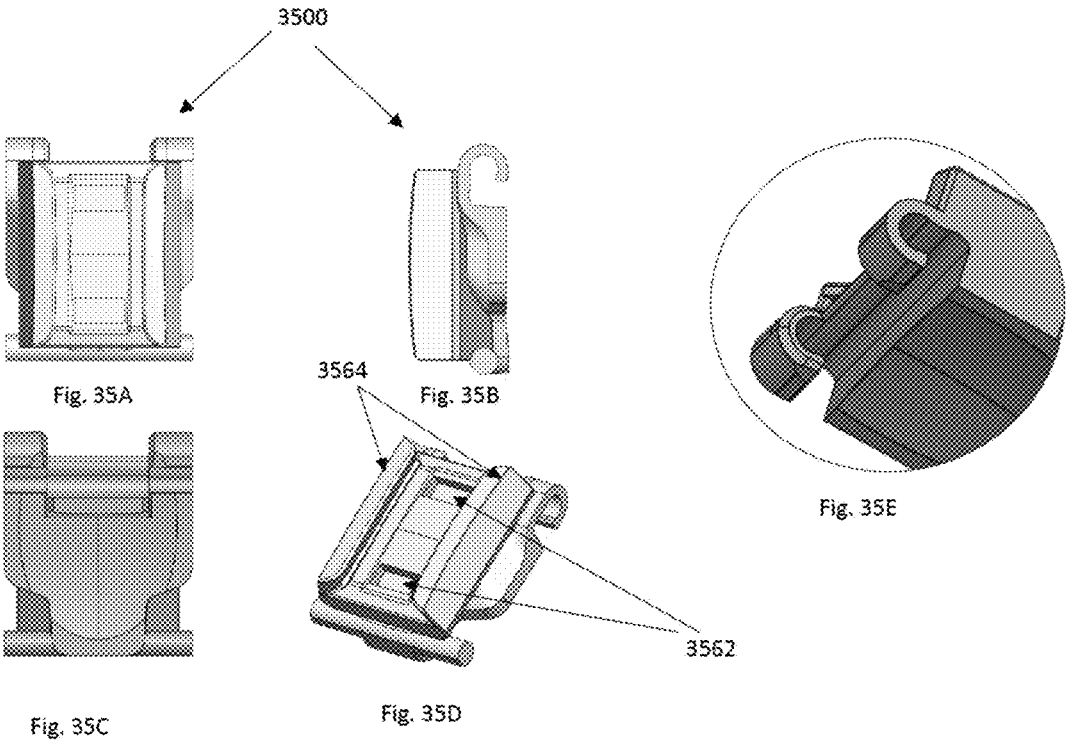
Fig. 35A
Fig. 35B
Fig. 35C
Fig. 35D
Fig. 35E
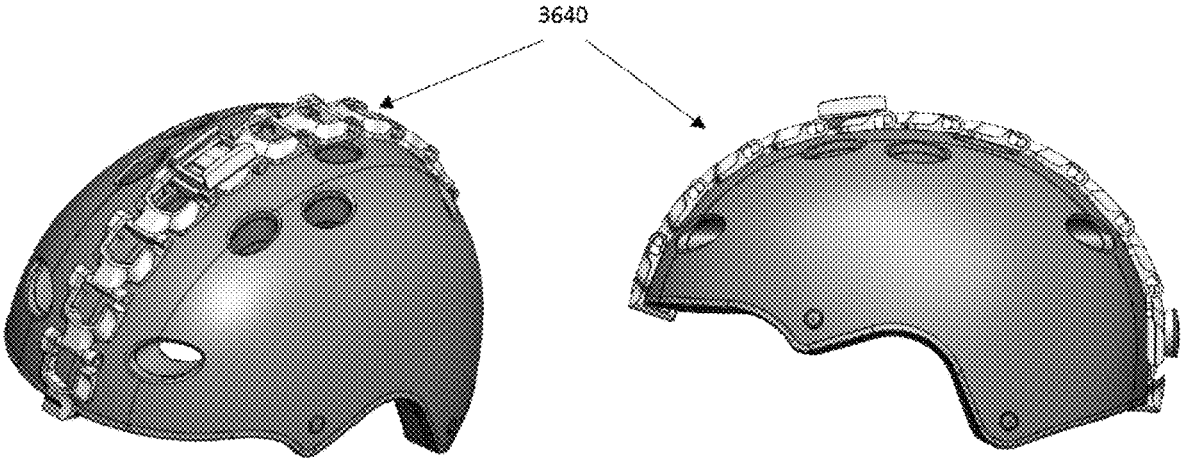
Fig. 36A
Fig. 36B

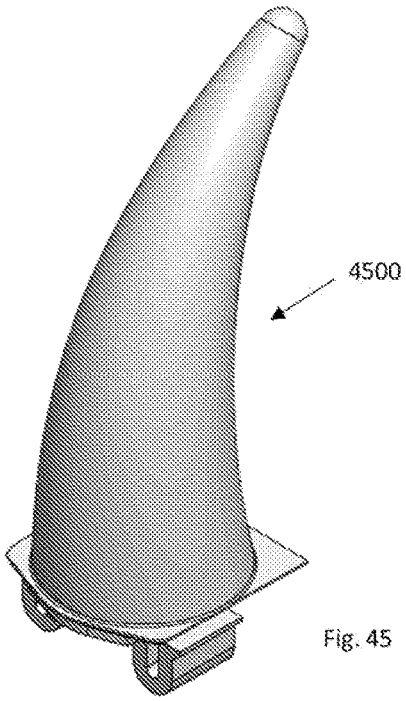
Fig. 45
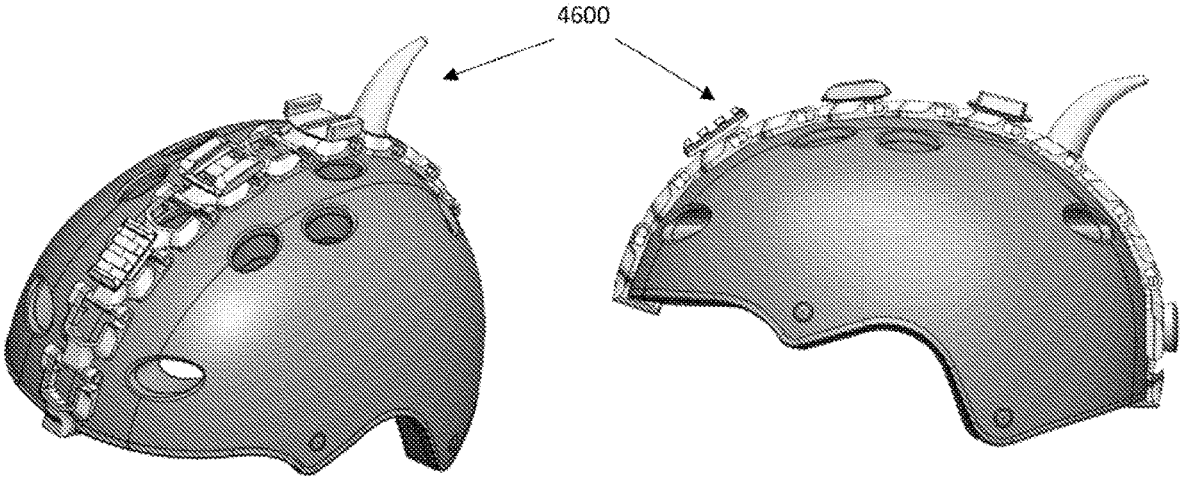
Fig. 46A
Fig. 46B

HELMET MOUNTING UNIT COMPRISED OF LINKS

TECHNICAL FIELD

The present disclosure relates to a helmet mounting unit configured for attaching accessories thereon, whereby the helmet mounting unit is comprised of links connected to one another.

BACKGROUND OF THE DISCLOSURE

Helmets include one or more mounting units onto which adaptors for carrying helmet accessories are attached. Sometimes after a period of usage, the adaptors or the mounting units are damaged and even break. In such case, the entire mounting unit needs to be replaced in order to replace the damaged or broken accessory adaptor.

Replacing an entire helmet mounting unit due to a single broken accessory adaptor is time consuming as well as costly.

In addition, helmet mounting units are typically of a certain predetermined length, which cannot be changed.

Accordingly, there is a need for a helmet mounting unit that enables adjustment per helmet size as well as replacement of each adaptor separately instead of replacing the entire helmet mounting unit altogether.

SUMMARY OF THE DISCLOSURE

An aspect of an embodiment of the disclosure, relates to a helmet mounting unit that is comprised of several links easily connected to one another, and which may be easily detached from one another to enable replacement of any damaged or broken link, when necessary. That is, a link-based helmet mounting unit is provided. Some of the links may comprise an accessory adaptor, while other links may not comprise any accessory adaptor and may simply be links configured to connect those links comprising accessory adaptors to the helmet along its external circumference.

In some embodiments, the links may be configured to have attached thereon interchangeable adaptors, such that the user may design the helmet mounting unit per their specific needs. For example, the user may change location of any accessory adaptors between the links of the helmet mounting unit, add more than one type of accessory adaptor along different locations of the link-based helmet mounting unit and replace a broken or damaged link with a new link.

The link-based mounting unit may be attached onto the external circumference of the helmet from front to back, and/or from side to side. The front of the helmet being the side configured to be located above the face of the user, while the back of the helmet being the side of the helmet configured to be located at the back side of the user. The sides of the helmet being the right side and left side of the helmet, are configured to be located at the right and left sides of the user's face, respectively.

According to some embodiments, the link-based helmet mounting unit may comprise at least one clip on each end of the helmet mounting unit, configured to attach the helmet mounting unit onto the edges of the helmet.

In some embodiments, the link-based helmet mounting unit may comprise wires running through the plurality of links, which the helmet mounting unit is comprised of. The wires running through the links may allow tightening of the helmet mounting unit onto the helmet, as well as enable attachment of the 'Integrated Visual Augmentation System' (IVAS) by Microsoft, to the helmet mounting unit, and thereby to the helmet carrying the helmet mounting unit. In some embodiments, instead of attaching an WAS, the helmet mounting unit may be configured to attach other systems to the helmet via the wires.

There is provided a link that is part of a plurality of links for forming a link-based helmet mounting unit, which is configured to carry accessories thereon. The link comprising: a link body; a first end comprising a rod; and a second end comprising at least one hook connected to the link body via an elongated arm, said elongated arm comprising a curved end. The at least one hook is configured to connect onto a rod of another link with the curved end hugging the rod, thereby enabling connection between the plurality of links to form the helmet mounting unit.

Optionally, the at least one hook comprises two hooks positioned on each side of the second end.

Optionally, each open end of each of the two hooks are positioned towards the same direction.

Optionally, each open end of each of the two hooks are positioned towards opposite directions.

Optionally, the at least one hook comprises a step along the elongated arm, the step configured to prevent easy disconnection of the rod from the at least one hook by partially blocking movement of the rod away from the curved end of the at least one hook.

Optionally, the step is located substantially at the middle of the elongated arm.

Optionally, the link further comprises an accessory adaptor integrated as part of the link, the accessory adaptor configured for attaching an accessory onto the link via the accessory adaptor.

Optionally, the link comprises an opening within the link body, the opening configured to receive an independent accessory adaptor, said independent accessory adaptor configured for attaching an accessory onto the link via the accessory adaptor.

Optionally, the independent accessory adaptor is an extractable accessory adaptor configured to be inserted into the opening and be extracted from the opening.

Optionally, the extractable accessory adaptor comprises a locking mechanism, the locking mechanism comprising a protruding tooth located on each side of the extractable accessory adaptor, each of the protruding teeth configured to be pushed against a corresponding indent along either side of the link body, wherein, when the extractable accessory adaptor is pushed into the opening within the link body, each protruding tooth is pushed against its corresponding indent to secure the extractable accessory adaptor into the link body.

Optionally, each of the protruding teeth is connected to a squeezable wing, the two squeezable wings located on opposite sides of the accessory adaptor, wherein when the squeezable wings are squeezed towards the middle of the extractable accessory adaptor, each protruding tooth is pulled away from its corresponding indent to extract the extractable accessory adaptor from the link body.

Optionally, the extractable accessory adaptor is replaceable with other extractable accessory adaptors.

Optionally, the extractable accessory adaptor includes at least one of: a GoPro camera adaptor, a picatinny rail, an adaptor with holes for screws, an adaptor configured to attach an accessory via an elastic band connected thereon, or any combination thereof.

Optionally, the link comprises an opening within the link body, the opening configured to receive an extractable cap configured to cover the opening.

A link-based helmet mounting unit for attaching accessories onto a helmet is provided. The link-based helmet mounting unit comprises a plurality of links connected to one another, whereby the plurality of links comprise:

a first link comprising: a first link body; a first end comprising a first clip configured to connect the first link to a first edge of the helmet; and a second end comprising at least one hook connected to the link body via an elongated arm, said elongated arm comprising a curved end;

an end link comprising: an end link body; a first end comprising an end clip configured to connect the end link to a second edge of the helmet opposite the first edge; and a second end comprising a rod;

a plurality of middle links, wherein each middle link comprises: a link body; a first end comprising a rod; and a second end comprising at least one hook connected to the link body via an elongated arm, said elongated arm comprising a curved end.

In some embodiments, the first clip is connected to the first edge of the helmet and the at least one hook of the first link is connected onto the rod of the middle link. Optionally, the at least one hook of the middle link is connected onto a rod of another middle link via the curved end of the middle link hugging the rod of the other middle link, and so on until a middle link is connected to the end link via the curved end of the middle link hugging the rod of the end link and the end clip is connected to the second edge of the helmet, thereby connecting the plurality of links to one another to form the helmet mounting unit connected onto a circumference of the helmet.

Optionally, the at least one hook of the first and middle links comprises two hooks positioned on each side of the second end of the first and middle links.

Optionally, each open end of each of the two hooks are positioned towards the same direction.

Optionally, each open end of each of the two hooks are positioned towards opposite directions.

Optionally, the at least one hook of the first and middle links comprises a step along the elongated arm, the step configured to prevent easy disconnection of the rod of a connected link from the at least one hook by partially blocking movement of the rod away from the curved end of the at least one hook.

Optionally, the step is located substantially at the middle of the elongated arm.

Optionally, the first and/or middle link further comprise an accessory adaptor integrated as part of the first and/or middle link, the accessory adaptor configured for attaching an accessory onto the first and/or middle link via the accessory adaptor.

Optionally, the first and/or middle link comprises an opening within the first and/or middle link body, the opening configured to receive an independent accessory adaptor, said independent accessory adaptor configured for attaching an accessory onto the first and/or middle link via the accessory adaptor.

Optionally, the independent accessory adaptor is an extractable accessory adaptor configured to be inserted into the opening of the first and/or middle link and be extracted from the opening.

Optionally, the extractable accessory adaptor comprises a locking mechanism, the locking mechanism comprising a protruding tooth located on each side of the extractable accessory adaptor, each of the protruding teeth configured to be pushed against a corresponding indent along either side of the link body of the first and/or middle link, wherein, when the extractable accessory adaptor is pushed into the opening within the first and/or middle link body, each protruding tooth is pushed against its corresponding indent to secure the extractable accessory adaptor into the link body of the first and/or middle link.

Optionally, each of the protruding teeth is connected to a squeezable wing, the two squeezable wings located on opposite sides of the accessory adaptor, wherein when the squeezable wings are squeezed towards the middle of the extractable accessory adaptor, each protruding tooth is pulled away from its corresponding indent to extract the extractable accessory adaptor from the link body of the first and/or middle link.

Optionally, the extractable accessory adaptor is replaceable with other extractable accessory adaptors.

Optionally, the extractable accessory adaptor includes at least one of: a GoPro camera, a picatinny rail, an adaptor with holes for screws, an adaptor configured to attach an accessory via an elastic band connected thereon, or any combination thereof.

Optionally, the first and/or middle link comprises an opening within the link body, the opening configured to receive an extractable cover configured to cover the opening.

Optionally, the end link further comprises a tightening mechanism configured to pull the connected links towards the end link and pull the rod of the end link body towards the end clip to thereby tighten the plurality of links onto the external circumference of the helmet between the first and second edges of the helmet.

Optionally, the tightening mechanism comprises a rotatable knob or dial, wherein when the dial is turned in a first direction, the end link body is pulled towards the end clip, which in turn pulls the connected middle and first link towards the end clip, thereby tightening the plurality of links onto the external circumference of the helmet between the first and second edges of the helmet, and wherein the dial is turned in a second opposite direction, the end link body is pushes away from the end clip to thereby untighten the plurality of links and distant them from the external circumference of the helmet.

BRIEF DESCRIPTION OF THE DRAWINGS

The present disclosure will be understood and better appreciated from the following detailed description taken in conjunction with the drawings. Identical structures, elements or parts, which appear in more than one figure, are generally labeled with the same or similar number in all the figures in which they appear, wherein:

FIG. 20B is a schematic illustration of a perspective side view of a first front link of a helmet mounting unit comprising a wire dial and no screws, according to an embodiment of the disclosure;

FIGS. 20C-20D are schematic illustrations of a side view, and a front view of a first front link of a helmet mounting unit comprising a wire dial and no screws, respectively, according to an embodiment of the disclosure;

FIGS. 25A-25F are schematic illustrations of a first link of a plurality of links from which a helmet mounting unit is comprised of, according to another embodiment of the present disclosure;

FIGS. 26A-26C are schematic illustrations of the first link of FIGS. 25A-25F as it is assembled as part of the link-based helmet mounting unit, according to another embodiment of the present disclosure;

FIGS. 29A-29D are schematic illustrations another middle link according to embodiments of the present disclosure;

FIGS. 30A-30B are schematic illustrations of the middle link of FIGS. 29A-29D as it is assembled as part of the link-based helmet mounting unit, according to embodiments of the present disclosure;

FIGS. 31A-31E are schematic illustrations of a middle link comprising an integral GoPro adaptor, according to embodiments of the present disclosure;

FIGS. 32A-32B are schematic illustrations of the middle link of FIGS. 31A-31E as it is assembled as part of the link-based helmet mounting unit, according to embodiments of the present disclosure;

FIGS. 33A-33E are schematic illustrations of a middle link comprising an integral Picatinny adaptor, according to embodiments of the present disclosure;

FIGS. 34A-34B are schematic illustrations of the middle link of FIGS. 33A-33E as it is assembled as part of the link-based helmet mounting unit, according to embodiments of the present disclosure;

FIGS. 35A-35E are schematic illustrations of a middle link comprising an integral Dove-tail type adaptor, according to embodiments of the present disclosure;

FIGS. 36A-36B are schematic illustrations of the middle link of FIGS. 35A-35E as it is assembled as part of the link-based helmet mounting unit, according to embodiments of the present disclosure;

FIGS. 41-45 schematically illustrate different examples for caps and/or extractable caps integrally incorporating different types of accessory adaptors, according to embodiments of the present disclosure;

FIGS. 46A-46B schematically illustrate a helmet mounding unit comprising the different caps of FIGS. 41-45 as they are assembled as part of the link-based helmet mounting unit, according to embodiments of the present disclosure;

FIGS. 49A-48B are schematic illustrations of the end link of FIGS. 48A-48F as it is assembled as part of the link-based helmet mounting unit, according to embodiments of the present disclosure;

DETAILED DESCRIPTION

The present disclosure provides a link-based helmet mounting unit comprising a plurality of detachable links connected to one another. The link-based helmet mounting unit of the present disclosure offers the user the ability to adjust the length of the link-based helmet mounting unit by adding or removing links. In addition, the link-based helmet mounting unit of the present disclosure enables a user to replace only a part of it, instead of replacing the entire helmet mounting unit, in case a section of the helmet mounting unit has been damaged or broken. Some of the detachable links may be connected to either of the edges of the helmet onto which the mounting unit is to be placed and tightened against. Thus, the 'first' and 'end' links, i.e., the links located at each of the ends of the link-based helmet mounting unit, should have a shape configured to fit onto each of the helmet edges, and possibly to comprise connectors and/or clips for connecting and tightening the helmet mounting unit onto the helmet. Other detachable links may be the links which connect the two 'end' links therethrough and form the main body of the helmet mounting unit. Any of the links may either comprise an integral accessory adaptor or may be configured to have attached thereon an accessory adaptor, which may be interchangeable.

In some embodiments, the front link may comprise a first front link and a second front link, configured to be connected to one another, while the first front link may be connected to the front edge of the helmet, and the second front link may be connected to the first front link and may comprise connectors for holding various systems, such as viewing systems, e.g., Microsoft's WAS, or any other required accessory.

Figure 1:
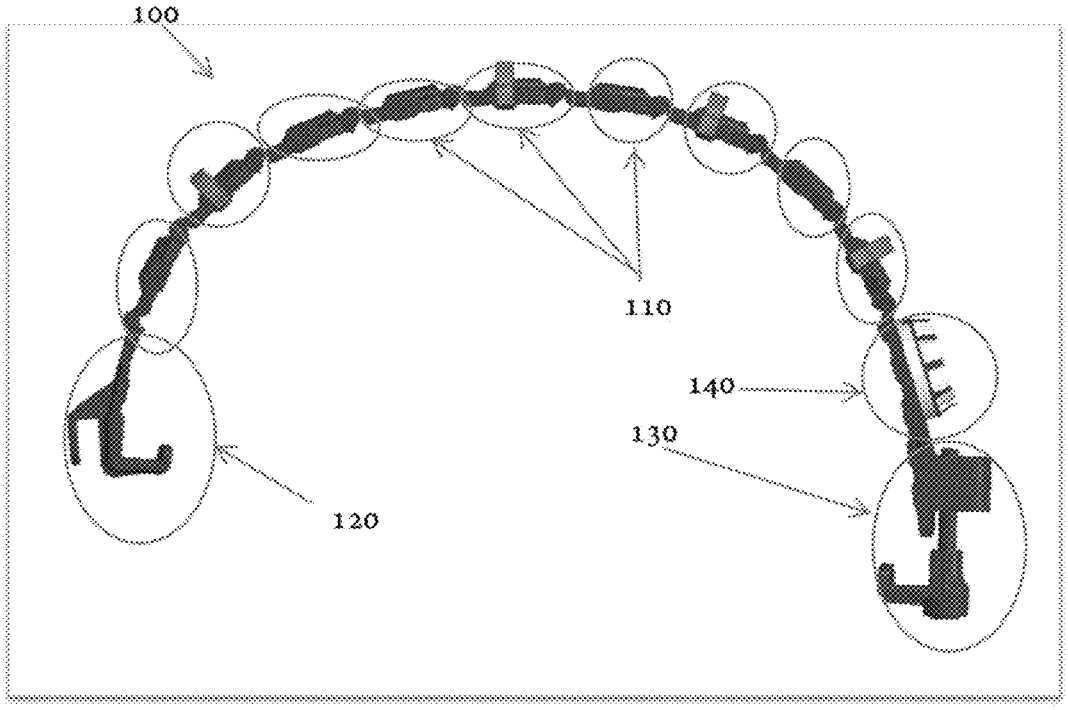
FIG. 1 is a schematic illustration of a side view of a helmet mounting unit comprised of a plurality of links connected to one another, according to an embodiment of the disclosure.

FIG. 1 is a schematic illustration of a side view of a helmet mounting unit 100 comprised of a plurality of links connected to one another, according to an embodiment of the disclosure. Some of the links are mere connecting links 110, which have the same shape and which reappear along the helmet mounting unit 100, whereas some of the links have a unique shape configured to connect them onto the edge of a helmet, e.g., links 120, 130 and 140.

Figure 2:
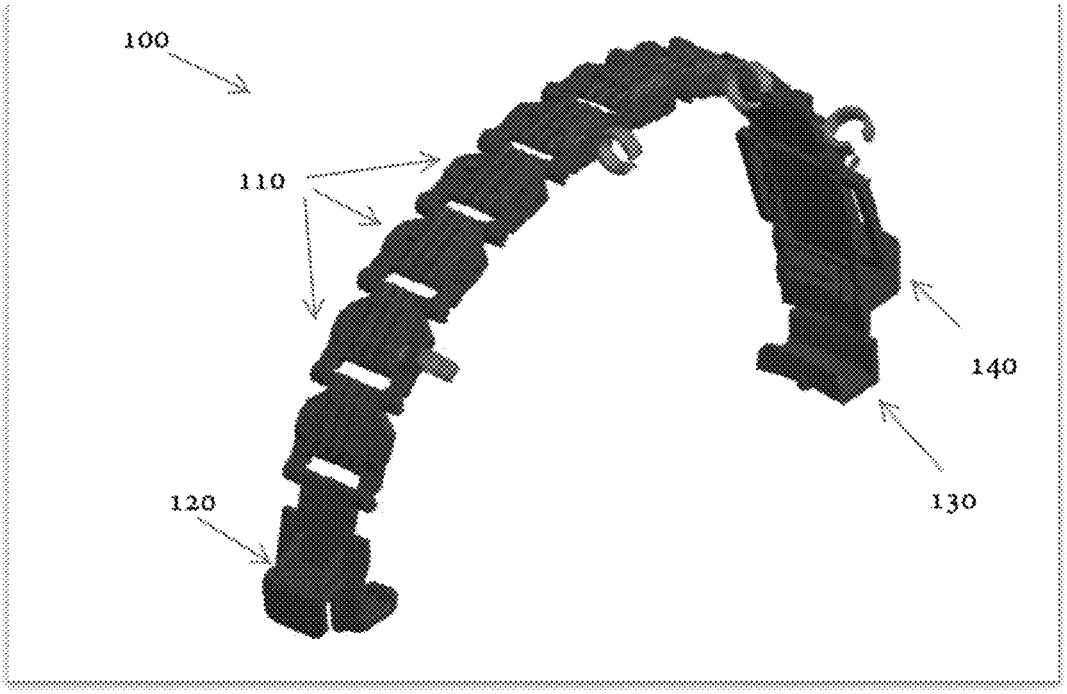
FIG. 2 is a schematic illustration of a perspective side view of the helmet mounting unit, according to an embodiment of the disclosure.

FIG. 2 is a schematic illustration of a perspective top view of the helmet mounting unit 100, according to an embodiment of the disclosure.

Figure 3A:
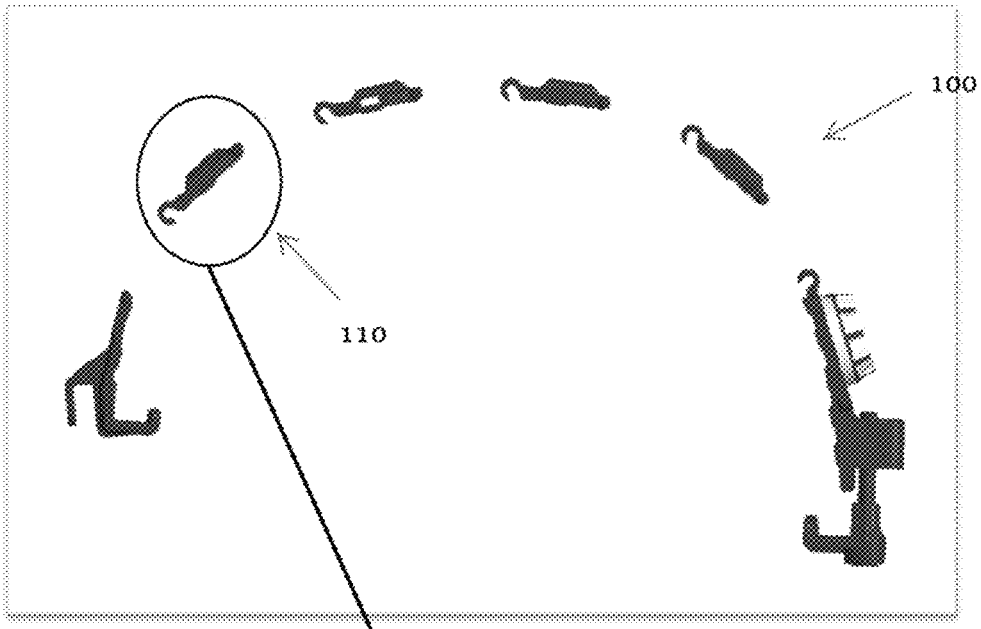
FIG. 3A is a schematic illustration of an exploded view of the helmet mounting unit, according to an embodiment of the disclosure.

FIG. 3A is a schematic illustration of an exploded view of the helmet mounting unit 100, according to an embodiment of the disclosure, illustrating each of the plurality of links disconnected from any adjacent link.

Figure 3B:
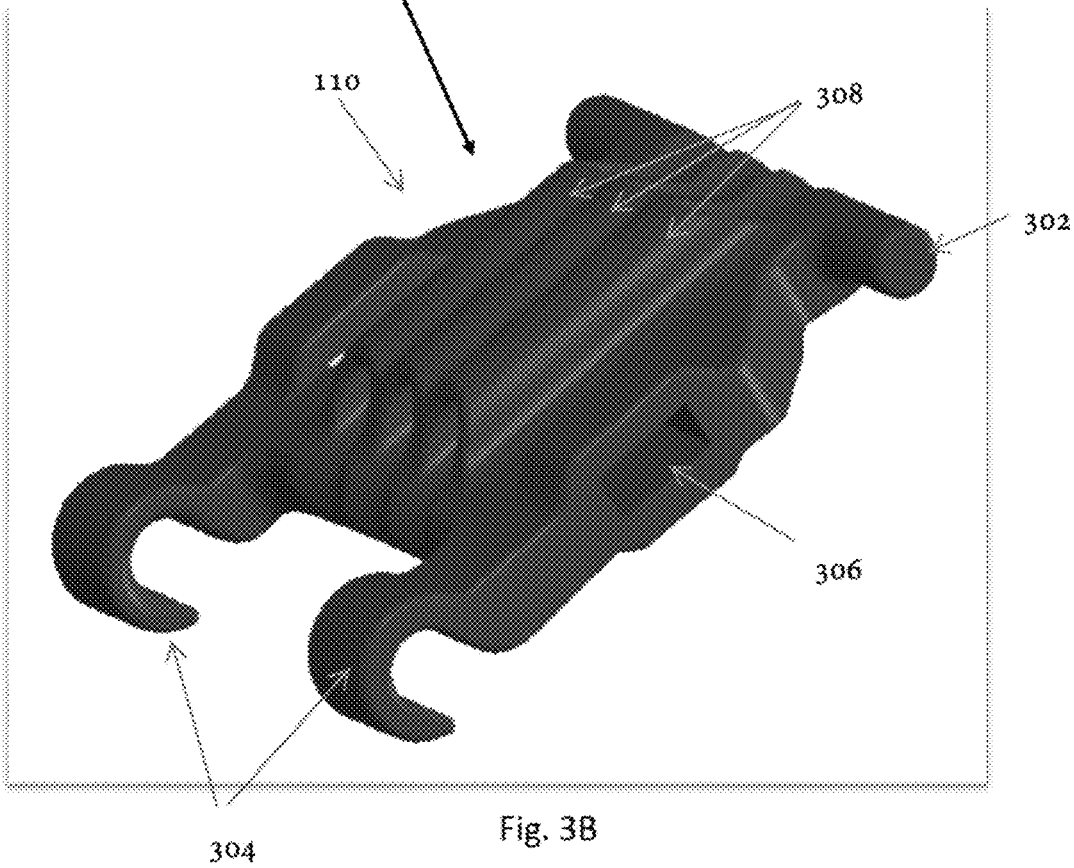
FIG. 3B is a schematic illustration of a close-up perspective top view of a link of the helmet mounting unit, according to an embodiment of the disclosure.

FIG. 3B is a schematic illustration of a close-up perspective top view of a link of the helmet mounting unit, according to an embodiment of the disclosure. According to some embodiments, link 110, which is a connecting link reappearing between the 'end' links, e.g., front and back links of helmet mounting unit 100, may comprise a rod 302 located at one end of link 110 and at least one hook 304, which may be located at an opposite end of link 110. When connecting links 110 to one another, the at least one hook 304 of one link 110 may be pushed onto a corresponding rod 302 of an adjacent link 110. This hook-and-rod configuration may be easy to assemble as well as disassemble, to thus enable a user to easily disconnect a broken or damaged link, e.g., link 110 from the chain of links creating the helmet mounting unit 100, replace the damaged/broken link with a new one and quickly connect the new link to the other links to reassemble helmet mounting unit 100. A user may push the at least one hook 304 onto rod 302 when assembling a link as part of helmet mounting unit 100, and may pull the at least one hook 304 off rod 302 when disassembling a link from helmet mounting unit 100.

In some embodiments, link 110 may further comprise a hole 306 into which a wire carrier may be inserted, as will be explained below.

In some embodiments, link 110 may comprise at least one tunnel-like structures 308, typically located at the top side of link 110, through which wires may be passed. These wires will be discussed below, as they provide tightening of helmet mounting unit 100 onto a helmet, as well as enable helmet mounting unit 100 to carry accessories, typically at the front side of helmet mounting unit 100, though the back side is also optional for carrying such.

Figure 3C:
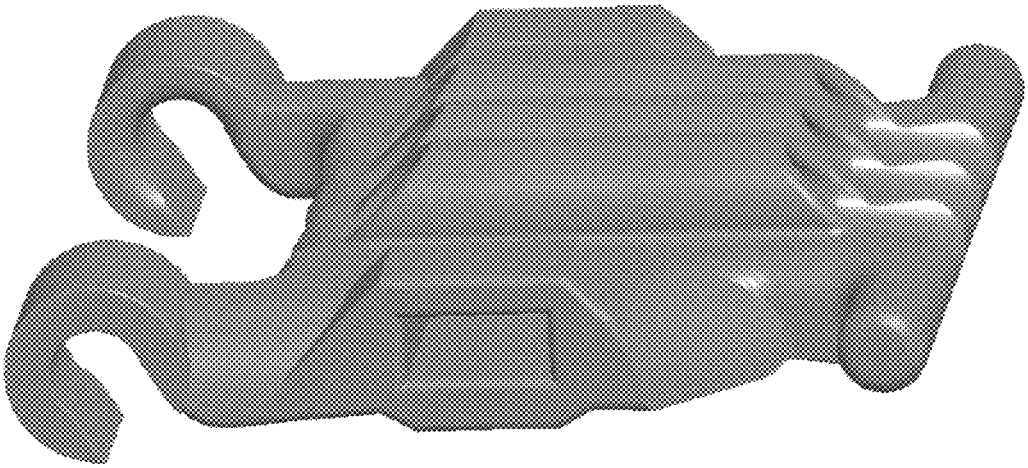
FIGS. 3C-3D are schematic illustrations of a perspective side view, and a top view of a link of the helmet mounting unit, respectively, according to an embodiment of the disclosure.
Figure 3D:
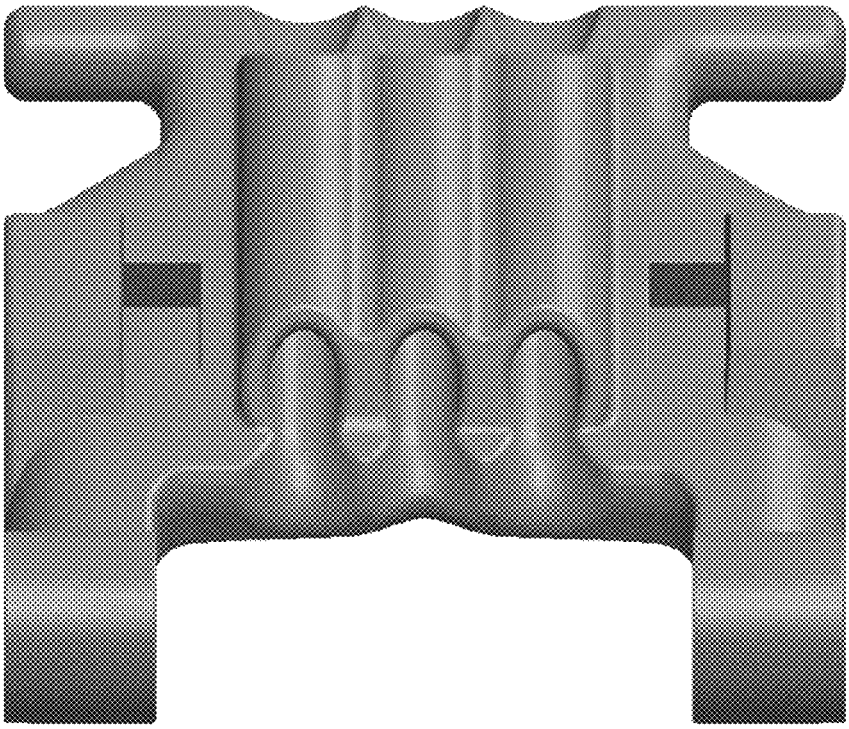
Figure 3E:
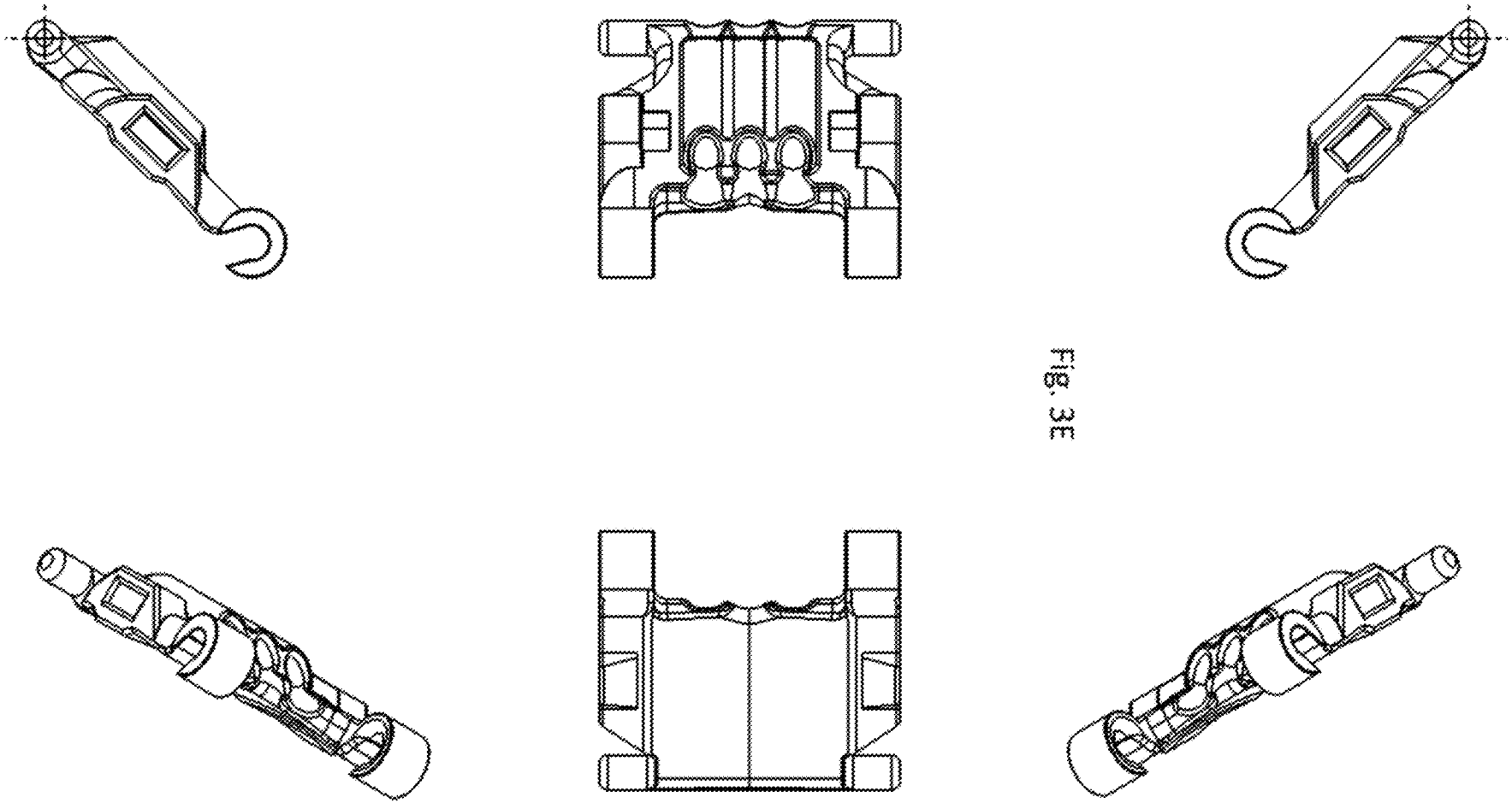
FIG. 3E are schematic illustrations of different views of a link of the helmet mounting unit, according to an embodiment of the disclosure.

FIGS. 3C-3D are schematic illustrations of a perspective side view, and a top view of a link of the helmet mounting unit, respectively, according to an embodiment of the disclosure, and FIG. 3E are schematic illustrations of different views of a link of the helmet mounting unit, according to an embodiment of the disclosure.

Figure 4:
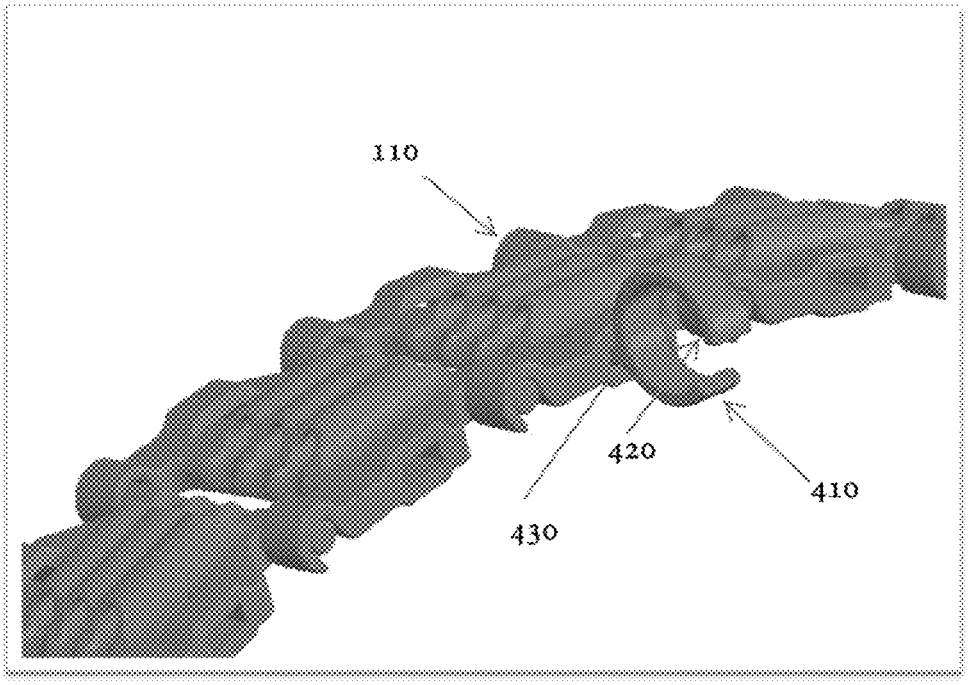
FIG. 4 is a schematic illustration of a perspective side view of the link with a wire carrier, according to an embodiment of the disclosure.
Figure 5:
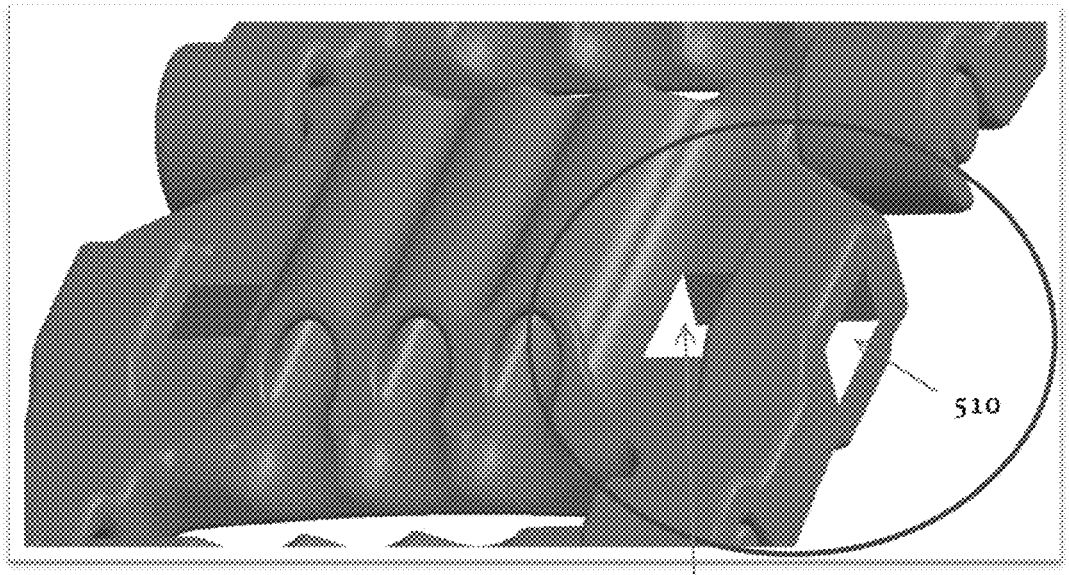
FIG. 5 is a schematic illustration of the hole in the link into which the wire carrier is inserted, according to an embodiment of the disclosure.

FIG. 4 is a schematic illustration of a perspective side view of the link 110 with a wire carrier 410, according to an embodiment of the disclosure, and FIG. 5 is a schematic illustration of the hole in the link into which the wire carrier is inserted, according to an embodiment of the disclosure. In some embodiments, in case a user carries goggles or any other accessory that contains wires, e.g., electrical wires, the user may add to link 110 wire carriers 410. A user may add one of several wire carriers 410 into a corresponding one of several links 110, such to have wires extending from an accessory to pass through wire carriers 410, e.g., through space 420 created by the shape of wire carrier 410. Passing wires through at least one wire carrier 410 may assist the user in positioning the wires along the mounting unit 100, such to avoid interference of the wire with the user's line of sight and/or avoid tangling of the wire around the user's face, body, helmet, etc.

Wire carrier 410 may be inserted into a designated hole 510. Specifically, one extending section of wire carrier 410 may be inserted into hole 510 to connect wire carrier 410 to link 110.

Figure 6:
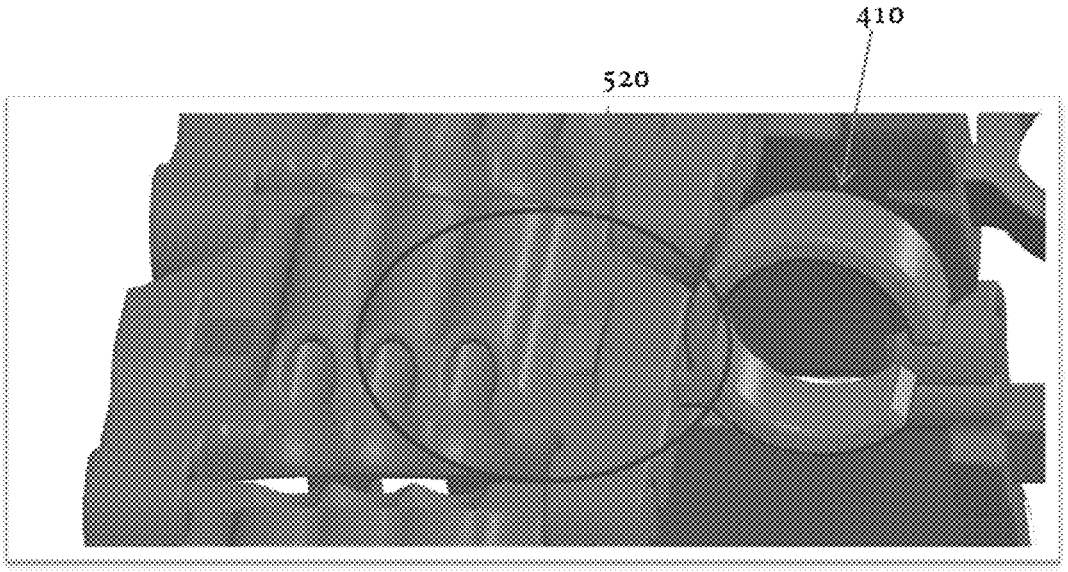
FIG. 6 is a schematic illustration of a wire carrier clip for the release of the wire carrier from the link, according to an embodiment of the disclosure.

FIG. 6 is a schematic illustration of a wire carrier clip for the release of the wire carrier from the link, according to an embodiment of the disclosure. In some embodiments, wire carrier 410 may comprise an extending end 430 that may be inserted into hole 510. The extending end 430 may comprise a section 520 which may operate as a clip. Once inserted into hole 510, clip 520, which is typically made of a flexible material, may be pushed into hole 530 and due to its flexibility, clip 520 may pop out of hole 530. In some cases, the extending end 430 may comprise a sort of clip 520, which may be pressed in case wire carrier 410 is to be removed from link 110. In such case, once clip 520 is pressed into hole 530, wire carrier 410 may be pulled out of hole 510 and thus be detached from link 110. In order to attach or reattach wire carrier 410 to link 110, clip 520 may be pushed into hole 510 until clip 520 is pushed into and out of hole 530 to lock wire carrier 410 in place within link 110.

Figure 7:
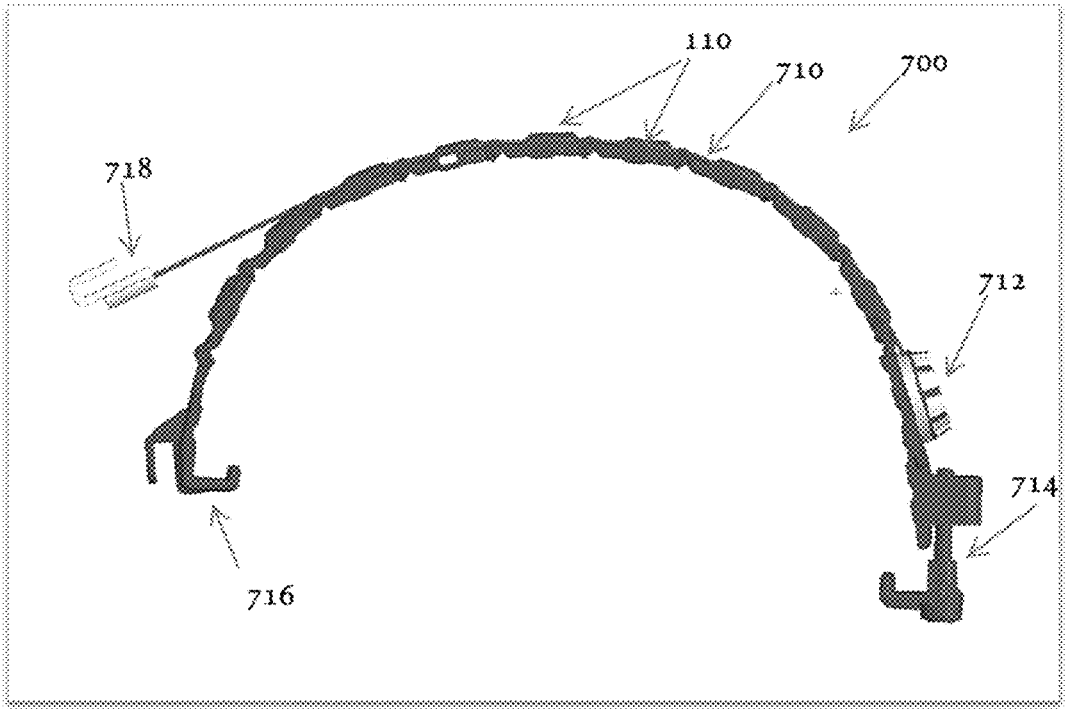
FIG. 7 is a schematic illustration of a side view of a helmet mounting unit comprising wires, a wire dial and a front clip for attaching an accessory at the front side of the helmet, according to an embodiment of the disclosure.

FIG. 7 is a schematic illustration of a side view of a helmet mounting unit comprising wires, a wire dial and a front clip for attaching an accessory at the front side of the helmet and a back clip comprising at least one screw, according to an embodiment of the disclosure. In some embodiments, another helmet mounting unit 700 may comprise wires 710 passing through the links that mounting unit 700 is comprised of, e.g., links 110. Wires 710 may pass through the links to enable attachment of an accessory at the front end of mounting unit 700, e.g., the Microsoft IVAS. That is, IVAS may be connected to mounting unit 700 via wires 710.

In some embodiments, wires 710 may be connected on the front end to connector 718, which may be attached to the WAS or any other accessory. Mounting unit 700 may comprise a front clip 716, which may be positioned onto the front edge of the helmet to which mounting unit 700 is attached.

In some embodiments, mounting unit 700 may further comprise on its rear end a wire dial 712, which may be configured to turn and thereby pull wires 710 around dial 712 and towards the rear or back end of mounting unit 700, thereby to tighten the WAS or other accessory to mounting unit 700, as well as tighten mounting unit 700 onto a helmet.

In some embodiments, wires 710 along with wire dial 712 may be used to tighten an accessory onto mounting unit 700, and a back clip 714, may be configured to accept at least one screw to pull and thereby tighten mounting unit towards the back end of the helmet, as detailed in U.S. Pat. No. 10,959,473 by the applicant, hereby incorporated by reference.

In other embodiments, as will be explained in detail hereinbelow, the helmet mounting unit need not comprise the back clip 714 that requires screws but rather wires 710 pulled by and turned around wire dial 712, may be used to tighten mounting unit 700 onto a helmet, alone.

Figure 8:
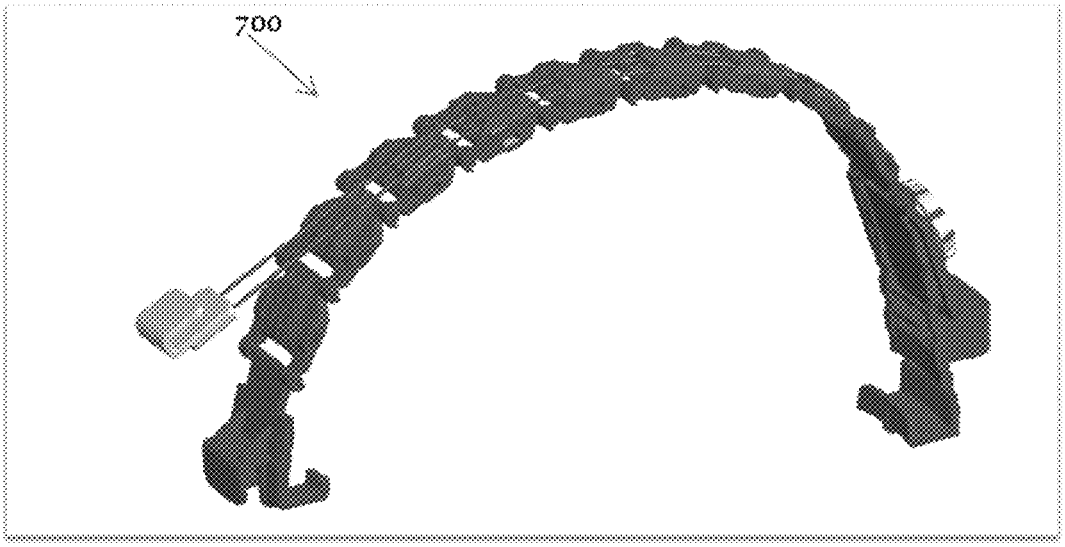
FIG. 8 is a schematic illustration of a perspective top view of a helmet mounting unit comprising wires, a wire dial and a front clip for attaching an accessory at the front side of the helmet, according to an embodiment of the disclosure.
Figure 9:
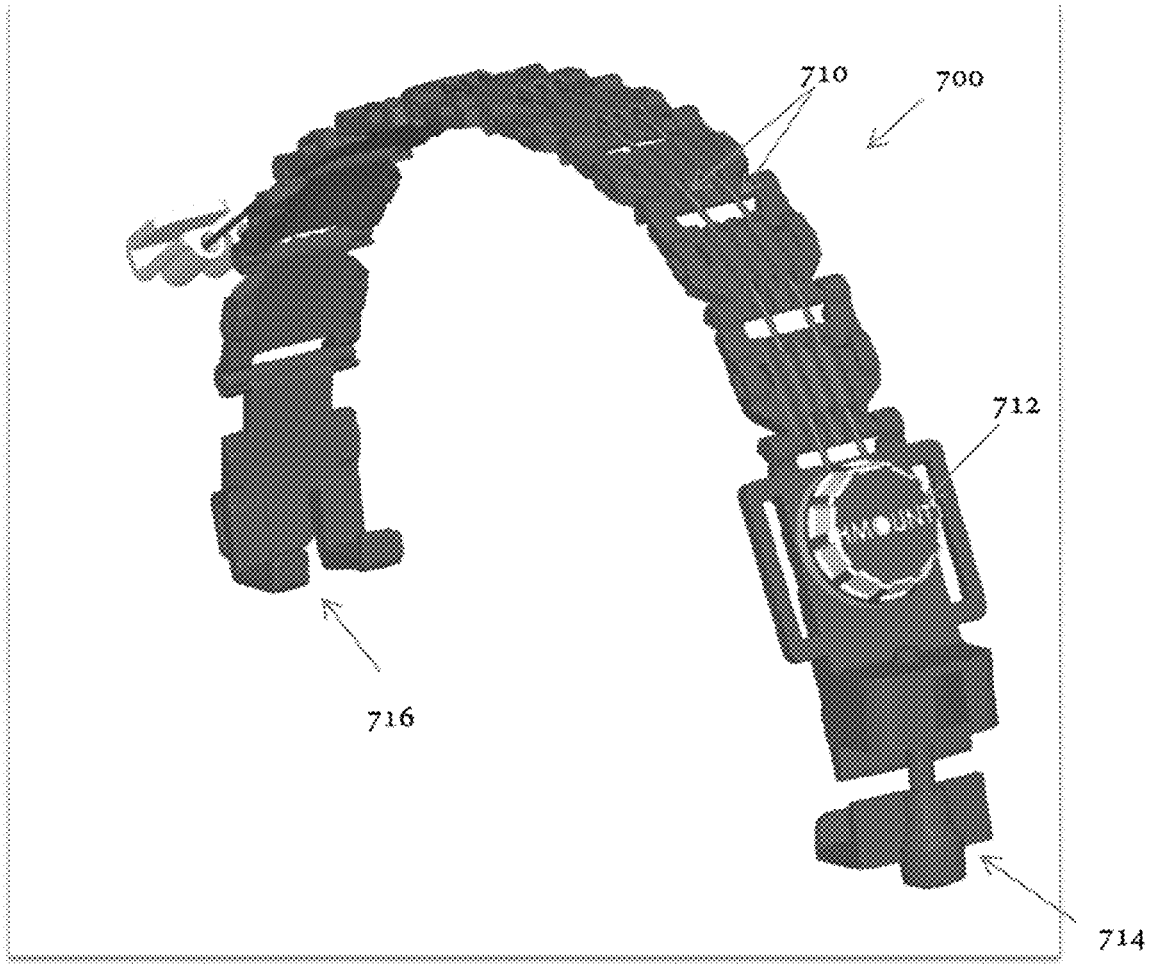
FIG. 9 is a schematic illustration of a perspective side view of a helmet mounting unit comprising wires, a wire dial and a front clip for attaching an accessory at the front side of the helmet, according to an embodiment of the disclosure.

FIG. 8 is a schematic illustration of a perspective top view of a helmet mounting unit 700 comprising wires 710, a wire dial 712 and a front clip 718 for attaching an accessory at the front side of the helmet, according to an embodiment of the disclosure. FIG. 9 is a schematic illustration of a perspective side view of a helmet mounting unit 700 comprising wires 710, a wire dial 712 and a front clip 718 for attaching an accessory at the front side of the helmet, according to an embodiment of the disclosure.

Figure 10:
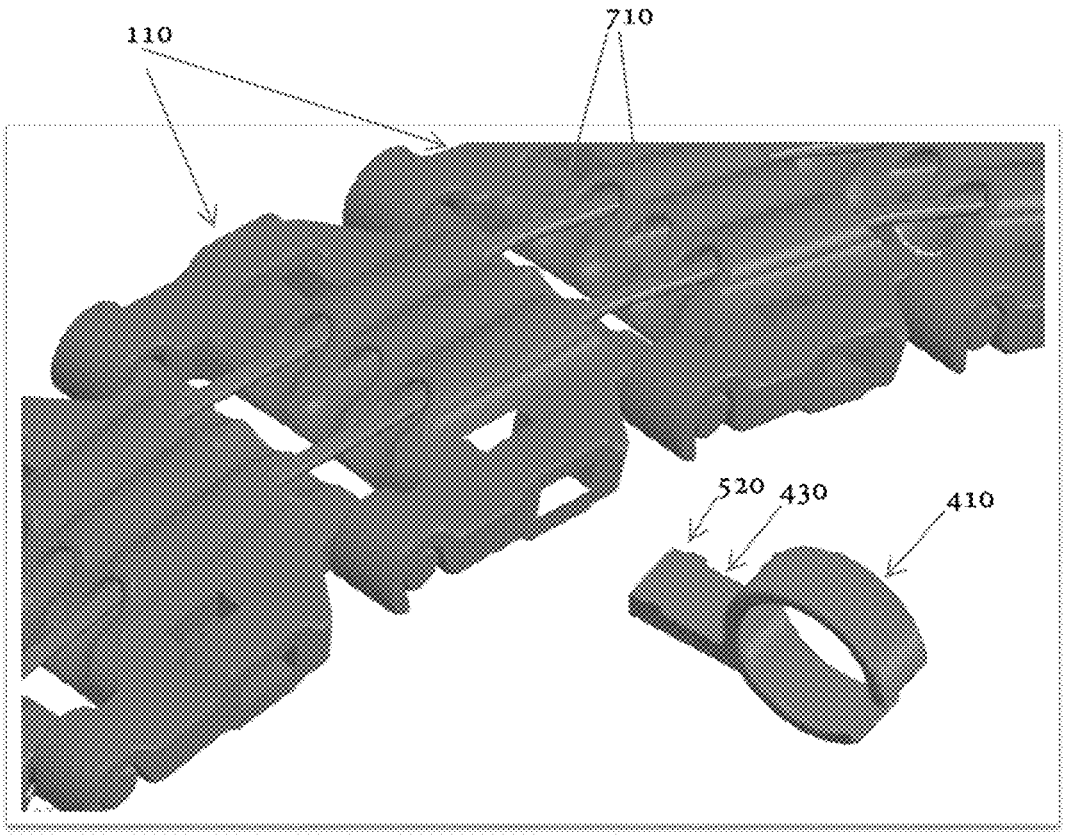
FIG. 10 is a schematic illustration of a top view of links of a helmet mounting unit comprising wires passing therethrough, and a wire carrier disconnected from the links, according to an embodiment of the disclosure.

FIG. 10 is a schematic illustration of a top view of links 110 of a helmet mounting unit comprising wires 710 passing therethrough, and a wire carrier 410 disconnected from the links, according to an embodiment of the disclosure. The wire carrier 410 may be similar to the wire carrier described in FIGS. 4-6.

Figure 11A:
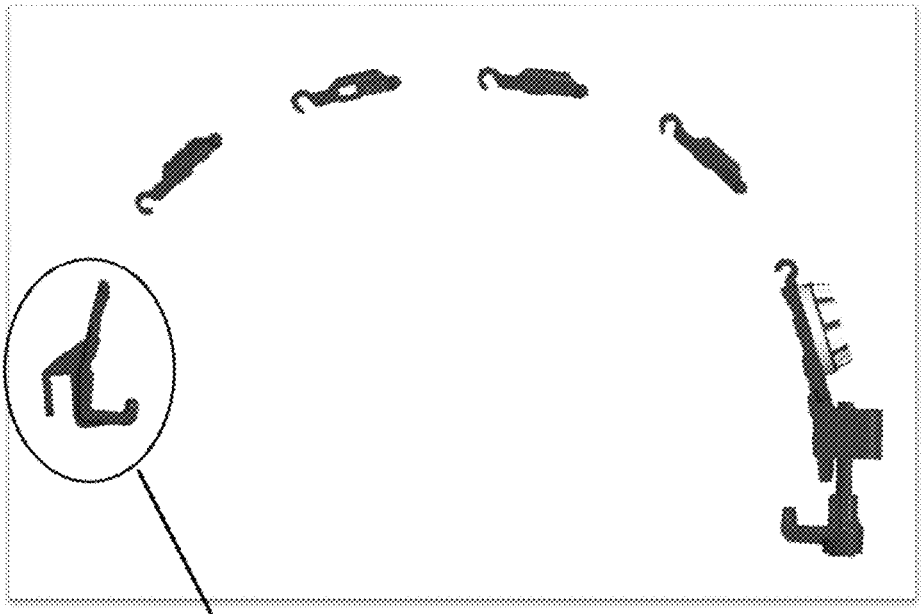
FIG. 11A is a schematic illustration of an exploded view of a helmet mounting unit, according to an embodiment of the disclosure.

FIG. 11A is a schematic illustration of an exploded view of a helmet mounting unit 100, which was illustrated in FIG. 1, according to an embodiment of the disclosure.

Figure 11B:
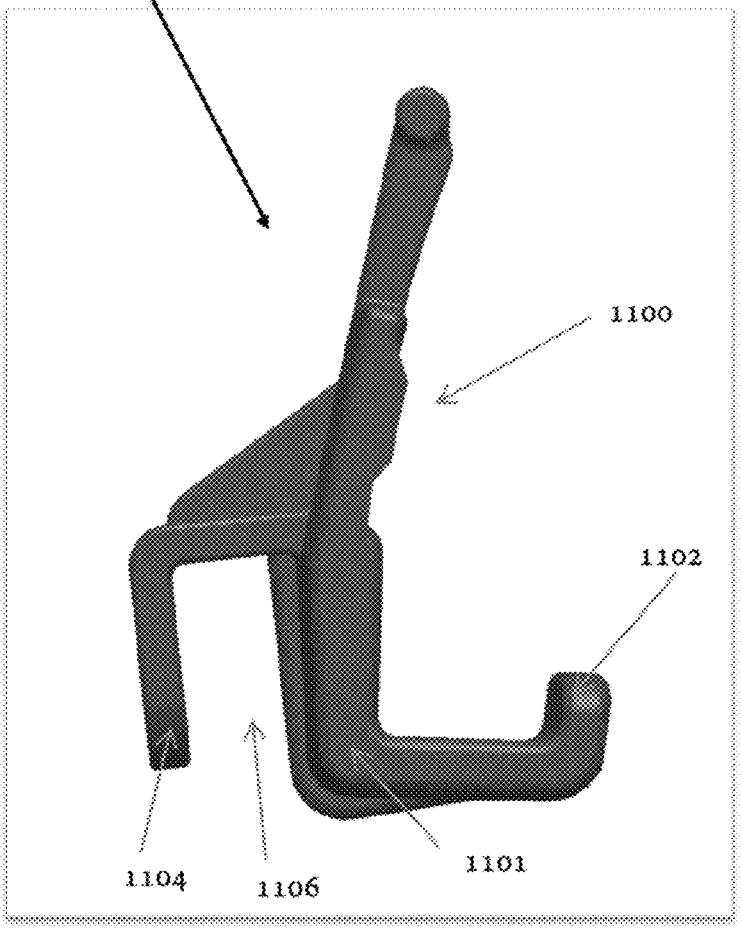
FIG. 11B is a schematic illustration of a close-up side view of a front link of the helmet mounting unit, according to an embodiment of the disclosure.

FIG. 11B is a schematic illustration of a close-up side view of a front link 1100 of the helmet mounting unit 100, according to an embodiment of the disclosure. Front link 1100 may comprise a section 1102, which may be of a shape configured to hug the edge of the front side of the helmet onto which mounting unit 100 is attached. In some embodiments, front link 1100 may comprise a section 1104, which along with backbone 1101 of front link 1100, may create a 'U' shape at the front end of front link 1100. Into the space 1106 created by the 'U' shape may be inserted an accessory connected configured to connect an accessory to mounting unit 100, e.g., the WAS, though other augmented reality systems may be attached.

Figure 11C:
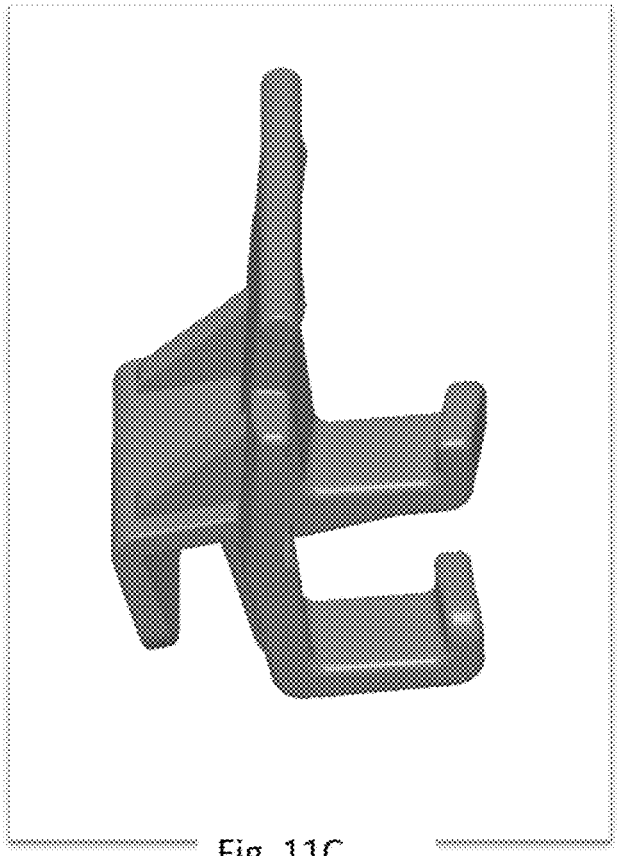
FIGS. 11C-11D are schematic illustrations of a perspective top view, and a rear view of a front link of the helmet mounting unit, respectively, according to an embodiment of the disclosure.
Figure 11D:
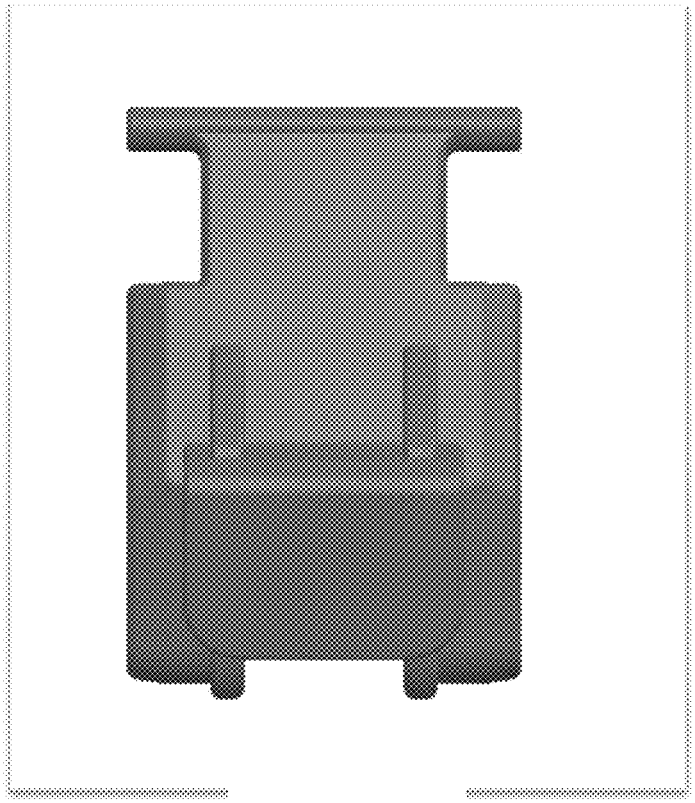

FIGS. 11C-11D are schematic illustrations of a perspective top view, and a rear view of a front link of the helmet mounting unit, respectively, according to an embodiment of the disclosure.

Figure 12A:
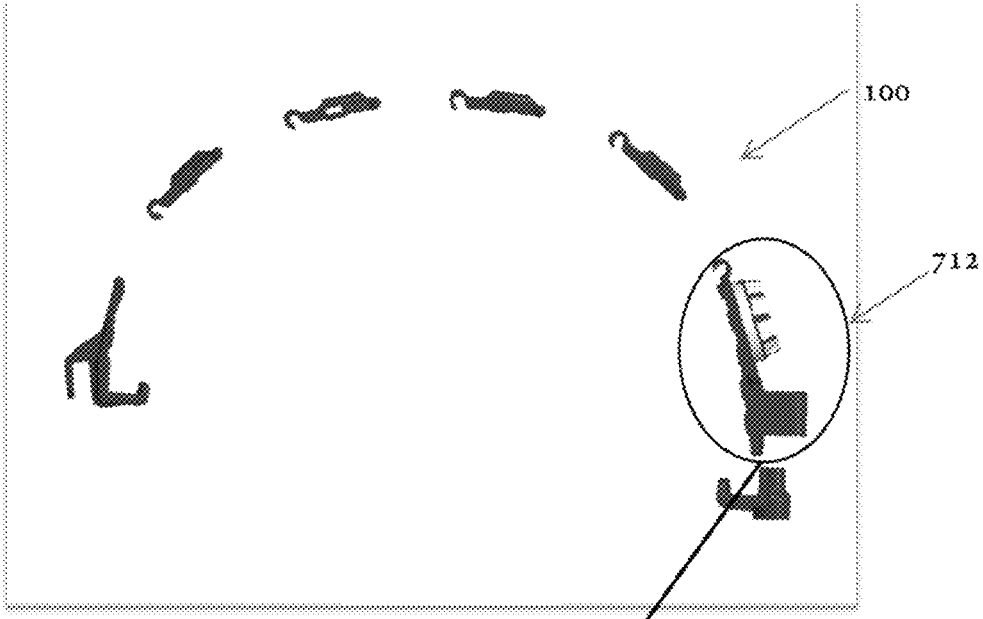
FIG. 12A is a schematic illustration of an exploded view of a helmet mounting unit, according to an embodiment of the disclosure.

FIG. 12A is a schematic illustration of an exploded view of a helmet mounting unit 100 illustrating a wire dial link 712, according to an embodiment of the disclosure.

Figure 12B:
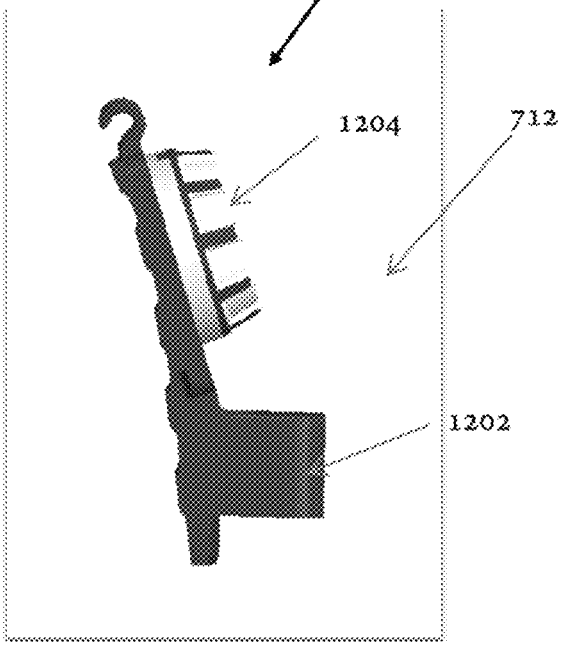
FIG. 12B is a schematic illustration of a close-up side view of a back link of the helmet mounting unit comprising a wire dial, according to an embodiment of the disclosure.

FIG. 12B is a schematic illustration of a close-up side view of a wire dial link 712, according to an embodiment of the disclosure. In some embodiments, wire dial link 712 may comprise a wire dial 1204 attached to a base 1202. In some embodiments, base 1202 may comprise a dent 1206 (FIGS. 12C-12D) in the shape of wire dial 1204 into which wire dial 1204 may be placed and attached to base 1202.

Figure 12C:
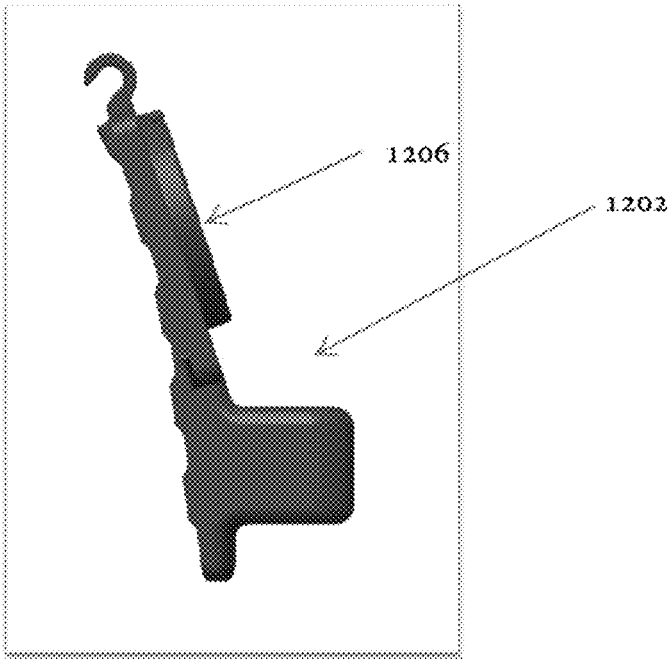
FIGS. 12C-12D are schematic illustrations of a side view, and a front view of a back link of the helmet mounting unit without the wire dial, respectively, according to an embodiment of the disclosure.
Figure 12D:
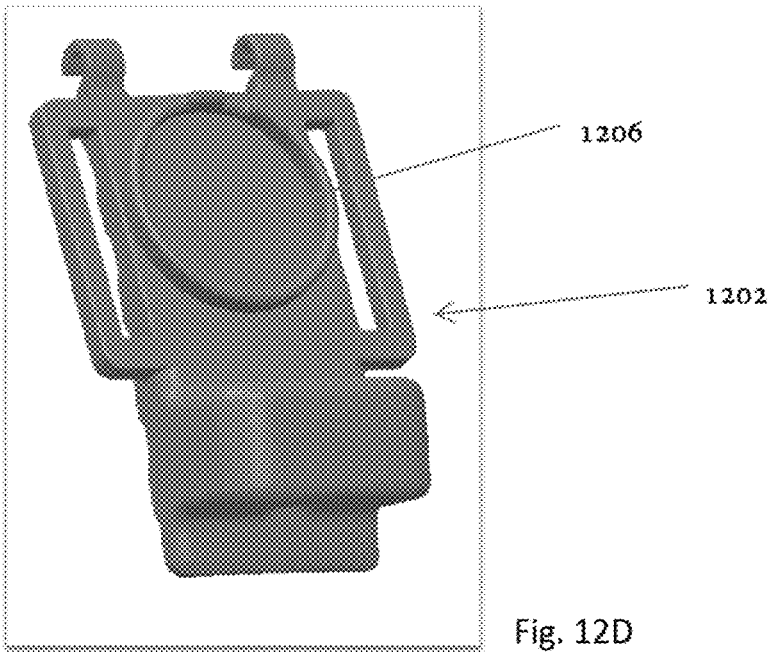

FIGS. 12C-12D are schematic illustrations of a side view, and a front view of a wire dial link of the helmet mounting unit without the wire dial, i.e., of base 1202, respectively, according to an embodiment of the disclosure.

Figure 12E:
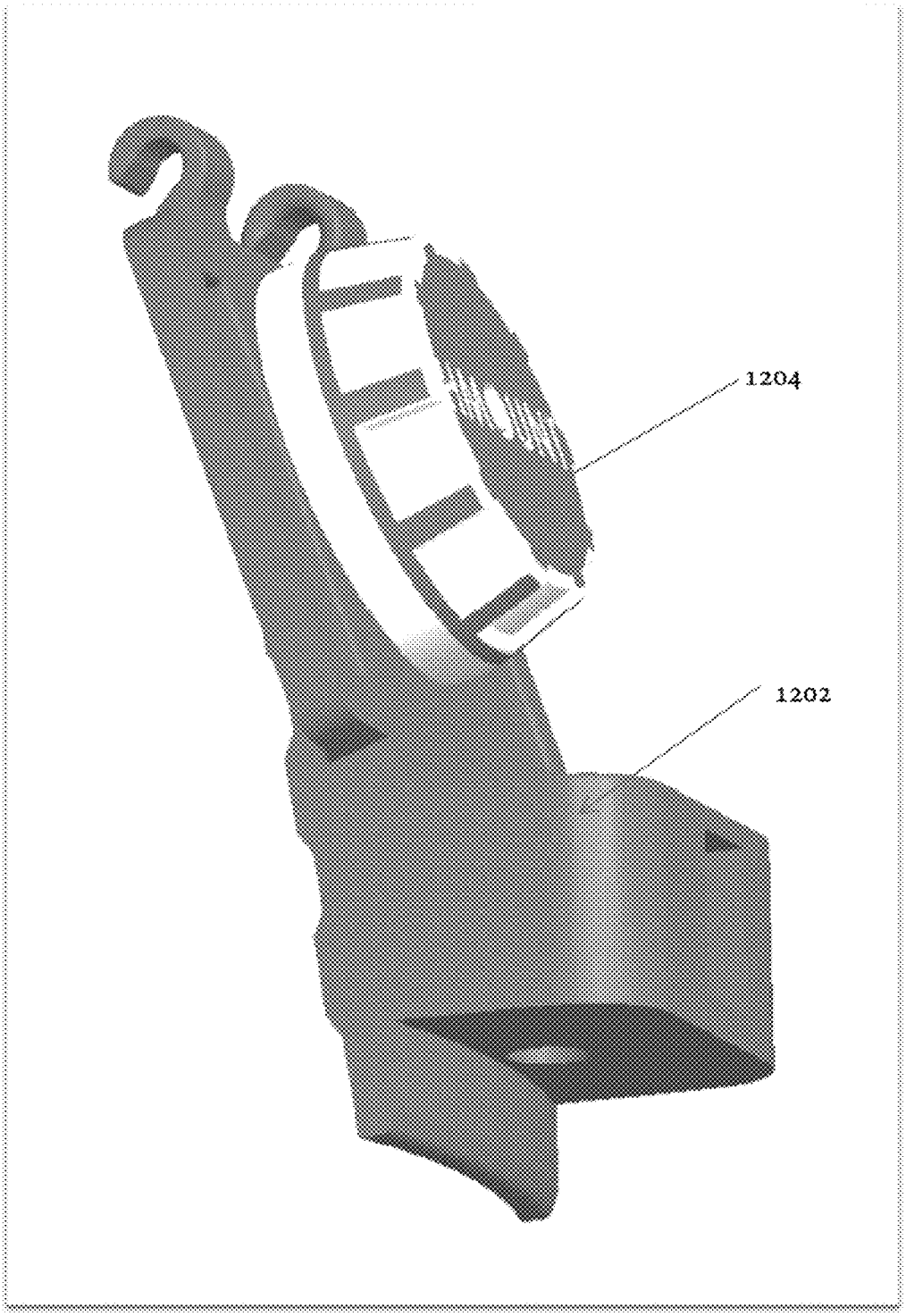
FIG. 12E is a schematic illustration of a perspective side view of a back link of the helmet mounting unit comprising a wire dial, according to an embodiment of the disclosure.

FIG. 12E is a schematic illustration of a perspective side view of a wire dial link 712 of the helmet mounting unit comprising a wire dial 1204, according to an embodiment of the disclosure.

Figure 13:
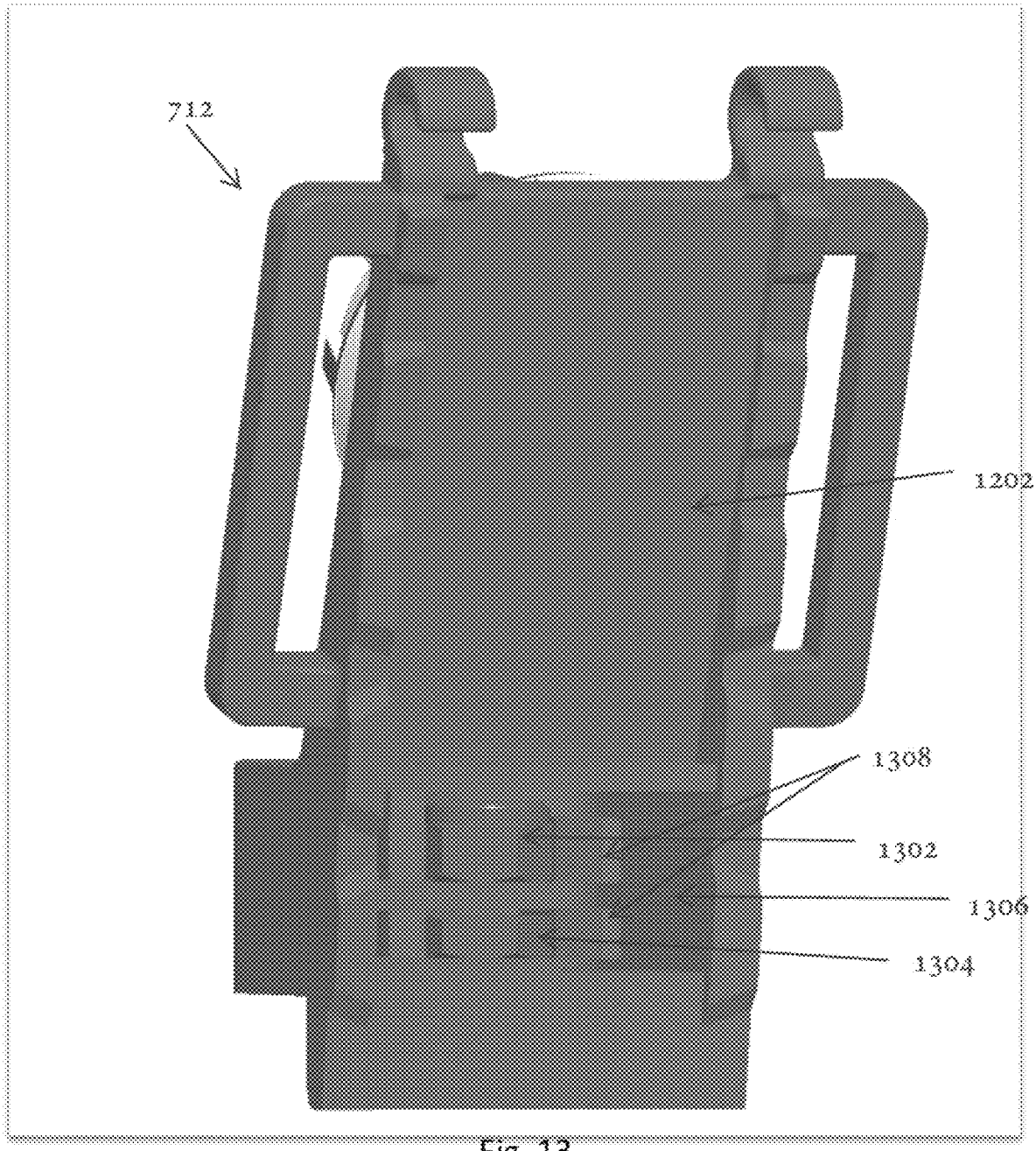
FIG. 13 is a schematic illustration of a rear view of a back link of the helmet mounting unit, according to an embodiment of the disclosure.

FIG. 13 is a schematic illustration of a rear view of a back link of the helmet mounting unit, according to an embodiment of the disclosure. In some embodiments, the helmet mounting unit, such as mounting unit 100, may comprise a back link or clip, which comprises at least one screw that is to be screwed into a nut, as detailed in U.S. Pat. No. 10,959,473 by the applicant, hereby incorporated by reference. As detailed in U.S. Pat. No. 10,959,473, the at least one screw is configured to be screwed into a nut such to tighten the mounting unit onto the helmet. In some embodiments, mounting unit 100 may comprise two nuts at the rear side of wire dial link 712. These two nuts, which may comprise e.g., a larger nut 1302 and a smaller nut 1304, may be inserted into designated holes in the rear side of wire dial link 712. At least one screw is to be screwed through either of these two nuts 1302 or 1304. Incase a user desires a firm long term tightening of the mounting unit onto the helmet, the user may use one nut, e.g., the larger nut 1302, which in some cases may comprise a nyloc nut (or nylon-insert lock nut), which comprises a nylon collar that increases friction on the screw thread. However, if the user desires to firmly tighten the mounting unit onto the helmet in such a way that he could later loosen the attachment between the mounting unit and the helmet, to enable the user to remove the mounting unit from the helmet, and perhaps position the mounting unit onto a different helmet, then the user should screw the at least one screw through the smaller nut 1304, which doesn't comprise a nyloc nut but rather a standard nut.

In some embodiments, the rear side of wire dial link 712 may comprise another hole 1306, into which spare nuts may be positioned, or into which a piece of material may be inserted to apply pressure onto tabs 1308, which in turn apply pressure onto the nuts 1302 and 1304, to keep them in place in their designated holes in rear side of wire dial link 712.

Figure 14:
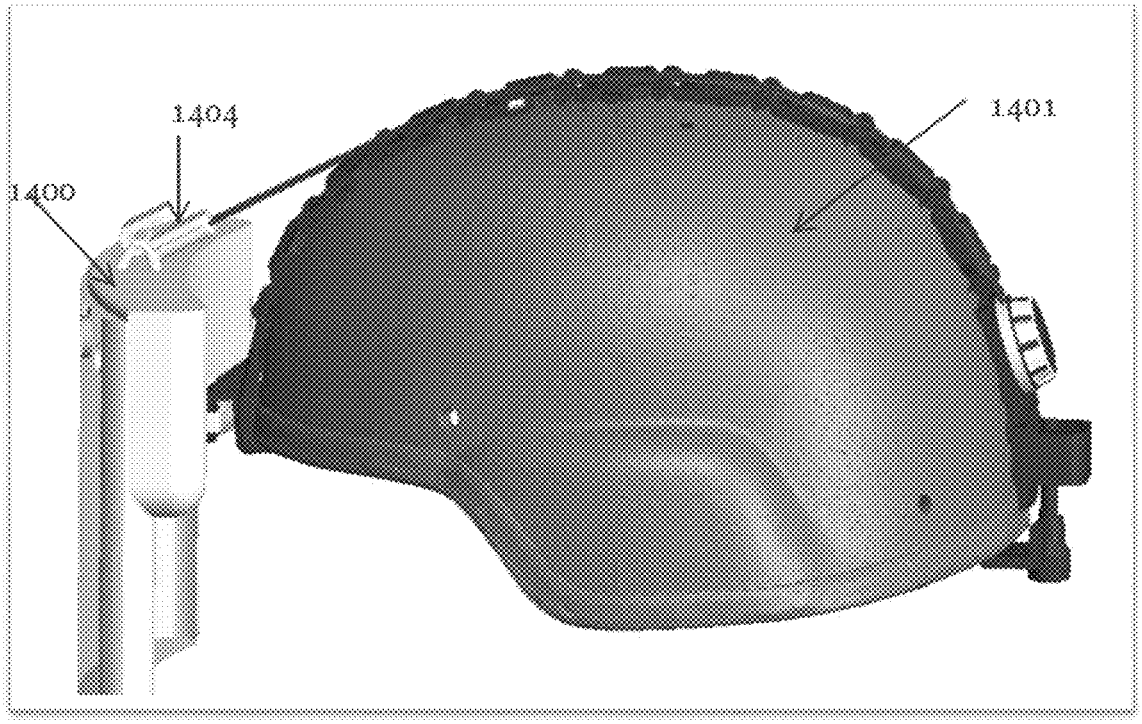
FIG. 14 is a schematic illustration of a side view of a helmet mounting unit tightened onto a helmet, and comprising wires passing through the links, a dial wire and connectors holding the IVAS Microsoft system, according to an embodiment of the disclosure.

FIG. 14 is a schematic illustration of a side view of a helmet mounting unit tightened onto a helmet 1401, and comprising wires passing through the links, a dial wire link and connectors holding the IVAS Microsoft system 1400, according to an embodiment of the disclosure. That is, the wires twisted around and thereby pulled by wire dial 1204 may be connected to a connector 1404, and connector 1404 may be configured to attach the IVAS 1400 to mounting unit 100 via the wires.

Figure 15:
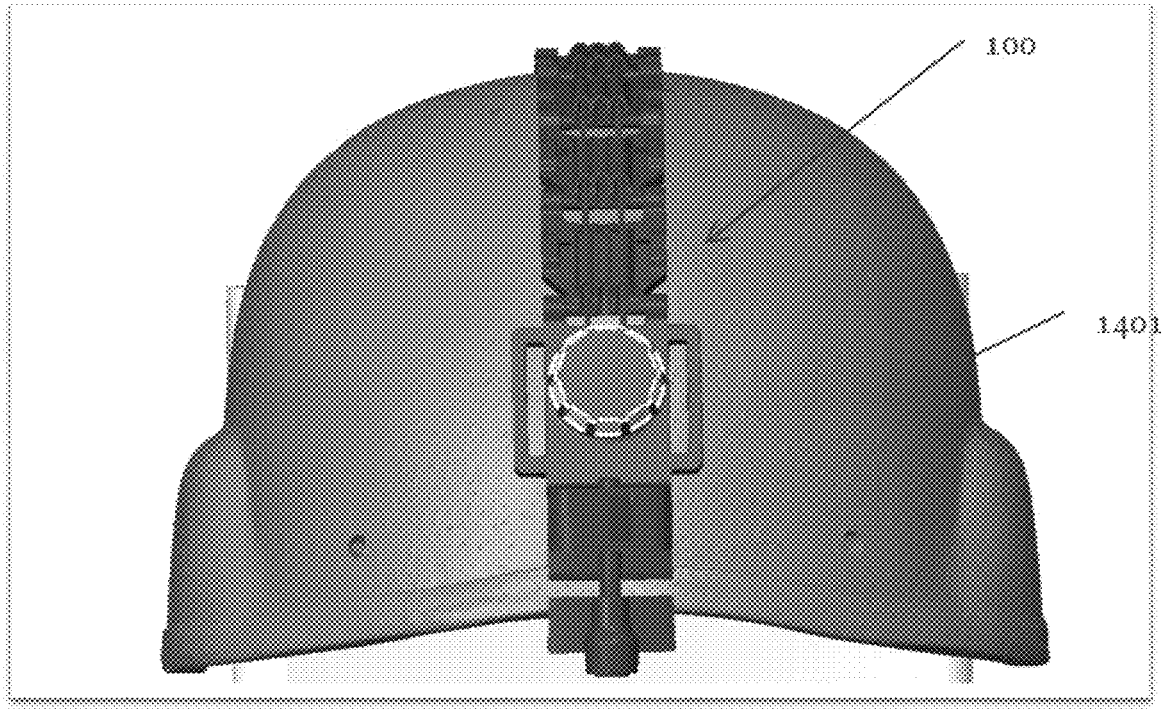
FIG. 15 is a schematic illustration of a rear view of a helmet mounting unit tightened onto a helmet, and comprising wires passing through the links, a dial wire, according to an embodiment of the disclosure.

FIG. 15 is a schematic illustration of a rear view of a helmet mounting unit 100 tightened onto a helmet 1401, and comprising wires passing through the links, and a dial wire link comprising a wire dial, according to an embodiment of the disclosure.

Figure 16:
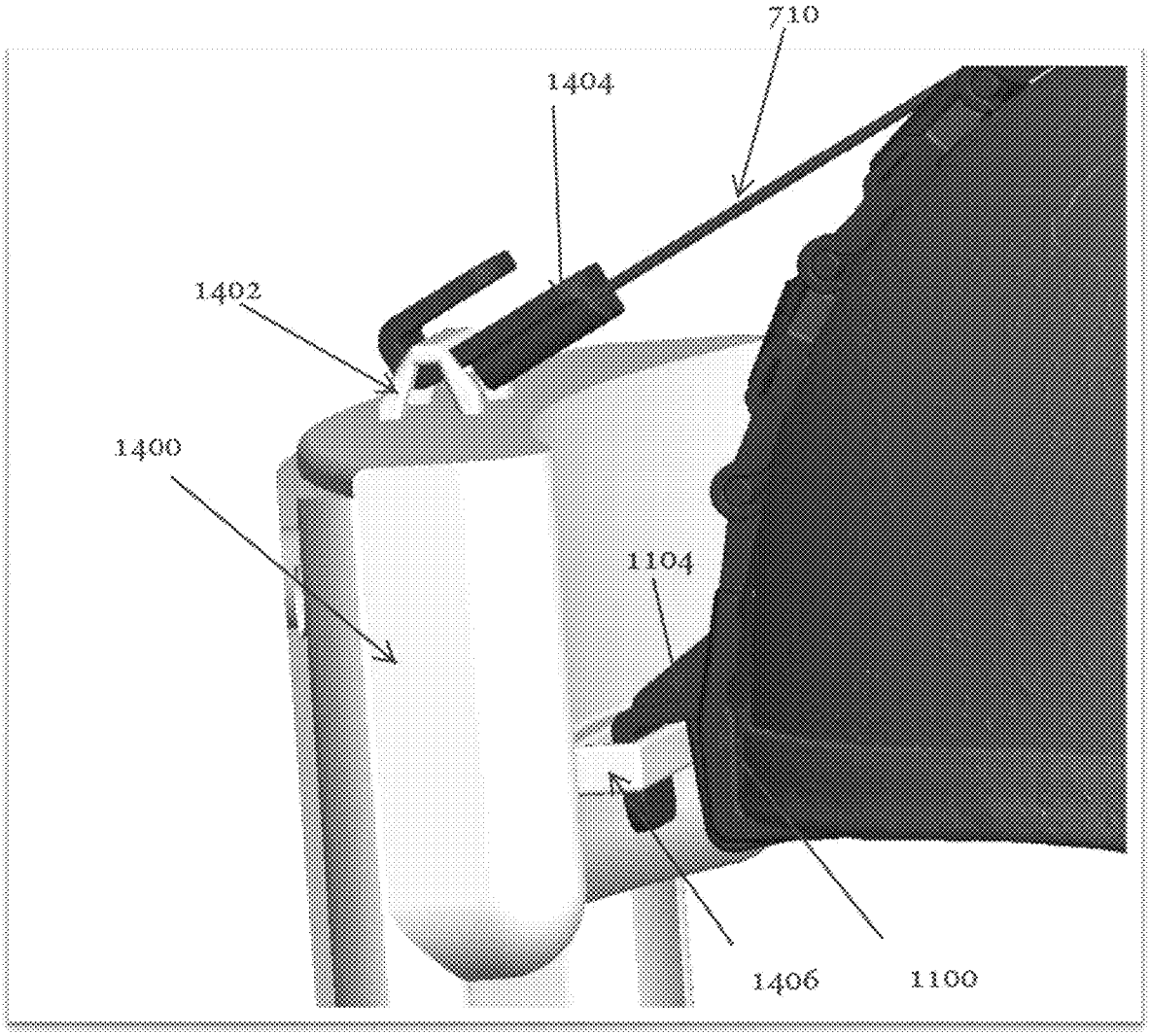
FIG. 16 is a schematic illustration of a side view of front connectors of a helmet mounting unit holding the IVAS Microsoft system, according to an embodiment of the disclosure.

FIG. 16 is a schematic illustration of a side view of front connectors 1104 and 1404 of a helmet mounting unit holding the WAS Microsoft system 1400, according to an embodiment of the disclosure. In some embodiments, mounting unit 100 may comprise a front link 1100 (FIGS. 11A-11D), which may comprise a section 1104 configured to connect to IVAS 1400 by being inserted into a space created by handle 1406. The space created between handle 1406 and the back side of WAS 1400 may be in the size and shape of section 1104.

In some embodiments, mounting unit 100 may further comprise a connector 1404, which may be connected to wires 710 on one end, and connected to IVAS 1400 on its other end, via handle 1402. In some embodiments, connector 1404 may comprise a hook that is to be inserted into handle 1402.

It should be appreciated that other AR systems may be attached to mounting unit 100 instead of the WAS 1400, and the number and type of connecters may be changed and designed to fit any such system, and to thereby attach it to the mounting unit, e.g., mounting unit 100.

Figure 17A:
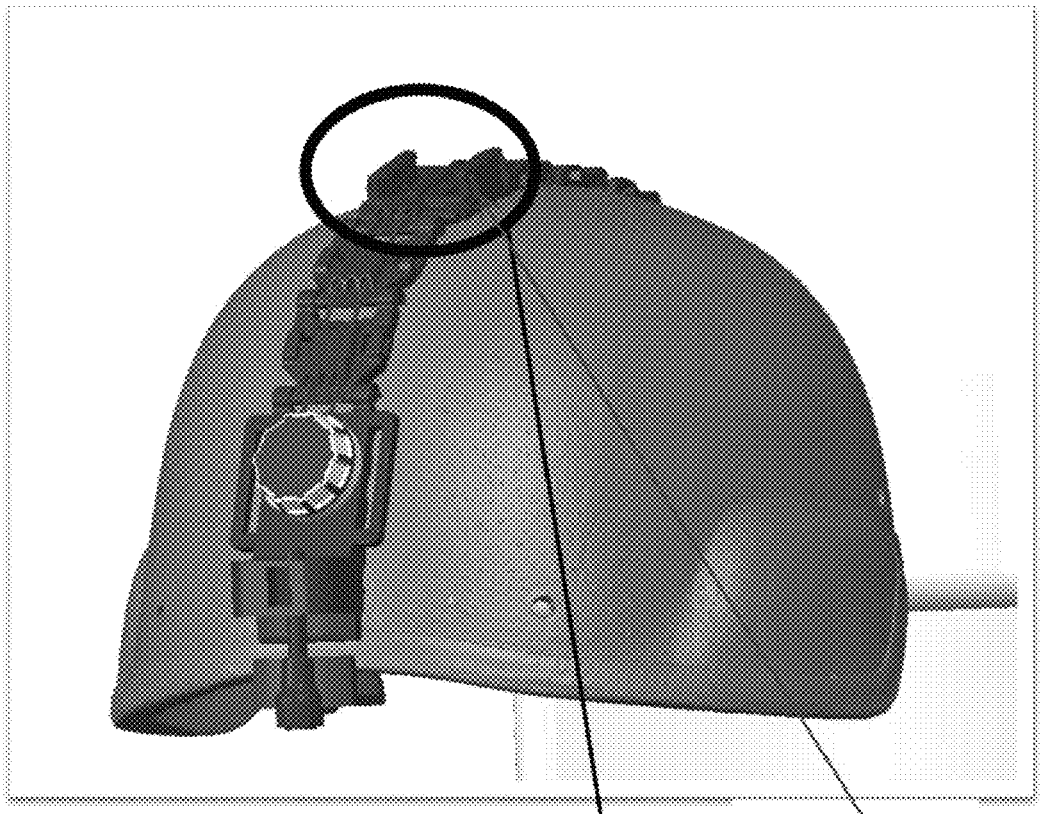
FIG. 17A is a schematic illustration of a perspective side view of a helmet mounting unit tightened onto a helmet comprising a go-pro adaptor on one link, according to an embodiment of the disclosure.

FIG. 17A is a schematic illustration of a perspective side view of a helmet mounting unit 100 tightened onto a helmet comprising a go-pro adaptor link 1700 replacing one link, according to an embodiment of the disclosure. In some embodiments, one or more of the links 110, may be replaced with a link that comprises an accessory adaptor, e.g., a go-pro adaptor 1700. In other embodiments, other adaptors shaped to enable carrying of other accessories may be implemented within a link, comprising the links rod on one side and the links hooks on the other side, to enable the link adaptor to connect to the other mounting unit's links.

Figure 17B:
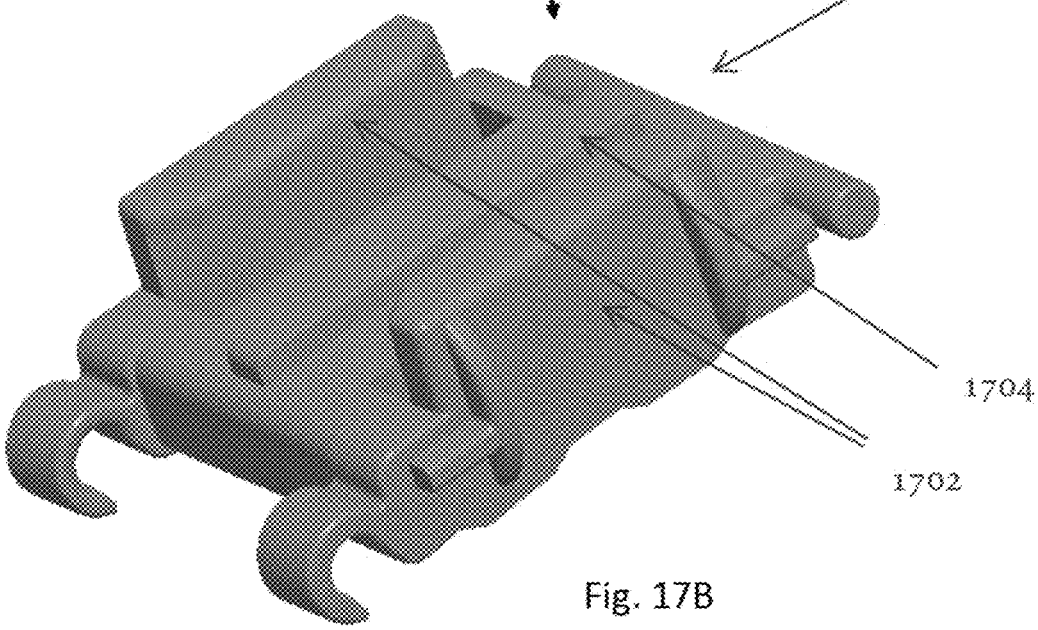
FIG. 17B is a schematic illustration of a close-up perspective side view of a go-pro link of the helmet mounting unit, according to an embodiment of the disclosure.

FIG. 17B is a schematic illustration of a close-up perspective side view of a go-pro adaptor link 1700 of the helmet mounting unit, according to an embodiment of the disclosure. In some embodiments, go-pro adaptor link 1700 may comprise a leading backbone 1704 along which a go-pro camera may be slid and attached to go-pro adaptor 1700. In some embodiments, go-pro adaptor 1700 may comprise two supporting walls 1702 located on opposite sides of the go-pro adaptor 1700 to support a go-pro camera on both of its sides.

Figure 17C:
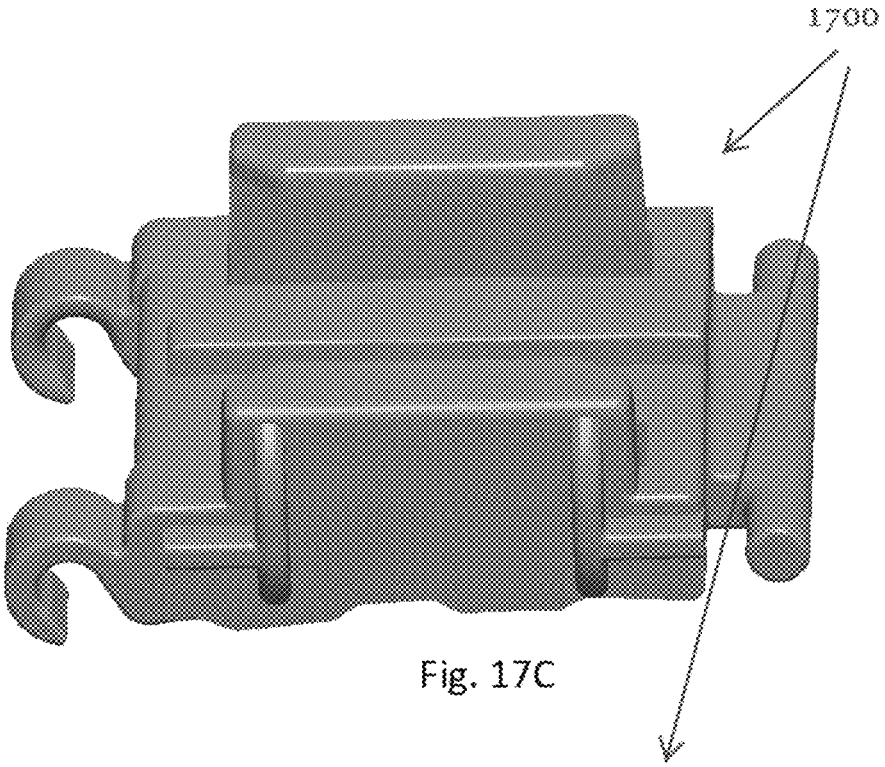
FIGS. 17C-17D are schematic illustrations of a perspective top view, and a top view of a go-pro link of the helmet mounting unit, respectively, according to an embodiment of the disclosure.
Figure 17D:
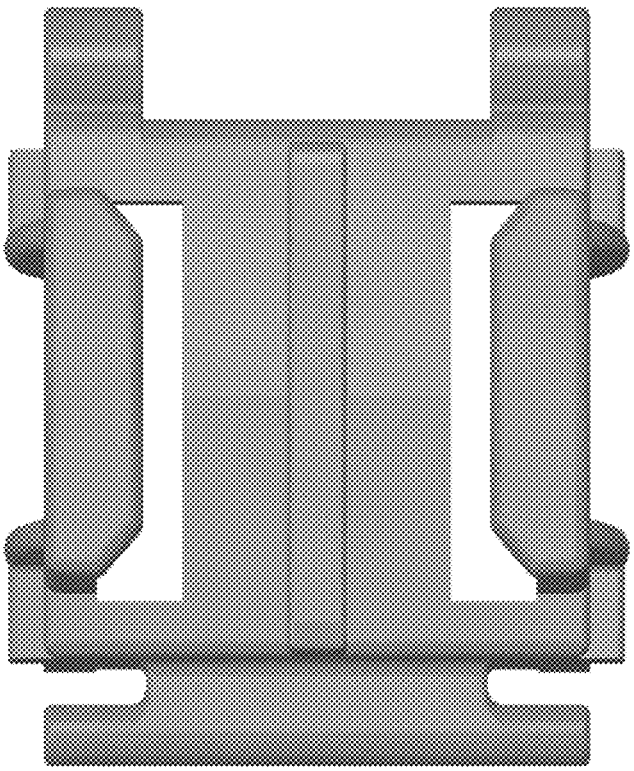

FIGS. 17C-17D are schematic illustrations of a perspective top side view, and a top view of a go-pro adaptor link 1700 of the helmet mounting unit 100, respectively, according to an embodiment of the disclosure.

Figure 18A:
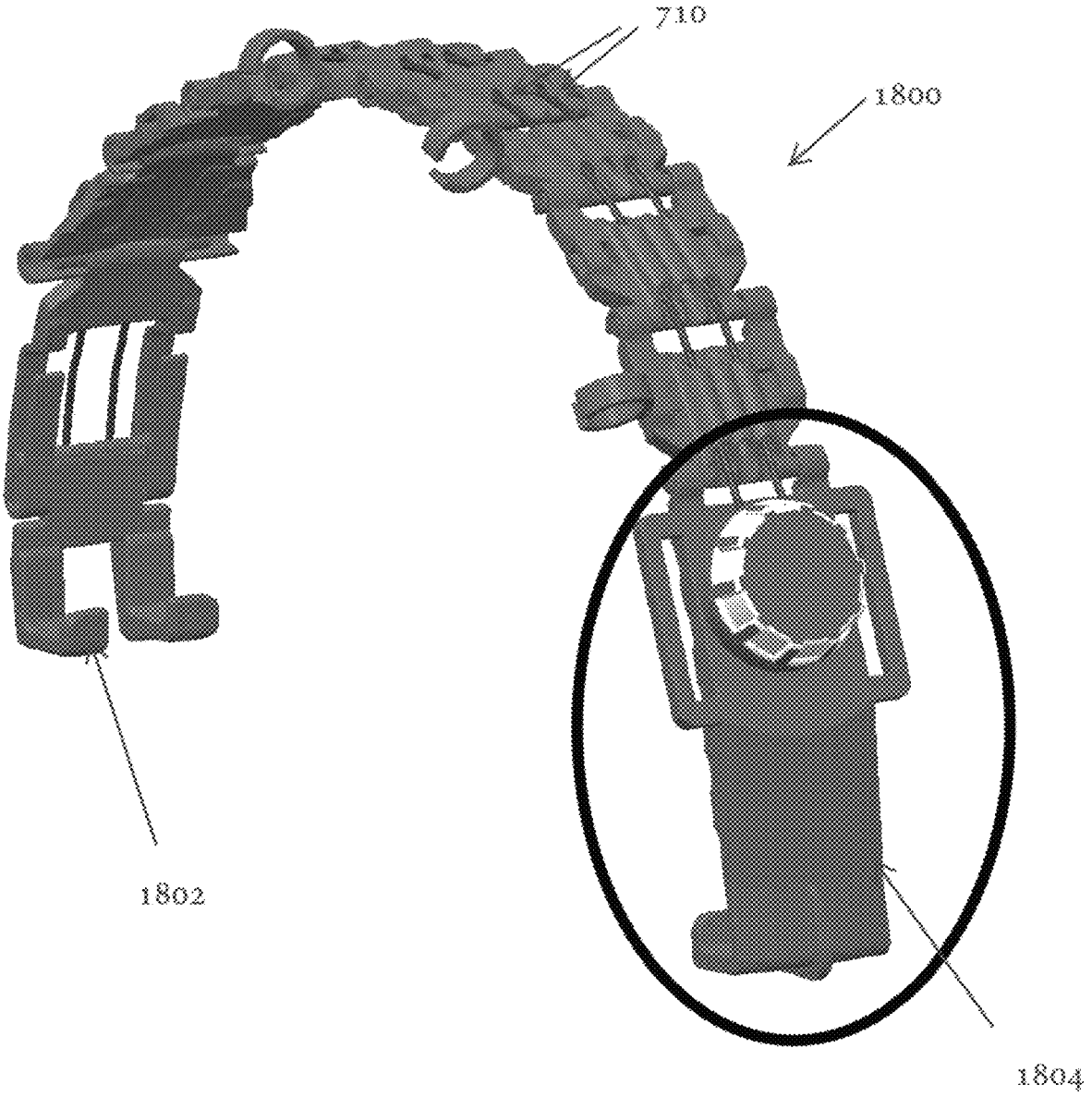
FIG. 18A is a schematic illustration of a perspective front view of a helmet mounting unit comprising wires and no screws, according to an embodiment of the disclosure.

FIG. 18A is a schematic illustration of a perspective back view of a helmet mounting unit 1800 comprising wires and no screws, according to an embodiment of the disclosure. 1 bat is, helmet mounting unit 1800 does not comprise any screws for tightening mounting unit 1800 onto a helmet, but rather comprises wires such as wires 710 and a wire dial link comprising a wire dial that is configured to tighten mounting unit 1800 onto a helmet by tightening wires 710 and thereby the links, which the wires pass therethrough, against the external circumference of the helmet. In such case, mounting unit 1800 may comprise a rather simple front link 1802, which comprises a hook-type edge to be held against the front edge of the helmet. And mounting unit 1800 may comprise a back link 1804 also comprising a hook-type edge to be held against the back edge of the helmet.

Figure 18B:
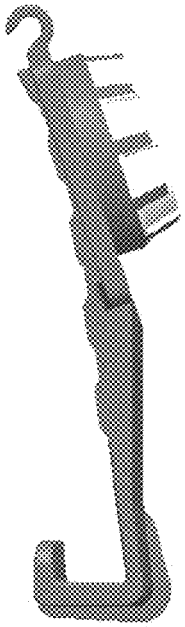
FIG. 18B is a schematic illustration of a side view of a back link of a helmet mounting unit comprising a wire dial and no screws, according to an embodiment of the disclosure.
Figure 18C:
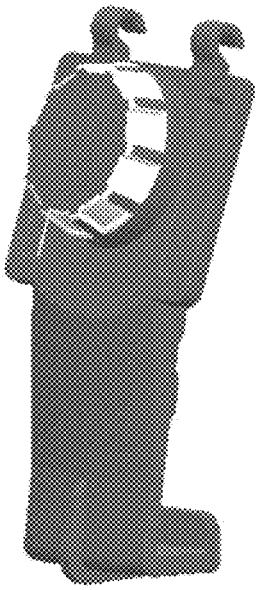
FIGS. 18C-18D are schematic illustrations of a perspective side view, and a front view of a helmet mounting unit comprising a wire dial and no screws, respectively, according to an embodiment of the disclosure.
Figure 18D:
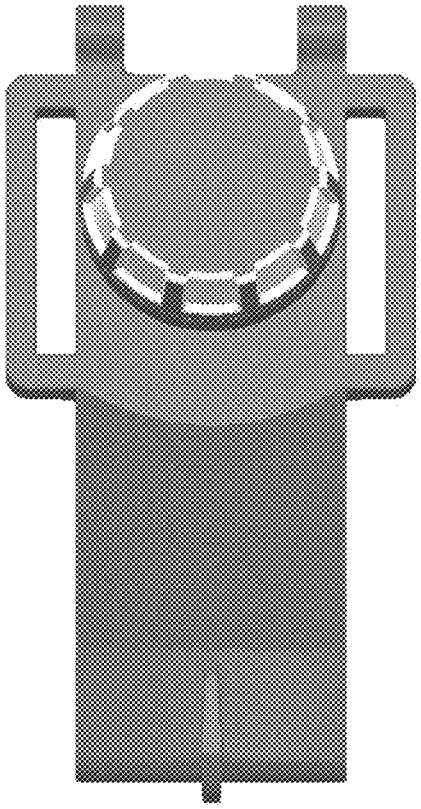

FIG. 18B is a schematic illustration of a side view of a back link of a helmet mounting unit 1800 comprising a wire dial and no screws, according to an embodiment of the disclosure, and FIGS. 18C-18D are schematic illustrations of a perspective side view, and a front view of a helmet mounting unit 1800 comprising a wire dial and no screws, respectively, according to an embodiment of the disclosure.

Figure 19A:
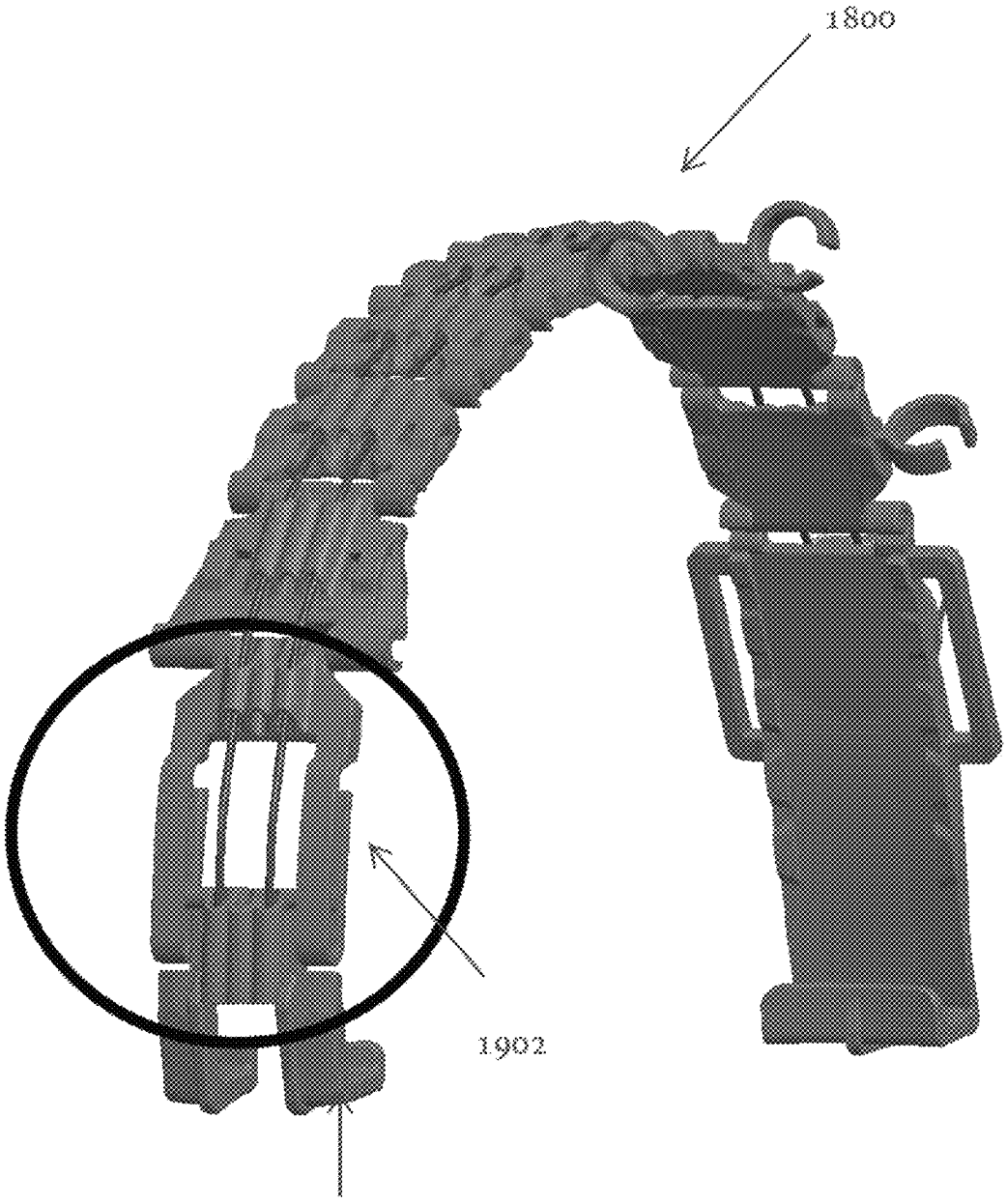
FIG. 19A is a schematic illustration of a perspective front view of a helmet mounting unit comprising wires and no screws, according to an embodiment of the disclosure.
Figure 19B:
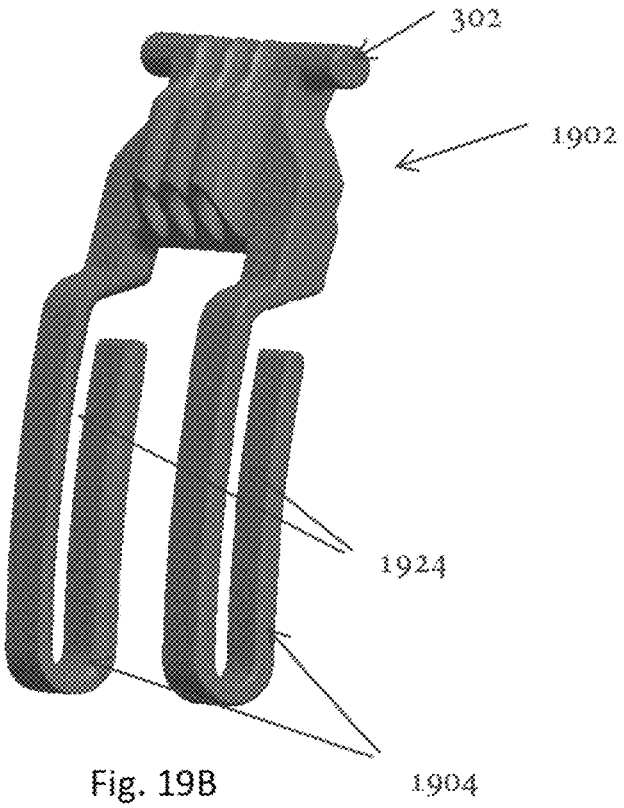
FIG. 19B is a schematic illustration of a perspective front view of a second front link of a helmet mounting unit comprising a wire dial and no screws, according to an embodiment of the disclosure.

FIG. 19A is a schematic illustration of a perspective front view of a helmet mounting unit 1800 comprising wires and no screws, according to an embodiment of the disclosure. FIG. 19B is a schematic illustration of a perspective front view of a second front link of a helmet mounting unit comprising a wire dial and no screws, according to an embodiment of the disclosure.

In some embodiments, when wires 710 are tightened by twisting and turning wire dial 1204 (FIG. 12), the wires 710 are pulled towards wire dial 1204, i.e., towards the back side of mounting unit 1800. However, the front link 1802 which is positioned onto the front edge of the helmet, prevents movement of the front link 1802 itself as well as of the other links 110 connected to it, thus first front link 1802 causes the links 110 to be pulled towards the front edge of the mounting unit 1800. In order to enable a pull and tightening of the links 110 and thereby of mounting unit 1800 onto the external circumference of the helmet, the second front link 1902 may comprise elongated hooks 1904, which create elongated space 1924 along which the first front link 1802 may be inserted and moved. This space 1924 along each elongated hook 1904 may further allow movement of the links 110 along with first front link 1802 towards the front side of mounting unit 1800 to thereby tighten mounting unit 1800 onto the helmet. That is, elongated space 1924 enables first front link 1802 to move along the elongated hooks 1904 or enables second front link 1902 to move along first front link 1802, thereby enabling movement of the links attached to the second front link 1902 to move towards the front edge of the helmet and to tighten the entire links of mounting unit 1800 against the external circumference of the helmet.

Figure 19C:
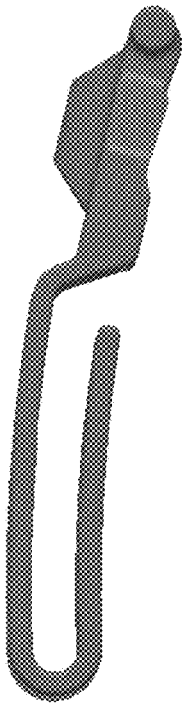
FIGS. 19C-19D are schematic illustrations of a side view, and a front view of a second front link of a helmet mounting unit comprising a wire dial and no screws, respectively, according to an embodiment of the disclosure.
Figure 19D:
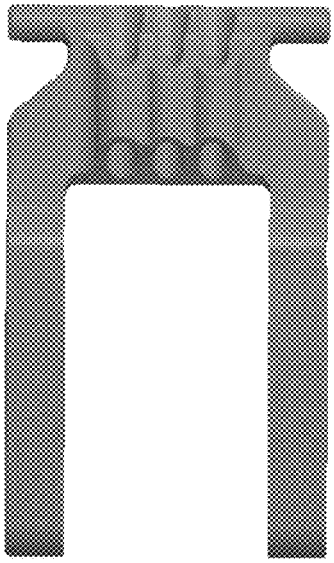

FIGS. 19C-19D are schematic illustrations of a side view, and a front view of a second front link 1902 of a helmet mounting unit 1800 comprising a wire dial and no screws, respectively, according to an embodiment of the disclosure.

Figure 20A:
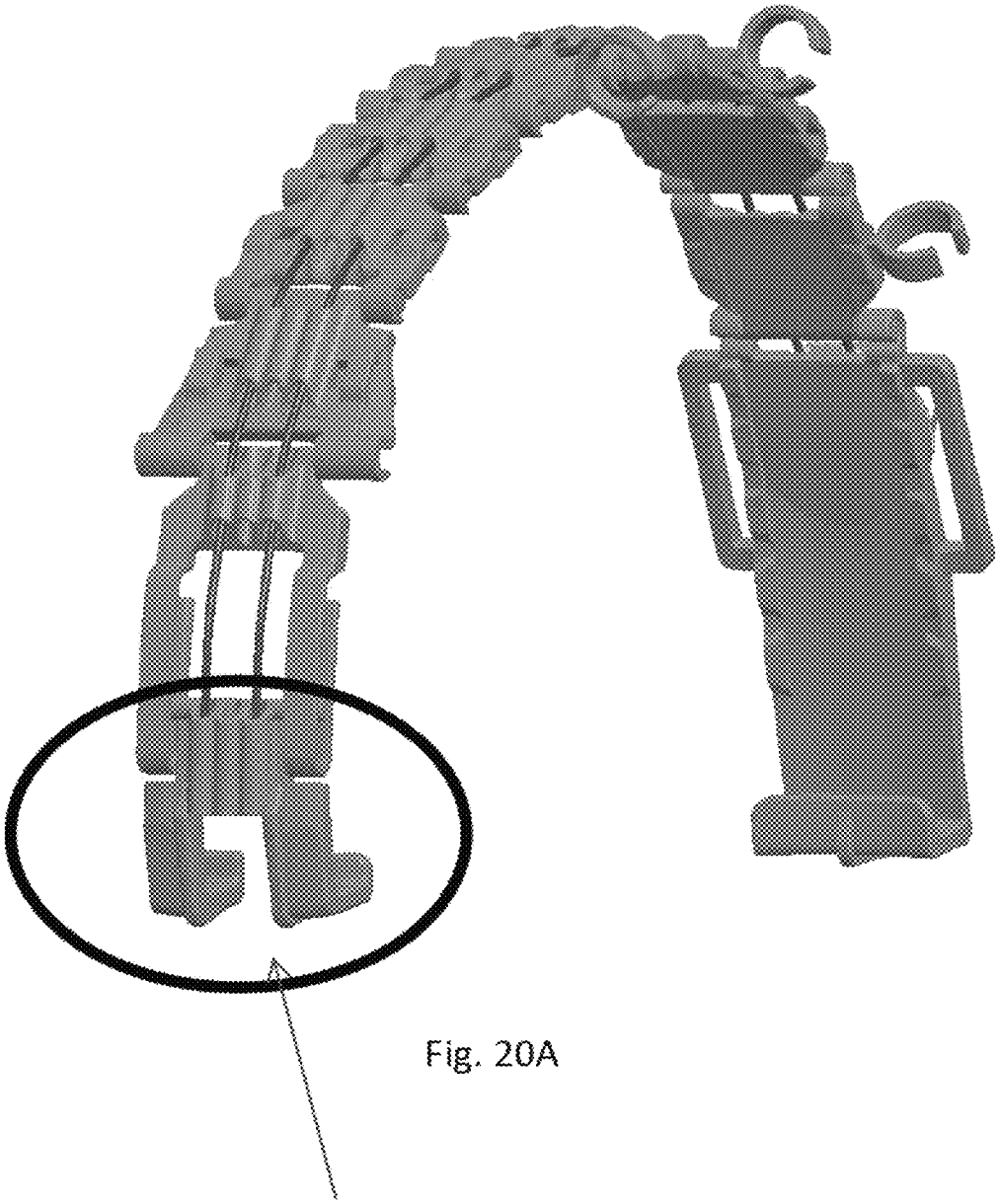
FIG. 20A is a schematic illustration of a perspective front view of a helmet mounting unit comprising wires and no screws, according to an embodiment of the disclosure.

FIG. 20A is a schematic illustration of a perspective front view of a helmet mounting unit comprising wires and no screws, according to an embodiment of the disclosure. FIG. 20B is a schematic illustration of a perspective side view of a first front link 1802 of a helmet mounting unit 1800 comprising a wire dial and no screws, according to an embodiment of the disclosure, and FIGS. 20C-20D are schematic illustrations of a side view, and a front view of a first front link 1802 of a helmet mounting unit 1800 comprising a wire dial and no screws, respectively, according to an embodiment of the disclosure.

In some embodiments, first front link 1802 may comprise a rod 2002 such as rod 302 on one end so as to enable easy connection to an adjacent link's hooks, while the other end may comprise hooks 20004 to be held against the front edge of a helmet.

Figure 21:
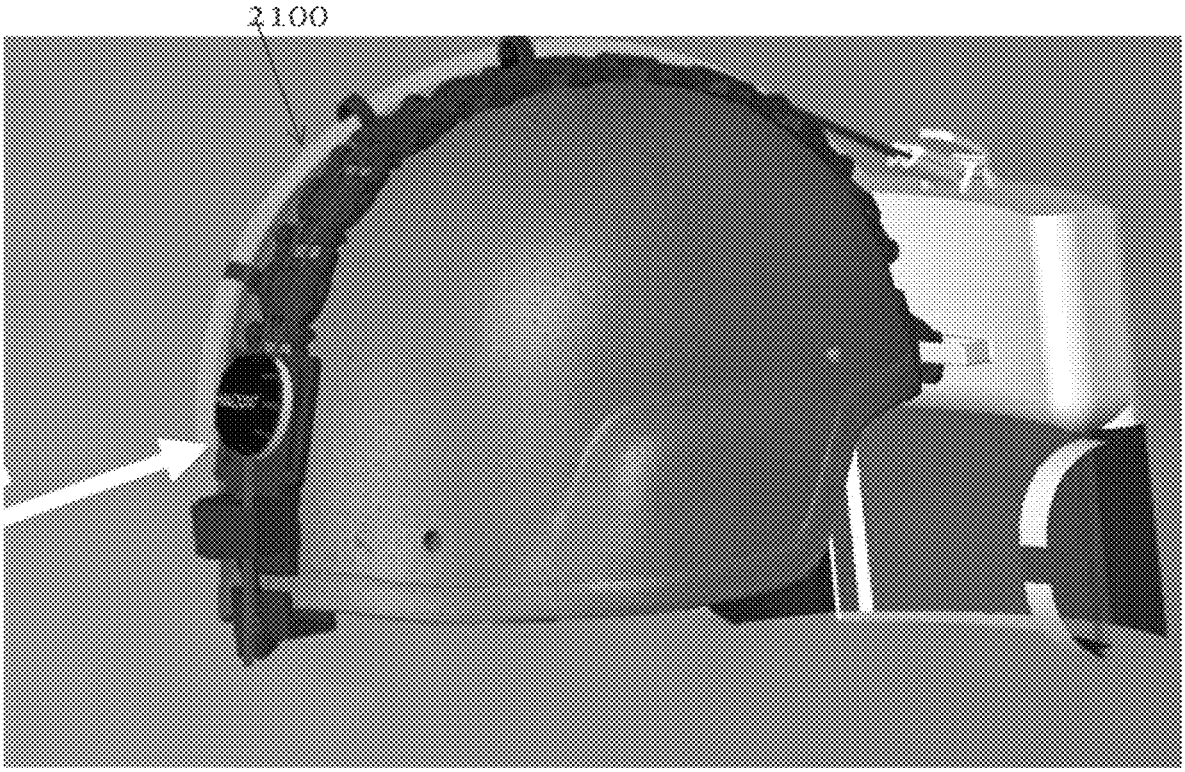
FIG. 21 is a schematic illustration of a helmet mounting unit for holding an AR system with a wire running through wire carriers, according to an embodiment of the disclosure.

FIG. 21 is a schematic illustration of a helmet mounting unit for holding an AR system with a wire or cable 2100 running through wire carriers 410 in addition to wires 710, according to an embodiment of the disclosure. The additional wire 2100 may be used as a replacement for the back link or clip that comprises screws. That is, the additional wire 2100 makes the screws redundant in view of the existing wires and cable 2100.

Figures 22A, 22B, 22C, 22D, 23A, 23B:
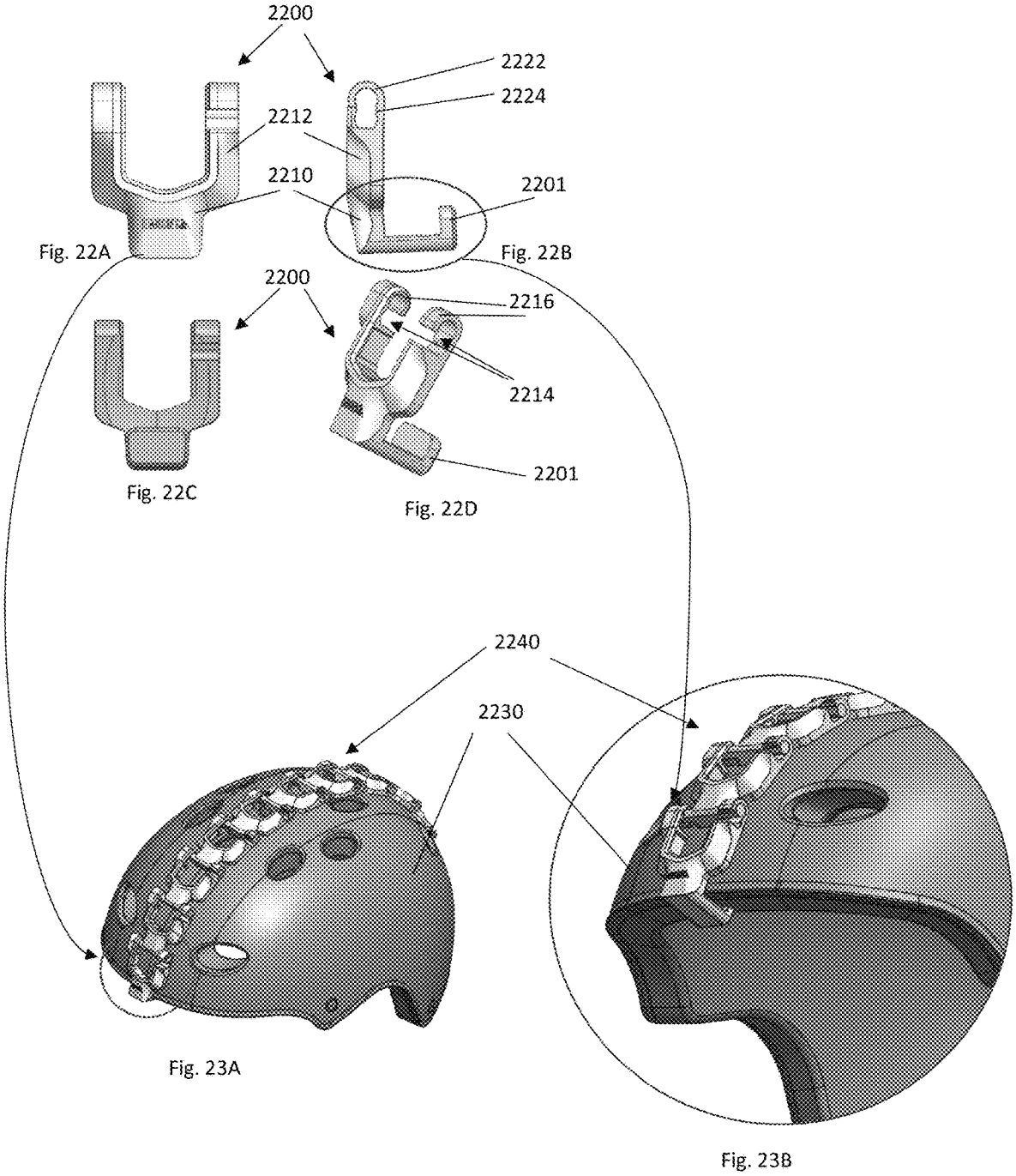
FIGS. 22A-22D are schematic illustrations of a first link of a plurality of links from which a helmet mounting unit is comprised of, according to embodiments of the present disclosure.
FIGS. 23A-23B are schematic illustrations of a first link connected to other links and assembled onto a helmet, according to embodiments of the present disclosure.

FIGS. 22A-22D are schematic illustrations of a first link of a plurality of links from which a helmet mounting unit is comprised of, according to embodiments of the present disclosure. FIG. 22A is a front (or external) view of first link 2200, FIG. 22B is a side view thereof, FIG. 22C is a rear (or internal) view thereof and FIG. 22D is a front-side perspective view thereof. In some embodiments, first link 2200 may be configured to attach onto a first edge of a helmet, e.g., helmet 2230 (FIGS. 23A-23B). For example, first link 2200 may be attached onto a front edge of a helmet, i.e., above the face of a user, as one link of a plurality of links that helmet mounting unit 2240 is comprised of.

In some embodiments, first link 2200 may comprise a link body 2210. First link 2200 may comprise a clip 2201, which may be integral to link body 2210 on a first end of first link 2200. Clip 2201 may be configured to attach first link 2200 onto a first edge of the helmet such that the first edge of the helmet is located between link body 2210 and clip 2201. First link 2200 may further comprise at least one hook 2216 located at a second end of first link 2200, opposite the first end, i.e., opposite clip 2201. Typically, first link 2200 may comprise two hooks 2216. Each hook 2216 may comprise an elongated arm 2212, which may be integrally connected to body link 2210. Elongated arm 2212 may comprise a curved end 2222, which is part of the connecting mechanism for connecting the first link 2200 to a middle link, as will be detailed hereinbelow.

In some embodiments, each of the two hooks 2216 may comprise a step 2224 located along elongated arm 2212. Step 2224 may be a protrusion configured to prevent easy disconnection between first link 2200 and any link connected to it. Each of two hooks 2216 creates an opening 2214 beneath curved end 2222. In some embodiments, opening 2214 of each of the two hooks 2216 may be directed in the same direction, whereas in other embodiments, openings 2214 of each of two hooks 2216 may be directed in opposite directions, as illustrated in FIGS. 22A-22D, where one opening 2214 is directed towards the external side of first link 2200 while the other opening 2214 is directed towards the internal side of first link 2200.

Figure 24A:
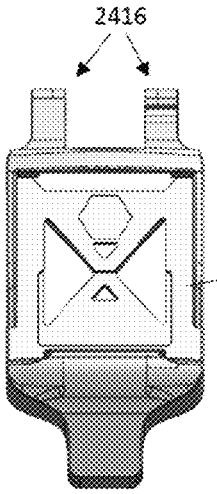
FIGS. 24A-24F are schematic illustrations of a first link of a plurality of links from which a helmet mounting unit is comprised of, according to other embodiments of the present disclosure.
Figure 24B:
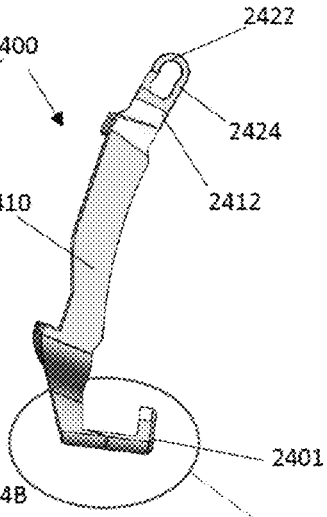
Figure 24C:
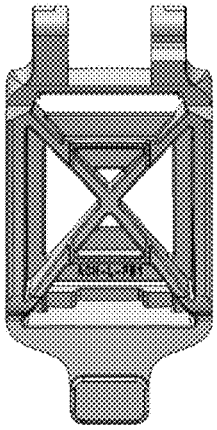
Figure 24D:
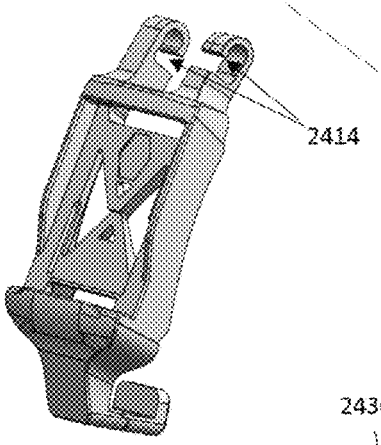

FIGS. 24A-24F are schematic illustrations of a first link of a plurality of links from which a helmet mounting unit is comprised of, according to other embodiments of the present disclosure. FIG. 24A is a front (or external) view of first link 2400, FIG. 24B is a side view thereof, FIG. 24C is a rear (or internal) view thereof and FIG. 24D is a front-side perspective view thereof.

In some embodiments, a first link 2400 is configured for connection of night vision goggles (NVG) by implementing link body 2410 which is dedicated specifically for connecting a NVG system. That is, link body 2410 has the shape of an off-the-shelf NVG adaptor.

Figure 24E:
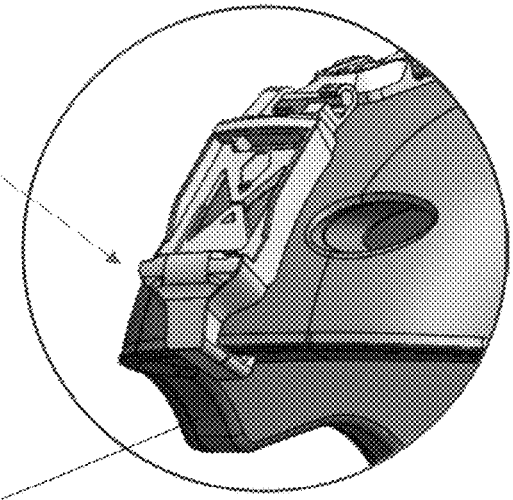
Figure 24F:
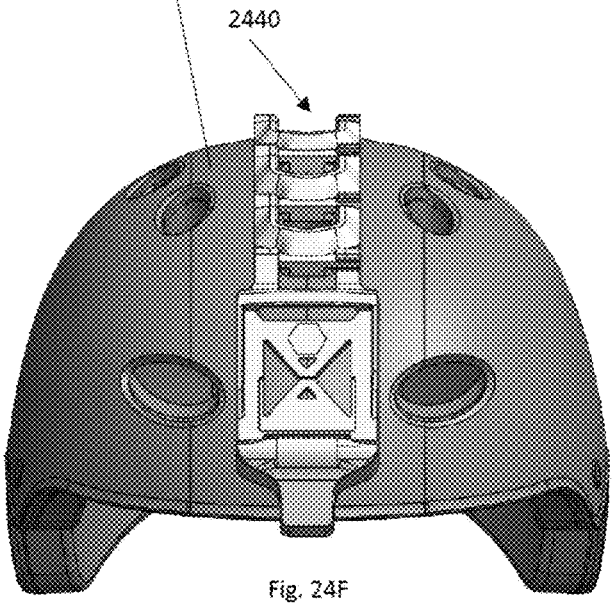

In some embodiments, first link 2400 may be configured to attach onto a first edge of a helmet, e.g., helmet 2430 (FIGS. 24E-24F). For example, first link 2400 may be attached onto a front edge of a helmet, i.e., above the face of a user, as one link of a plurality of links that helmet mounting unit 2440 is comprised of.

In some embodiments, first link 2400 may comprise a link body 2410. Link body 2410 may be configured for direct connection of an NVG system onto it, without the need for a specialized additional adaptor between link body 2410 and the NVG system, as with link body 2510 detailed hereinbelow with respect to FIGS. 25A-25F.

First link 2400 may comprise a clip 2401, which may be integral to link body 2410 on a first end of first link 2400. Clip 2401 may be configured to attach first link 2400 onto a first edge of the helmet such that the first edge of the helmet is located between link body 2410 and clip 2401. First link 2400 may further comprise at least one hook 2416 located at a second end of first link 2400, opposite the first end, i.e., opposite clip 2401. Typically, first link 2400 may comprise two hooks 2416. Each hook 2416 may comprise an elongated arm 2412, which may be integrally connected to body link 2410. Elongated arm 2412 may comprise a curved end 2422, which is part of the connecting mechanism for connecting the first link 2400 to a middle link, as will be detailed hereinbelow.

In some embodiments, each of the two hooks 2416 may comprise a step 2424 located along elongated arm 2412, e.g., at substantially the middle of elongated arm 2412. Step 2424 may be a protrusion configured to prevent easy disconnection between first link 2400 and any link connected to it. Each of two hooks 2416 creates an opening 2214 beneath curved end 2422. In some embodiments, opening 2414 of each of the two hooks 2416 may be directed in the same direction, whereas in other embodiments, openings 2414 of each of two hooks 2416 may be directed in opposite directions, as illustrated in FIGS. 24A-24D, where one opening 2414 is directed towards the external side of first link 2400 while the other opening 2414 is directed towards the internal side of first link 2400.

FIGS. 25A-25F are schematic illustrations of a first link of a plurality of links from which a helmet mounting unit is comprised of, according to another embodiment of the present disclosure. FIG. 25A is a front (or external) view of first link 2500, FIG. 25B is a side view thereof, FIG. 25C is a rear (or internal) view thereof, FIG. 25D is a front-side perspective view thereof and FIG. 25E is an enlarged front-side perspective view thereof.

In some embodiments, first link 2500 may be configured to attach onto a first edge of a helmet, e.g., helmet 2630 (FIGS. 26B-26C). For example, first link 2500 may be attached onto a front edge of a helmet, i.e., above the face of a user, as one link of a plurality of links that helmet mounting unit 2640 is comprised of.

In some embodiments, first link 2500 may comprise a link body 2510. First link 2500 may comprise a clip 2501, which may be integral to link body 2510 on a first end of first link 2500. Clip 2501 may be configured to attach first link 2500 onto a first edge of the helmet such that the first edge of the helmet is located between link body 2510 and clip 2501. First link 2500 may further comprise at least one hook 2516 located at a second end of first link 2500, opposite the first end, i.e., opposite clip 2501. Typically, first link 2500 may comprise two hooks 2516. Each hook 2516 may comprise an elongated arm 2512, which may be integrally connected to body link 2510. Elongated arm 2512 may comprise a curved end 2522, which is part of the connecting mechanism for connecting the first link 2500 to a middle link, as will be detailed hereinbelow.

In some embodiments, each of the two hooks 2516 may comprise a step 2524 located along elongated arm 2512. Step 2524 may be a protrusion configured to prevent easy disconnection between first link 2500 and any link connected to it. Each of two hooks 2516 creates an opening 2514 beneath curved end 2522. In some embodiments, opening 2514 of each of the two hooks 2516 may be directed in the same direction, whereas in other embodiments, openings 2514 of each of two hooks 2516 may be directed in opposite directions, as illustrated in FIG. 25D, where one opening 2514 is directed towards the external side of first link 2500 while the other opening 2514 is directed towards the internal side of first link 2500.

In some embodiments, link body 2510 may create a space 2550 between the two opposing elongated arms 2512 into which various accessory adaptors may be inserted for accessory connection to the helmet via link body 2500. An accessory adaptor, e.g., an NVG adaptor 2560, which comprises a rotatable arm, may be attached to link body 2500 by being inserted into space 2550 while being supported by section 2552 of link body 2510 that is located between the two elongated arms 2512, as illustrated in FIGS. 26A-26C. Section 2552 may be an indent along link body 2510 between elongated arms 2512, such that an adaptor with a corresponding elongated tab may be configured to lean against section 2552 when the adaptor is placed into space 2550, thereby securing a connection between the adaptor and link 2500.

In some embodiments, a dedicated NVG system may be attached to NVG adaptor 2560 via its rotatable arm.

Figure 27A:
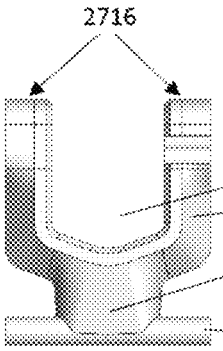
FIGS. 27A-27E are schematic illustrations of a middle link of a plurality of links from which a helmet mounting unit is comprised of, according to embodiments of the present disclosure.
Figure 27B:
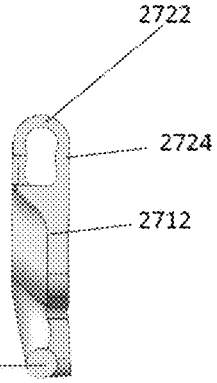
Figure 27C:
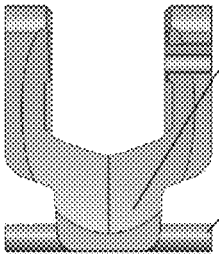
Figure 27D:
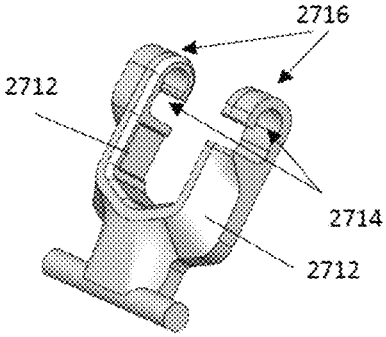
Figure 27E:
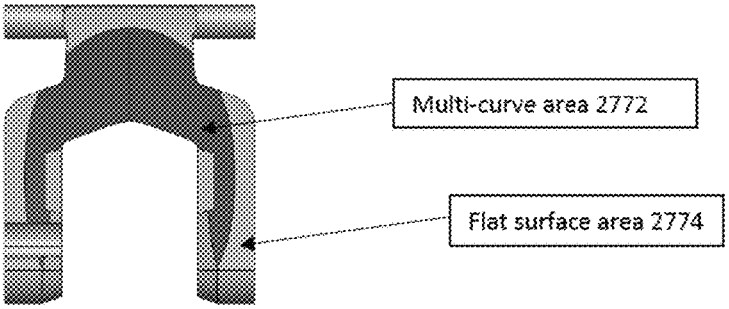
Figure 28A:
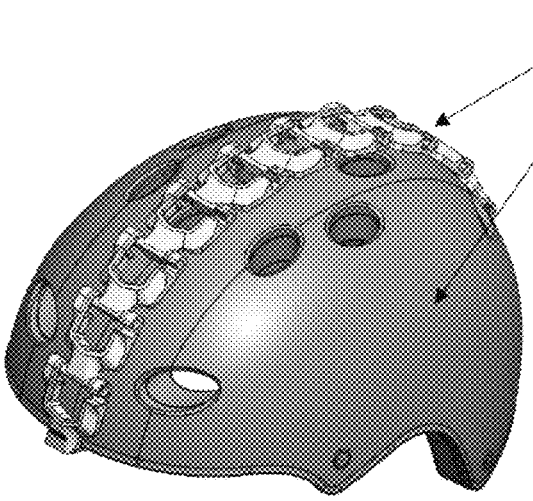
FIGS. 28A-28B are schematic illustrations of the middle link of FIGS. 27A-27E as it is assembled as part of the link-based helmet mounting unit, according to embodiments of the present disclosure.
Figure 28B:
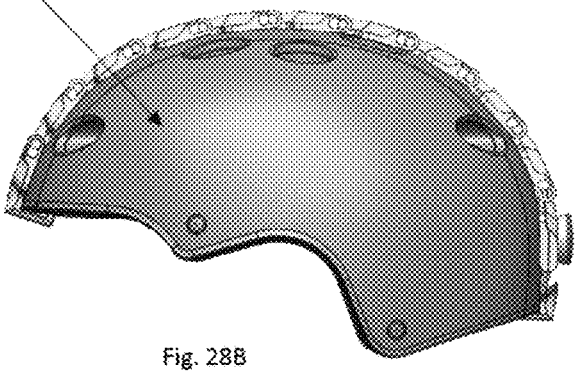

FIGS. 27A-27E are schematic illustrations of a middle link of a plurality of links from which a helmet mounting unit is comprised of, according to embodiments of the present disclosure. FIG. 27A is a front (or external) view of middle link 2700, FIG. 27B is a side view thereof, FIG. 27C is a rear (or internal) view thereof, FIG. 27D is a front-side perspective view thereof, and FIG. 27E is a rear (or internal) view illustrating different surfaces of middle link 2700. In some embodiments, middle link 2700 may be configured to attach onto the external circumference a helmet, e.g., helmet 2830 (FIGS. 28A-28B). In some embodiments, middle link 2700 may be one link of a plurality of links that helmet mounting unit 2840 is comprised of. Middle link 2700 may be configured to connect to a first link, e.g., first link 2200, 2400 or 2500, to connect to other middle links, or to connect to an end link, which is configured to be connected to an edge of the helmet that is opposite the first edge of the helmet.

That is, middle link 2700 is the main link that a link-based helmet mounting unit, e.g., helmet mounting unit 2840, is comprised of.

Middle link 2700 may be retractable and rechargeable in case it is broken, thereby avoiding the need to replace an entire helmet mounting unit if a section of it is damaged. In addition, since middle links 2700 may be configured to have accessory adaptors connected thereon, a change in location of any accessory along the circumference of the helmet may be implemented by disconnecting a certain middle link 2700 with a certain accessory adaptor and connecting it at the new location, after disconnecting a previous middle link 2700 at the desired location.

In case the accessory adaptor is extractable from the middle link 2700, one accessory adaptor may be changed with a different accessory adaptor, per user preferences, anywhere along the link-based helmet mounting unit.

The number of middle links 2700 that are connected to one another between a first link and an end link may be adjustable per size of the helmet. For a larger sized helmet, a larger number of middle links 2700 connected to one another, may be used. Whereas, for a smaller sized helmet, a smaller number of middle links 2700 connected to one another, may be used.

In some embodiments, the first, middle and end links may be made of rigid materials, and the link-based helmet mounting unit may still have flexibility characteristics due to presence of a plurality of links. Since each link is a relatively small part with respect to the entire link-based helmet mounting unit, flexibility of the helmet mounting unit with respect to the helmet onto which it is attached, e.g., the ability to attach the helmet mounting unit onto substantially any shaped surface, for example, a flat or curved surface, is achieved by the plurality of links.

Each of the links is designed to have a multi-curve area 2772 at its internal side, i.e., at the side that is in contact with the external circumference of the helmet, such to be able to create sufficient contact between each link and the helmet's surface, as well as enable proper tightening of the link-based helmet mounting unit along the helmet's external circumference by having a flat surface area 2774 at the edges of middle link 2700.

In some embodiments, middle link 2700 may comprise a link body 2710. Middle link 2700 may comprise a rod 2701, which may be integral to link body 2710 on a first end of middle link 2700. Middle link 2700 may further comprise at least one hook 2716 located at a second end of middle link 2700, opposite the first end, i.e., opposite rod 2701. Typically, middle link 2700 may comprise two hooks 2716. Each hook 2716 may comprise an elongated arm 2712, which may be integrally connected to body link 2710. Elongated arm 2712 may comprise a curved end 2722, which is part of the connecting mechanism for connecting the middle link 2700 to another middle link or to an end link, as will be detailed hereinbelow.

In some embodiments, each of the two hooks 2716 may comprise a step 2724 located along elongated arm 2712. Step 2724 may be a protrusion configured to prevent easy disconnection between middle link 2700 and any link connected to it. Each of two hooks 2716 creates an opening 2714 beneath curved end 2722. In some embodiments, opening 2714 of each of the two hooks 2716 may be directed in the same direction, whereas in other embodiments, openings 2714 of each of two hooks 2716 may be directed in opposite directions, as illustrated in FIG. 27D, where one opening 2714 is directed towards the external side of middle link 2700 while the other opening 2714 is directed towards the internal side of middle link 2700.

In some embodiments, the at least one hook 2716 of one middle link 2700 is configured to connect onto a rod 2701 of another middle link 2700 (or an end link) with the curved end 2722 of hook 2716 hugging the rod 2701, thereby enabling connection between the plurality of links to form the link-based helmet mounting unit 2840 (FIGS. 28A-28B). as further illustrated in FIGS. 28A-28B, the middle link 2700 that is connected to the first link, whether first link 2200, 2400 or 2500, may be connected to the first link via the at least one hook of the first link hugging the rod 2701 of the middle link.

In some embodiments, middle link 2700 may comprise a space 2750 created between the two elongated arms 2712. Into space 2750, an accessory adaptor or a cover may be inserted, as will be explained in detail hereinbelow.

In some embodiments, no space is created between the elongated arms 2912 of middle link 2900, as illustrated in FIGS. 29A-29D. In such embodiments, middle link body 2910 comprising area 2955 may not be able to have attached thereon an accessory adaptor, and may only serve as a connecting link between other two links, as illustrated in FIGS. 30A-30B, via rod 2901 and at least one hook 2916, which are similar to those of middle link 2700.

FIGS. 30A-30B schematically illustrate connection of middle link 2900 to other links, on both ends of middle link 2900, to thereby create a link-based helmet mounting unit 3040.

FIGS. 31A-31E are schematic illustrations of a middle link comprising an integral GoPro adaptor, according to embodiments of the present disclosure. FIG. 31A is a front (or external) view of GoPro middle link 3100, FIG. 31B is a side view thereof, FIG. 31C is a rear (or internal) view thereof, FIG. 31D is a front-side perspective view thereof, and FIG. 31E is a rear (or internal) perspective view illustrating the at least one hook of middle link 3100.

In some embodiments, GoPro middle link 3100 may comprise a rod 3101 at one end of middle link body 3110, and at least one hook 3116 at the opposite end of middle link body 3110. Typically, GoPro middle link 3100 may comprise two hooks 3116. Each of hooks 3116 may create an opening 3114 beneath curved end 3122. In some embodiments, as illustrated with respect to first links and previous middle links, openings 3114 may be directed towards opposite directions, whereas in some embodiments, and as illustrated in FIGS. 31A-31E, openings 3114 may be directed towards the same direction, e.g., towards the rear side or internal side of GoPro middle link 3100.

The at least one hook 3116 may be configured to connect to and hug a corresponding rod of an adjacent link, whereas at least one hook of another adjacent link may be connected to and hug rod 3101 of GoPro middle link 3100.

GoPro middle link body 3110 may comprise an integral shape designated for GoPro device attachment. For example, GoPro middle link 3100 may comprise a guide 3162 positioned between two walls 3164, which are located on opposite sides, typically the opposite right and left edges, of GoPro middle link body 3110. A GoPro device may comprise a corresponding indent which may be slid along guide 3162, and may be of a sufficient size such to be held between opposing walls 3164, such to enable easy connection between a GoPro device and GoPro middle link 3100.

FIGS. 32A-32B schematically illustrate connection of GoPro middle link 3100 to other links, on both ends of GoPro middle link 3100, i.e., the top and bottom ends, to thereby create a link-based helmet mounting unit 3240.

FIGS. 33A-33E are schematic illustrations of a middle link comprising an integral Picatinny adaptor, according to embodiments of the present disclosure. FIG. 33A is a front (or external) view of Picatinny middle link 3300, FIG. 33B is a side view thereof, FIG. 33C is a rear (or internal) view thereof, FIG. 33D is a front-side perspective view thereof, and FIG. 33E is a rear (or internal) perspective view illustrating the hooks of Picatinny middle link 3300 with their opening positioned towards the same direction.

In some embodiments, Picatinny middle link 3300 may be similar to GoPro middle link 3100 with respect to all of its features, except for the main body section of Picatinny middle link 3300, which comprises an integral adaptor configured to enable attachment of accessories preconfigured to attach onto a Picatinny rail. The body of Picatinny middle link 3300 may comprise at least one track 3362 along which an accessory with a corresponding space may be slid onto. In some embodiments, at least one track 3362 may be positioned between two top and bottom tracks 3364, which may also enable attachment thereon of a suitable accessory, for example, an illumination source.

FIGS. 34A-34B schematically illustrate connection of Picatinny middle link 3300 to other links, on both ends of Picatinny middle link 3300, i.e., the top and bottom ends, to thereby create a link-based helmet mounting unit 3440.

FIGS. 35A-35E are schematic illustrations of a middle link comprising an integral Dove-tail type adaptor, according to embodiments of the present disclosure. FIG. 35A is a front (or external) view of Dove-tail middle link 3500, FIG. 35B is a side view thereof, FIG. 35C is a rear (or internal) view thereof, FIG. 35D is a front-side perspective view thereof, and FIG. 35E is a rear (or internal) perspective view illustrating the two hooks of Dove-tail middle link 3500 with their openings positioned towards the same direction.

In some embodiments, Dove-tail middle link 3500 may be similar to GoPro middle link 3100 with respect to all of its features, except for the main body section of Dove-tail middle link 3500, which comprises an integral adaptor configured to enable attachment of accessories preconfigured to attach onto a Dove-tail type adaptor. The body of Dove-tail middle link 3500 may comprise at least one indent 3562 into which an accessory with a corresponding protrusion may be inserted into. In some embodiments, at least one indent 3362 may be positioned between two supporting walls 3564, which may be positioned on the right and left sides of Dove-tail middle link 3500.

FIGS. 36A-36B schematically illustrate connection of Dove-tail middle link 3500 to other links, on both ends of Dove-tail middle link 3500, i.e., the top and bottom ends, to thereby create a link-based helmet mounting unit 3640.

It should be clear that the middle link may have an integrated adaptor of practically any kind, in order to enable connection of any type of accessory thereon. The GoPro, Picatinny and Dove-tail adaptors are mere examples of other adaptors that may be implemented as part of the middle link.

Figure 37A:
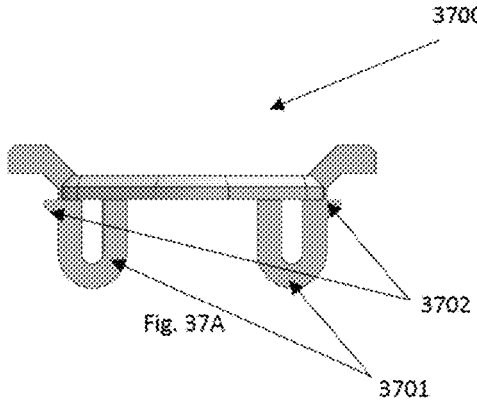
FIGS. 37A-37E are schematic illustrations of an extractable cap, according to embodiments of the present disclosure.
Figure 37B:
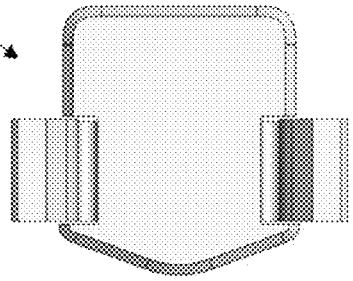
Figure 37C:
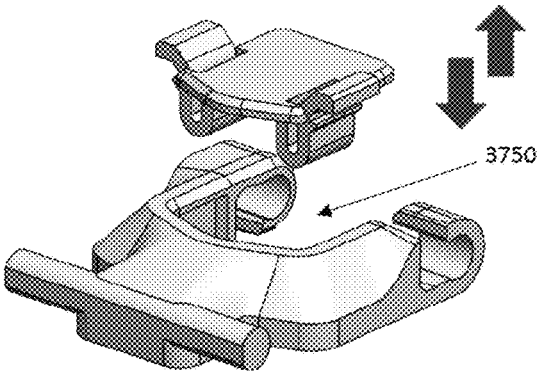
Figure 37D:
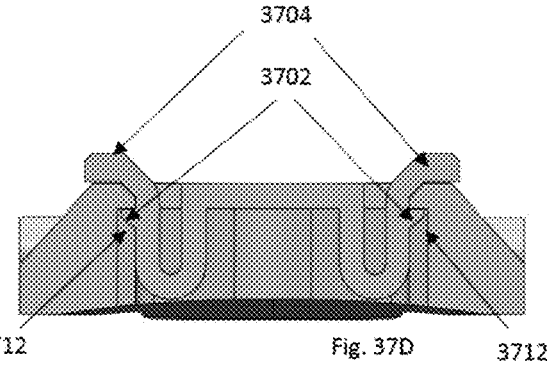
Figure 37E:
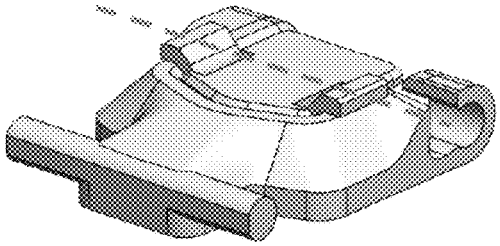

FIGS. 37A-37E are schematic illustrations of an extractable cap configured to cover the space or opening created between the two elongated arms of either of the first links or middle links that comprise such an opening. FIG. 37A is a front view of extractable cap 3700, FIG. 37B is a top view thereof, FIG. 37C illustrates the extractable cap 3700 with respect to a link comprising an opening into which extractable cap 3700 may be inserted, FIG. 37D is a cross section of the extractable cap 3700 when placed inside its corresponding opening within the link, and FIG. 37E is a top perspective view thereof.

In some embodiments, extractable cap 3700 may comprise a protruding flexible tooth 3702 located on each side, e.g., right and left, of the extractable cap 3700. Each protruding tooth 3702 may be part of a flexible U-shaped spring 3701. Each of the protruding flexible teeth 3702 may be configured to be pushed against a corresponding indent 3712 along either side of the link body. When the extractable cap 3700 is pushed into the opening 3750 within the link body, each protruding tooth 3702 is pushed against its corresponding indent 3712 to secure the extractable cap 3700 into the link body.

In some embodiments, each of the protruding teeth 3702 is connected to a squeezable wing 3704, the two squeezable wings 3704 located on opposite sides of the extractable cap 3700, wherein when the squeezable wings 3704 are squeezed towards the middle of the extractable cap 3700, each protruding tooth 3702 is pulled away from its corresponding indent 3712 to thereby enable extraction of the extractable cap 3700 from the link body.

That is, in order to insert extractable cap 3700 into the opening 3750 of the link body, extractable cap 3700 is pushed into the opening, squeezable wings 3704 are thereby squeezed toward the middle of extractable cap 3700, and protruding teeth 3702 are pushed against their respective indents 3712. And in order to extract extractable cap 3700 away from the opening 3750 of the link body, a user squeezes squeezable wings 3704 to thereby retract each of the protruding teeth 3702 away from their respective indents 3712, i.e., towards the middle of extractable cap 3700, which enables easy extraction of the entire extractable cap 3700 away from the link.

Figure 38A:
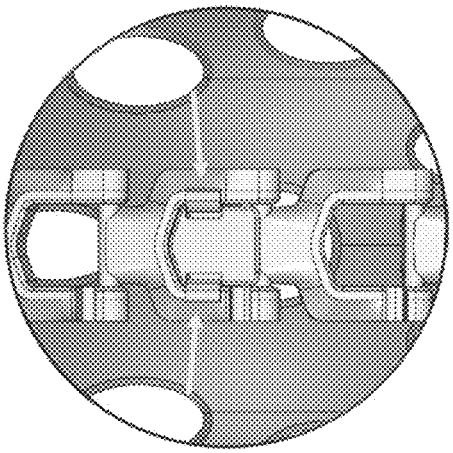
FIGS. 38A-38C are schematic illustrations of the link with the extractable cap of FIGS. 37A-37E as it is assembled as part of the link-based helmet mounting unit, according to embodiments of the present disclosure.
Figure 38B:
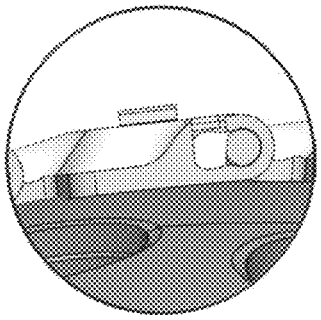
Figure 38C:
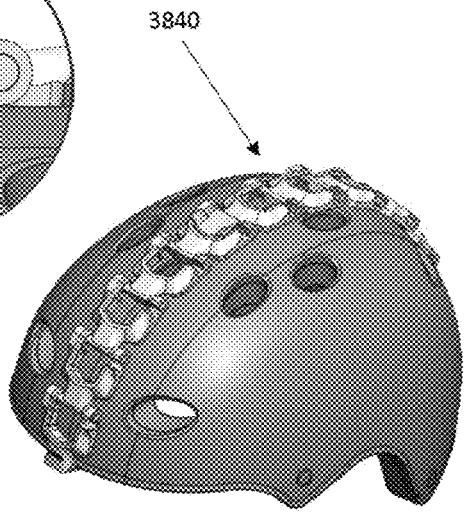

FIGS. 38A-38C schematically illustrate extractable cap 3700 as it is located within a corresponding link, which is part of an entire set of links comprising a helmet mounting unit 3840.

Figure 39A:
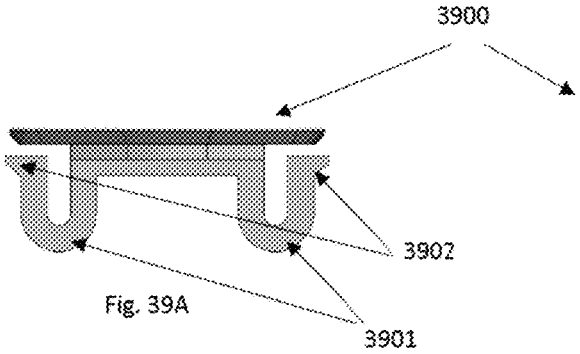
FIGS. 39A-39E are schematic illustrations of a cap, according to embodiments of the present disclosure.
Figure 39B:
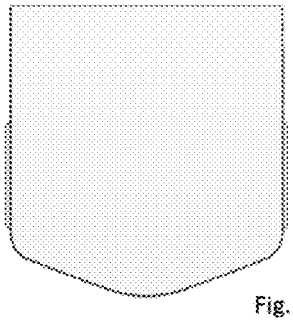
Figure 39C:
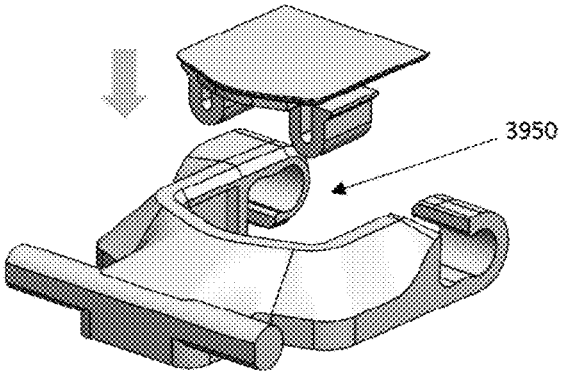
Figure 39D:
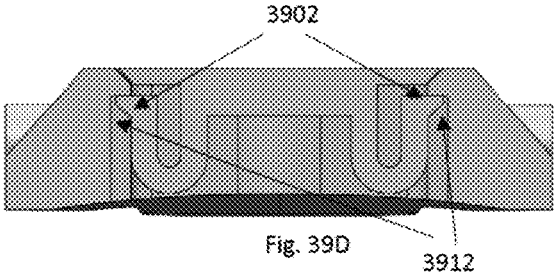
Figure 39E:
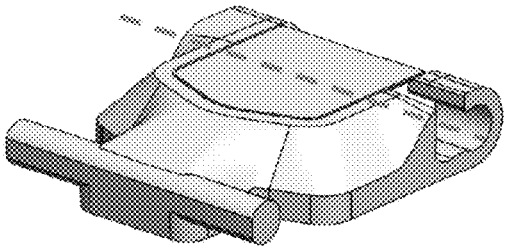

FIGS. 39A-39E are schematic illustrations of a cap configured to cover the space or opening created between the two elongated arms of either of the first links or middle links that comprise such an opening. FIG. 38A is a front view of cap 3900, FIG. 39B is a top view thereof, FIG. 39C illustrates the cap 3900 with respect to a link comprising an opening into which extractable cap 3900 may be inserted, FIG. 39D is a cross section of the cap 3900 when placed inside its corresponding opening within the link, and FIG. 39E is a top perspective view thereof.

In some embodiments, cap 3900 may comprise a protruding tooth 3902 located on each side, e.g., right and left, of the cap 3900. Each protruding tooth 3902 may be part of a flexible U-shaped spring 3901. Each of the protruding teeth 3902 may be configured to be pushed against a corresponding indent 3912 along either side of the link body. When the cap 3900 is pushed into the opening 3950 within the link body, each protruding tooth 3902 is pushed against its corresponding indent 3912 to secure the cap 3900 into the link body.

Cap 3900 may differ from extractable cap 3700 by not comprising a set of squeezable wings, which prevent easy extraction of cap 3900 out of the opening within the link from the top or external side of cap 3900. Cap 3900 may be extracted out of the opening by removing the entire helmet mounting unit 4040 and pushing flexible teeth 3902 from the bottom side of cap 3900.

That is, in order to insert cap 3900 into the opening 3950 of the link body, cap 3900 is pushed into the opening, and protruding teeth 3902 are pushed against their respective indents 3912. And in order to extract cap 3900 away from the opening 3950 of the link body, a user is required to pull each of protruding teeth 3902 towards the middle of cap 3900 to thereby retract each of the protruding teeth 3902 away from their respective indents 3912, which enables extraction of the entire cap 3900 away from the link, only via the bottom side of cap 3900, which is more difficult compared to the extraction of extractable cap 3700.

Figure 40A:
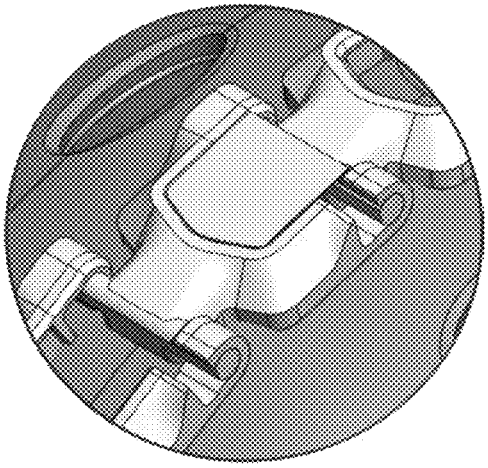
FIGS. 40A-40C are schematic illustrations of the link with the cap of FIGS. 39A-30E as it is assembled as part of the link-based helmet mounting unit, according to embodiments of the present disclosure.
Figure 40B:
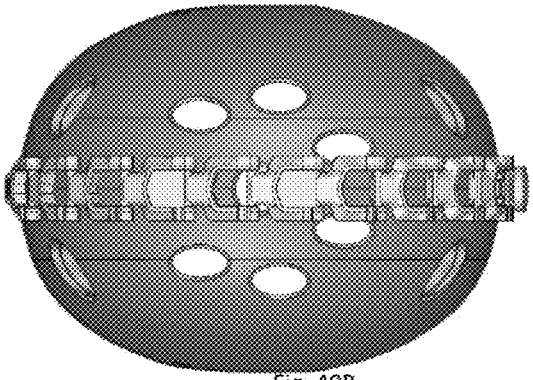
Figure 40C:
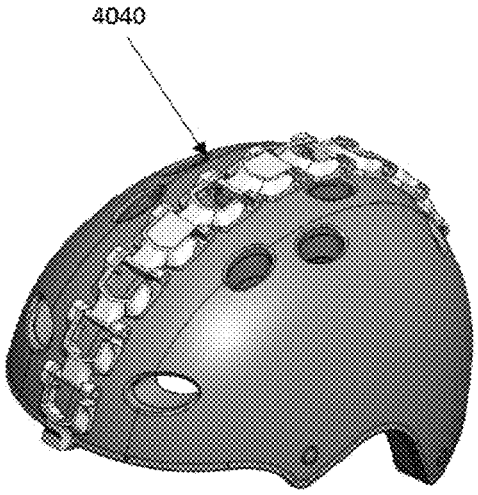

FIGS. 40A-40C schematically illustrate extractable cap 3900 as it is located within a corresponding link, which is part of an entire set of links comprising a helmet mounting unit 4040.

FIGS. 41-45 schematically illustrate different examples for caps and/or extractable caps integrally incorporating different types of accessory adaptors, such to enable replacement of one accessory adaptor with another, at any location along a helmet mounting unit, by extracting one cap with a first accessory adaptor from a middle link and inserting a different cap with a different accessory adaptor into that same middle link. Each of the caps comprises the flexible protruding tooth based locking-mechanism, as illustrated with respect to extractable cap 3700 and cap 3900.

Figure 41:
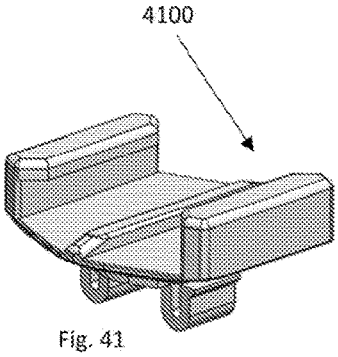
Figure 42:
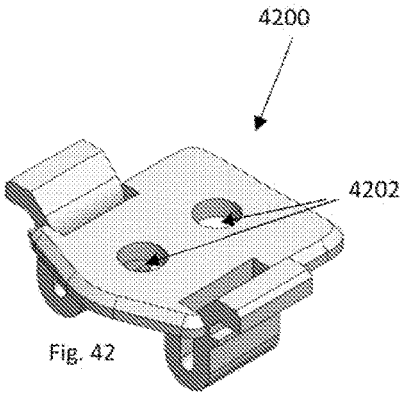
Figure 43:
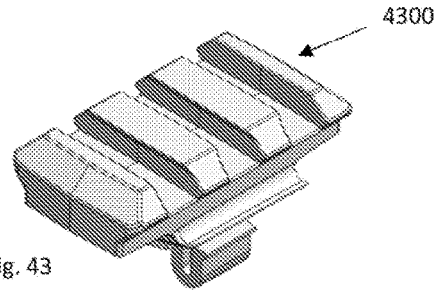
Figure 44A:
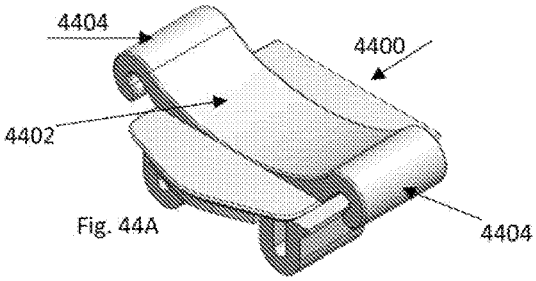
Figure 44B:
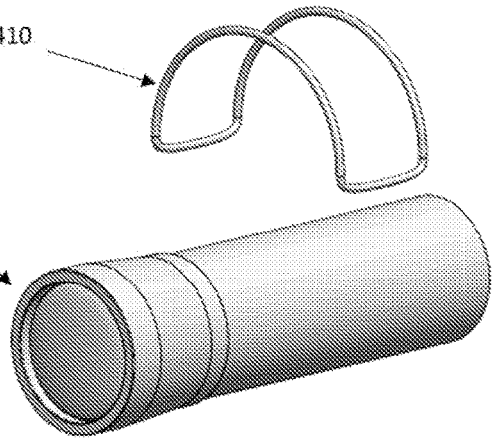
Figure 44B:
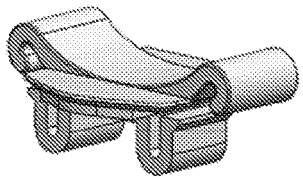
Figure 44C:
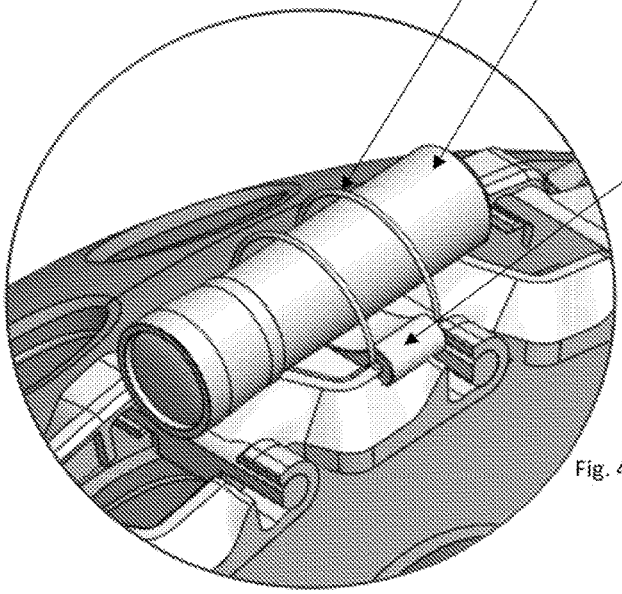

FIG. 41 illustrates a cap 4100 incorporating a GoPro adaptor. FIG. 42 illustrates a screw adaptor 4200 with holes 4202, which are configured to enable connection of an accessory via screws that are to be screwed into hole 4202. FIG. 43 illustrates a cap 4300 incorporating a picatinny adaptor. FIG. 44A-44C illustrate a cap 4400 incorporating a double-sided hook adaptor 4402 with a rounded middle shape onto which a circular-shaped accessory, e.g., a flashlight 4420, may be placed, and which hooks 4404 are configured to accept an elastic band 4410, e.g., a rubber band, such that the accessory would be held between the circular surface of adaptor 4402 and the elastic band 4410 held on both sides by hooks 4404.

FIG. 45 illustrates a cap incorporating a fashion element 4500. The fashion element may have different shapes and/or different colors. In this case, it is a horn shape, which may be attached on the helmet mounting unit to differentiate the look of the helmet implementing such element from other helmets that do not have such a fashion element attached thereon. A fashion element may be used and attached onto a helmet, for example, when a parent wishes to ease identifying their child who is using the helmet from other helmet users.

FIGS. 46A-46B schematically illustrate helmet mounding unit 4600 which comprises the different caps 4100, 4200, 430, 4400 and 4500 as they are attached onto the helmet mounting unit 4600. These caps are mere examples of other caps having other adaptors integrated therein, which may be inserted into and extracted from a middle link having an opening configured to accept such caps. A user may change location of the different caps along the helmet mounting unit, and may replace one cap with another, according to user's needs and/or preferences. This enables the helmet mounting unit to be versatile and adjustable per user preferences, instead of replacing an entire helmet mounting unit and preparing a new helmet mounting unit per user's needs, when no interchangeable caps are implemented.

FIGS. 47A-47E are schematic illustrations of the NVG adaptor 2560, illustrated in FIGS. 26A-26C. FIG. 47 illustrate the prior-art NVG adaptor comprising a rotatable arm, which is screwed into a dedicated helmet mounting unit adaptor.

Figures 47, 47A, 47B, 47C, 47D, 47E, 47F:
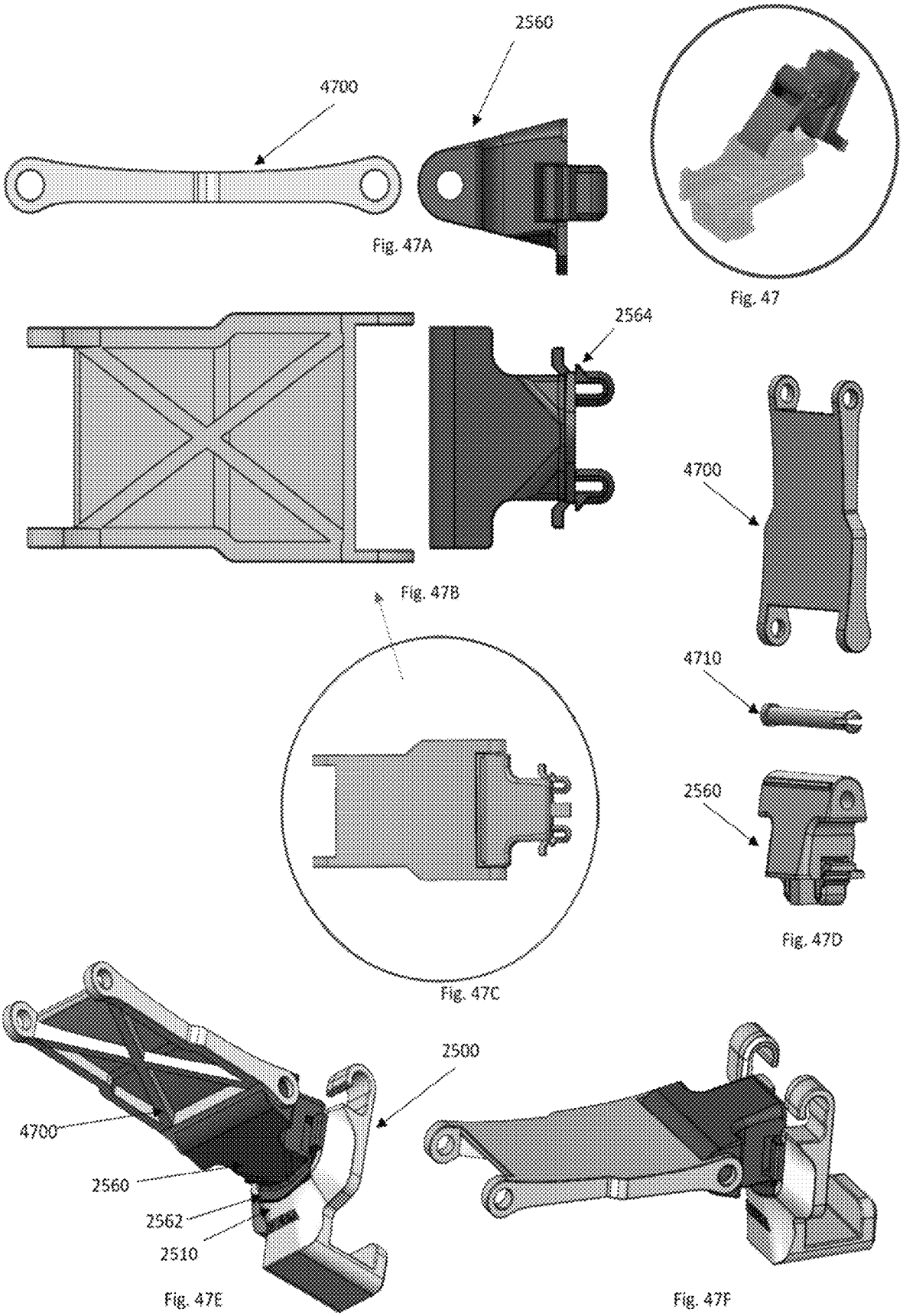
FIG. 47 illustrates the prior-art NVG adaptor comprising a rotatable arm, which is connected, e.g., screwed into a dedicated helmet mounting unit adaptor.
FIGS. 47A-47F are schematic illustrations of the NVG adaptor, illustrated in FIGS. 26A-26C, according to embodiments of the present disclosure.

FIG. 47A illustrates a side view of the NVG adaptor 2560 and it rotatable arm 4700, FIG. 47B illustrates a bottom view thereof, FIG. 47C illustrates an assembled top view thereof, FIG. 47D illustrates an exploded view thereof, FIG. 47E illustrates a bottom perspective view of the NVG adaptor 2560 as it is assembled onto a front link, and FIG. 47F illustrates a top perspective view thereof.

NVG adaptor 2560 comprises a rotatable arm 4700, and may be attached to any link body, typically a first link, which may be placed at the front side of a helmet, above the face of a user. NVG adaptor 2560 may be attached to a corresponding link by being inserted into a space created by the link's body, e.g., space 2550, as illustrated in FIGS. 26A-26C, while being supported by section 2552 of link body 2510 that is located between the two elongated arms 2512, as illustrated in FIG. 25A. Section 2552 may be an indent along link body 2510 between elongated arms 2512, such that NVG adaptor 2560 with a corresponding elongated tab 2562 may be configured to lean against section 2552 when the NVG adaptor 2560 is placed into space 2550, thereby securing a connection between the NVG adaptor 2560 and link 2500.

In some embodiments, a dedicated NVG system may be attached to NVG adaptor 2560 via its rotatable arm 4700.

NVG adaptor 2560 may comprise an extracting or locking mechanism that is similar to that of extractable cap 3700, i.e., to include flexible protruding teeth 2564 that are configured to be inserted into and to be extracted from corresponding indents within the opposing sides of the link body, e.g., link 2500.

NVG adaptor 2560 may be connected to its rotatable arm 4700 via rod 4710, onto which rotatable arm 4700 may rotate to thereby create different angles between NVG adaptor 2560 and arm rotatable 4700.

FIGS. 48A-48F are schematic illustrations of an end link comprising a tightening mechanism configured to tighten the entire link-based helmet mounting unit onto the external circumference of a helmet, according to embodiments of the present disclosure.

Figure 48A:
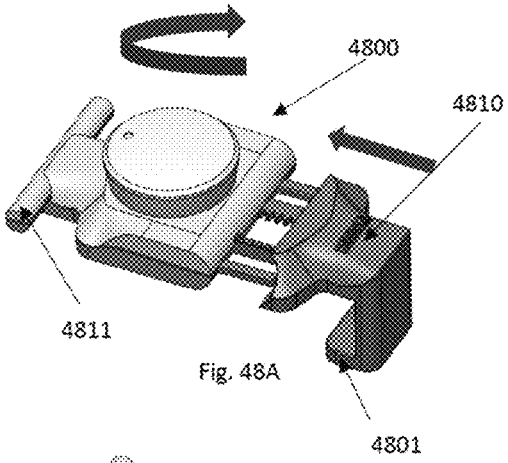
FIGS. 48A-48F are schematic illustrations of an end link comprising a tightening mechanism configured to tighten the entire link-based helmet mounting unit onto the external circumference of a helmet, according to embodiments of the present disclosure.
Figure 48B:
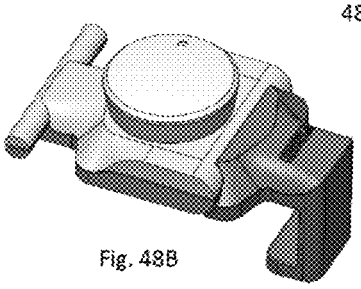
Figure 48C:
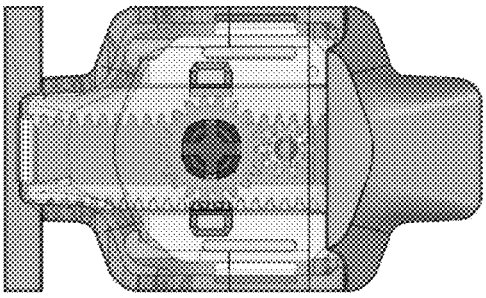
Figure 48D:
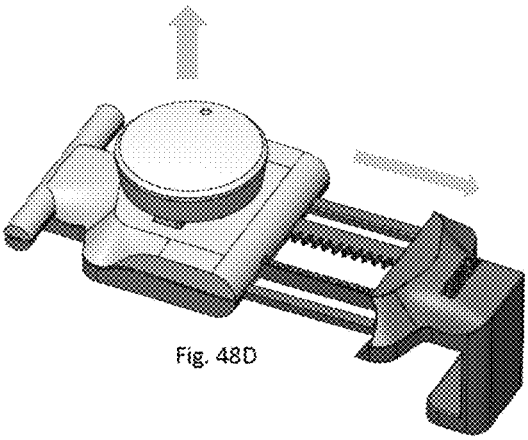
Figure 48E:
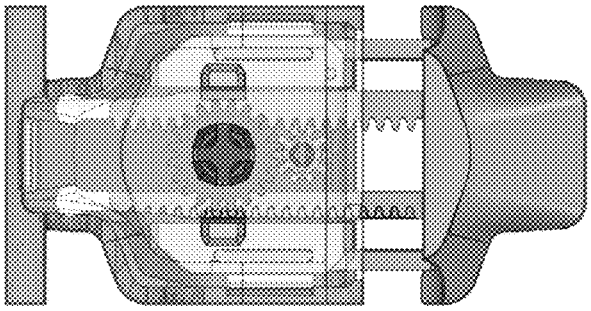
Figure 48F:
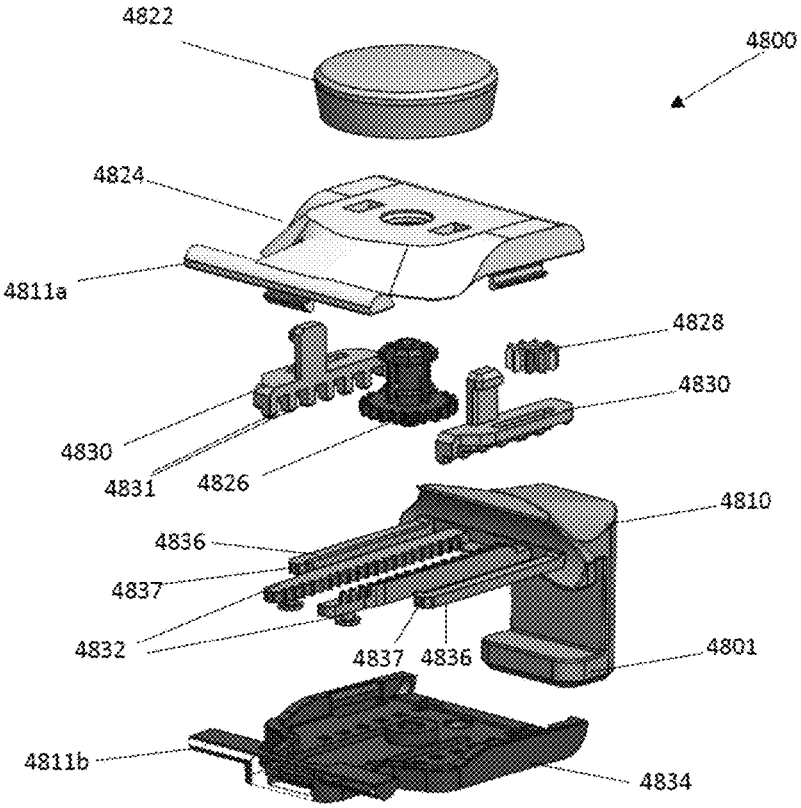

FIG. 48A is a top perspective view of end link 4800 in an expanded configuration, FIG. 48B is a top perspective view in a closed configuration thereof, FIG. 48C is a top view thereof, with a transparent top, FIG. 48D is a top perspective view thereof in an expanded configuration, FIG. 48E is a top view thereof with a transparent top, and FIG. 48F is an exploded view thereof.

End link 4800 may comprise a clip 4801 at one end of end clip 4800, which is typically the end that is configured to connect end link 4800 onto an edge of a helmet, e.g., above the back of a user. The helmet edge may thus be attached between clip 4801 and the body 4810 of end link 4800.

End clip 4800 may further comprise a rod 4811 at the opposite end of end clip 4800, which may be configured to be connected to at least one hook of a middle link. Thus, end clip 4800 may be connected to a plurality of middle links and to a first link via rod 4811.

As illustrated in FIG. 48F, end clip 4800 comprises a top shell 4824 and a bottom shell 4834 which cover several inner components of the tightening mechanism of end clip 4800. A section of rod 4811, e.g., a top section 4811*a* may be an integral extension of top shell 4824, while a second section of rod 4811, i.e., bottom section 4811*b* may be an integral extension of bottom shell 4834.

A rotatable dial or knob 4822 may be connected to top shell 4824 via main cog wheel 4826, as well as via two stoppers 4830, whereby top shell 4824 may comprise corresponding holes for each of main cog wheel 4826 and two stoppers 4830 such that these components pass through the holes and connect to rotatable dial 4822.

A secondary cog wheel 4828 may be located adjacent main cog wheel 4826, and may rotate when main cog wheel 4826 is rotated.

End clip 4800 may further comprise end link body 4810, which may have attached two linear gears or racks 4832, and two back clips 4836 which comprise a protruding tooth or clip that is configured to be caught by the holes 4831 located along stoppers 4830. Racks 4832 and back clips 4836 may be an integral part of end link body 4810.

In order to pull the entire links of the link-based helmet mounting unit that are connected to one another, from the first link, via the plurality of middle links, towards end link 4800 and thus tighten the link-based helmet mounting unit onto an external circumference of a helmet, a user operates the closing mechanism of end link 4800. The user rotates dial 4822, which causes main cog wheel 4826 to rotate in the same direction, e.g., clockwise. Main cog wheel 4826 thus rotates towards clip 4801 along first rack 4832, while further causing secondary cog wheel 4828 to rotate in an opposite direction of that of main cog wheel 4826, e.g., secondary cog wheel 4828 may rotate counterclockwise. Secondary cog wheel 4828 thus rotates towards clip 4801 along the second rack 4832, which secondary cog wheel 4828 is adjacent and in contact with. When the user stops rotation of dial 4822, the flexible protruding clip 4837 of each of back clips 4836 is pushed into an adjacent hole 4831 of the respective stoppers 4830, to thereby maintain the tightening force unchangeable, until dial 4822 is further rotated in the same direction. That is, rotation of dial 4822 in one direction causes the components encapsulated within top shell 4824 and bottom shell 4834 to come closer to clip 4801, which is equivalent to having the plurality of links connected to end link 4800 via rod 4811 to come closer to clip 4801 and thus be tightened against and onto the external circumference of a helmet to ensure a solid and safe connection between the link-based helmet mounting unit and the helmet.

Rotation of main cog wheel 4826 which turns secondary cog wheel 4828 creates a symmetric and synchronous movement of these two cog wheels 4826 and 4828 along their respective racks 4832, and thus for a synchronous movement of the plurality of links towards clip 4801, which tightens the plurality of links onto the helmet for a safe connection between the link-based helmet mounting unit and the respective helmet.

In this tightening mechanism of end link 4800, it is not possible to rotate dial 4822 in the opposite direction, to loosen the pulling force of the links onto the external circumference of the helmet, since clips 4837 are prevented from exiting their respective holes 4831 due to their shape. That is, clips 4837 may only exit holes 4831 when dial 4822 is rotated in a tightening direction, not the opposite.

In order to loosen the connection between the link-based helmet mounting unit and the helmet, dial 4822 is pulled upwards, which causes an upward pulling force of the main cog wheel 4826 and stoppers 4830. This upward movement releases the respective back clips 4863 and enables the user to manually distant end link shell (top shell 4824 and bottom shell 4834) from end link body 4810 and clip 4801, such to lengthen the size of end link 4800. Lengthening size of end link 4800 is equivalent to lengthening size of the entire link-based helmet mounting unit, which releases the connection between the link-based helmet mounting unit and the helmet.

Figure 49A:
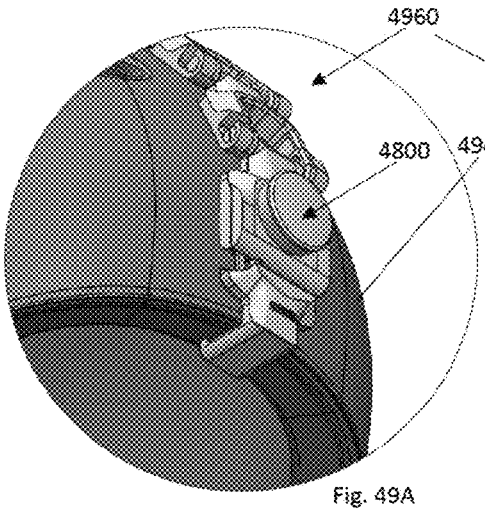
Figure 49B:
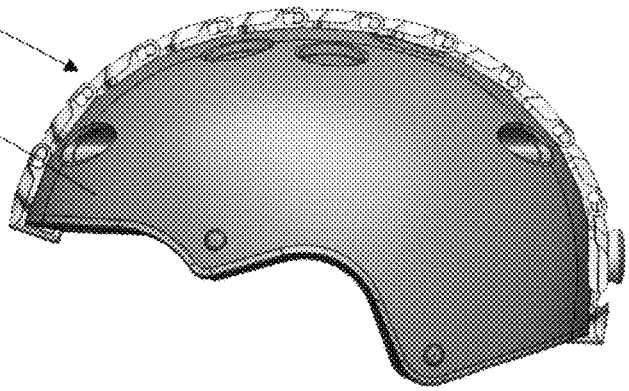

FIGS. 49A-49B illustrate end link 4800 as it is assembled and tightened onto the external circumference of the helmet 4940, as part of the entire link-based helmet mounting unit 4960.

FIGS. 50A-50D, 51A-51D and 52A-52C schematically illustrate an end clip comprising two parts connected together via an elongated screw, according to embodiments of the present disclosure.

Figure 50A:
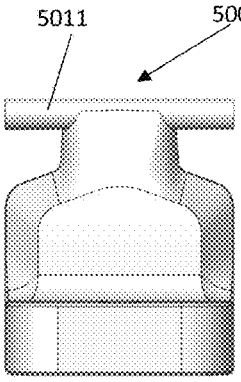
FIGS. 50A-50D, 51A-51D and 52A-52C schematically illustrate an end clip comprising two parts connected together via an elongated screw, according to embodiments of the present disclosure.
Figure 50B:
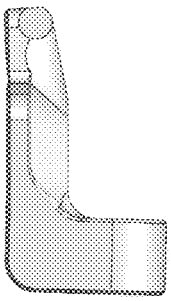
Figure 50C:
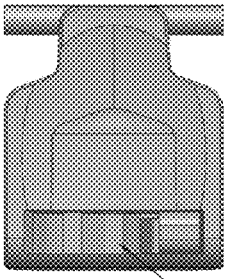
Figure 50D:
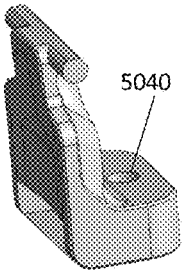
Figure 51A:
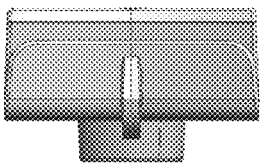
Figure 51B:
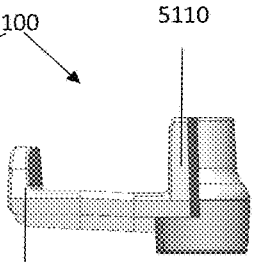
Figure 51C:
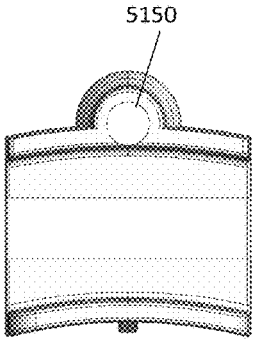
Figure 51D:
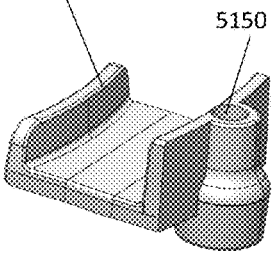

FIG. 50A illustrates a front view of a first end link 5000, FIG. 50B illustrates a side view thereof, FIG. 50C illustrates a rear view thereof, and FIG. 50D illustrates a rear-side perspective view thereof. FIG. 51A illustrates a front view of a second end link 5100, FIG. 51B illustrates a side view thereof, FIG. 51C illustrates a rear view thereof, and FIG. 51D illustrates a side perspective view thereof.

Figure 52A:
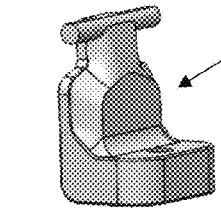
Figure 52A:
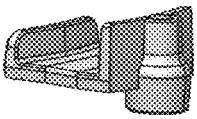
Figure 52A:
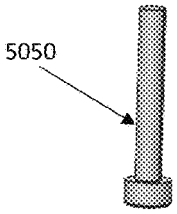

FIG. 52A illustrates an exploded view of the two part end link, i.e., first end link 5000, second end link 5100 and the elongated screw that is configured to attach second end link 5100 to first end link 5000, while pulling the rest of the links of the link-based helmet mounting unit towards the two part end link to thereby tighten connection between the link-based helmet mounting unit and the respective helmet.

Figure 52B:
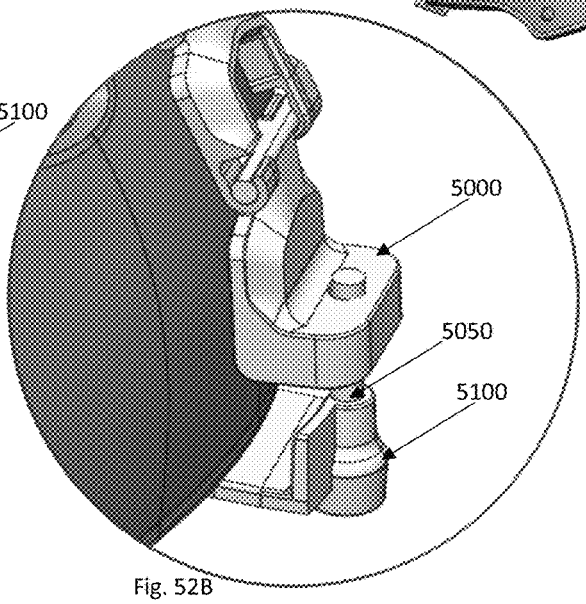
Figure 52C:
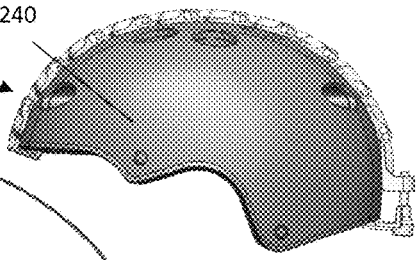

FIGS. 52B-52C illustrate the two-part end link as it is assembled and tightened onto a helmet as part of the link-based helmet mounting unit 5260.

In some embodiments, the two-part end link may comprise a first end link 5000, which may comprise a rod 5011 located on one end of first end link 5000. Rod 5011 is configured to be connected and hugged by at least one hook of an adjacent middle link, in order to connect the two-part end link to the rest of the links of link-based helmet mounting unit, e.g., helmet mounting unit 5260.

In some embodiments, first end link 5000 may comprise a hole 5040 located on an opposite end of first end link 5000, which may be a threaded hole configured to accept insertion of screw 5050 therethrough. Optionally, first end link 5000 may further comprise a space 5042 located at the rear side of first end link 5000. Space 5042 may comprise an imbedded nut located with respect to hole 5040, such that elongated screw 5050 would pass through the nut while passing through hole 5040.

Second end link 5100 may comprise a clip 5101 located on one side of second end link 5100. Clip 5101 may be configured to connect second end link 5100 onto an edge of a helmet, typically a back edge of the helmet located above the back of the user. Thus, the edge of the helmet is configured to be positioned between clip 5101 and second end link body 5110.

In some embodiments, second end link 5100 may comprise a hole 5150 passing through second end link body 5110 to enable insertion of elongated screw 5050 therethrough. Optionally, hole 5150 may be a threaded hole. Optionally, hole 5150 may comprise an embedded nut therein.

As illustrated in FIGS. 52A-52C, an elongated screw 5050 may be screwed into corresponding hole 5040 and 5150 to thereby connect first end link 5000 with second end link 5100. In addition, the more elongated screw 5050 is screwed into the corresponding holes, the closer first end link 5000 is to second end link 5100, which further causes the rest of the links, which are connected to first end link 5000 via rod 5011, to come closer to second end link 5100, thereby tightening the entire link-based helmet mounting unit onto the external circumference of a respective helmet, e.g., helmet 5240.

FIGS. 53A-53J schematically illustrate a 'turn-and-pull' connection between two adjacent links, whereby one of the links comprises two hooks with their elongated arm's opening facing opposite directions, according to embodiments of the present disclosure.

Figure 53B:
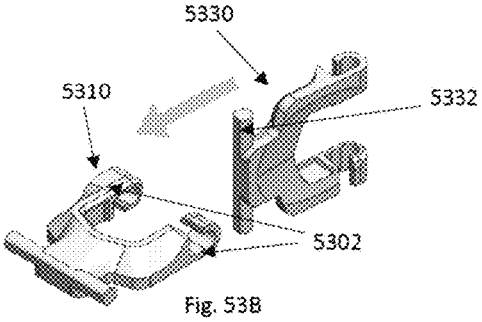
FIGS. 53A-53J schematically illustrate a 'turn-and-pull' connection between two adjacent links, according to embodiments of the present disclosure.
Figure 53A:
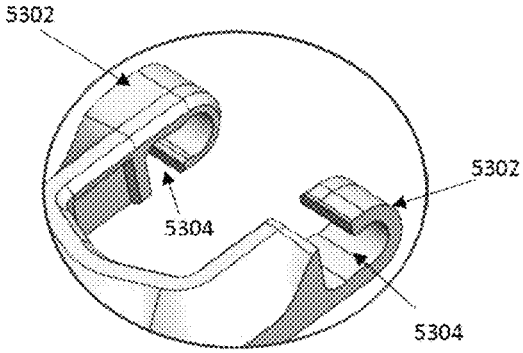
Figure 53C:
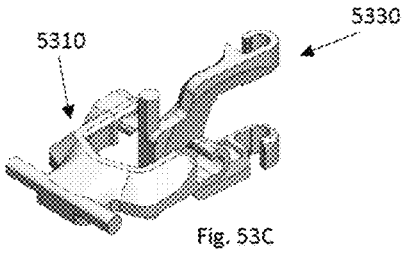
Figure 53D:
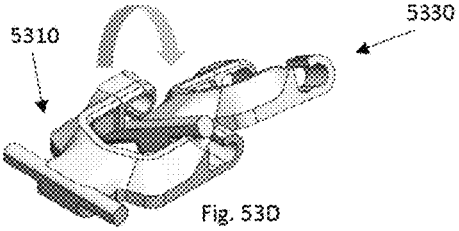
Figure 53E:
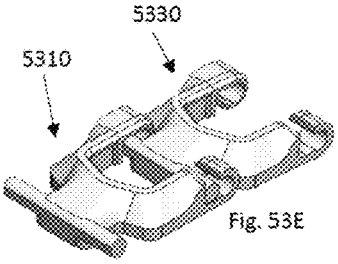
Figure 53F:
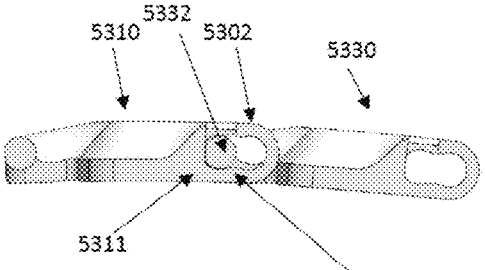
Figure 53G:
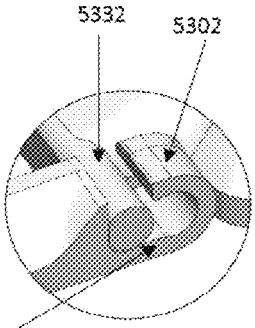
Figure 53H:
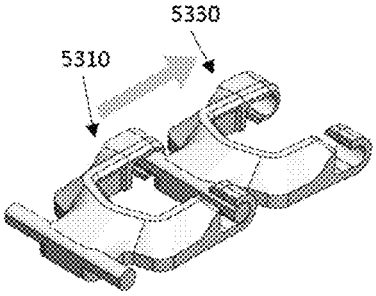
Figure 53I:
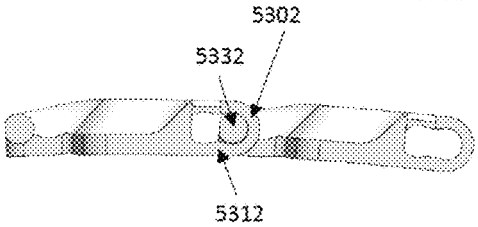
Figure 53J:
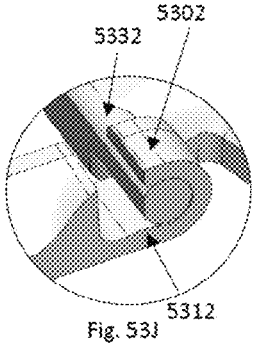

FIG. 53A is an enlarged view of the elongated arms facing opposite directions, and FIG. 53B-53D are top perspective views of the 'turn' operation of one link with respect to another. FIG. 53E is a top perspective view of two links connected after the turn operation, FIG. 53F is a side view thereof and FIG. 53G is a close up of the connection area of the two links. FIG. 53H is a top perspective view of two links connected after the 'pull' operation, FIG. 53I is a side view thereof and FIG. 53J is a close up of the connection area of the two links.

Two middle links, whereby each may comprise a rod on one end and two hooks that the openings created at the end of each hook are facing opposite directions, e.g., middle links 2700, 2900 or a middle link with an integrated accessory adaptor, may be connected via a 'turn-and-pull' connecting method. Any other links, e.g., a first and middle link, or a middle and end link, whereby one comprises a rod and the other comprises two hooks with their opening facing opposite directions may be connected via this same connecting method.

In some embodiments, one link 5310 may comprise two hooks 5302, with the openings 5304 created by each of hooks 5302 are facing opposite directions, e.g., a first opening 5304 of first hook 5302 is facing the front side of the link, and the second opening 5304 of the second hook 5302 is facing the rear side of link.

Another link 5330 may comprise a corresponding rod 5332 to which the two hooks are connected, and which the two hooks are configured to hug within their openings 5304.

The first connecting operation between such two links may be a 'turn' operation, which comprises link 5330 to be positioned substantially at a 90 degrees angle with respect to link 5310, as in FIG. 53B. as illustrated in FIG. 53C, link 5330 is brought closer to the space created by the two elongated arms of link 5310, and according to FIG. 53D, link 5330 as is rod 5332 are turned such to be positioned in parallel to link 5310. While turning link 5330, one side of rod 5332 is inserted into the first hook 5302 which faces the front side of link 5310, while the other side of rod 5332 is inserted into the second hook 5302 which faces the rear side of link 5310. That is, the turning operation of rod 5332 enables insertion of rod 5332 into the two opposite facing hooks 5302. Insertion of rod 5332 into its respective opposite facing hooks 5302 creates a first "click" sound.

As illustrated in FIGS. 53E-53G, once rod 5332 is inserted into the opposite facing hooks 5302, rod 5332 is first inserted into corresponding hooks 5302 while being positioned along the elongated arm 5311 to the left of protruding step 5312, to create a first click, i.e., connection sound, indicating a first connection between rod 5332 and hooks 5302.

As illustrated in FIGS. 53H-53J, rod 5332 is then pulled into its final position along the elongated arm 5311, which is past step 5312 and under the curved shaped hook ends, which creates a second "click" sound indicating the final connection between rod 5332 and the curved ends of hooks 5302.

Step 5312 may prevent easy disconnection of rod 5332 from hooks 5302, since due to its protruding shape, a user is required to apply force in order to push rod 5332 past step 5312 and away from the curved ends of hooks 5302.

When the second "click" sound is heard, that means that rod 5332 is safely positioned in its final position, which includes rod 5332 being hugged and surrounded by the curved ends of hooks 5302.

FIGS. 54A-54F schematically illustrate a 'push-and-pull' connection between two adjacent links, whereby one of the links comprises two hooks with their elongated arm's opening facing the same direction, according to embodiments of the present disclosure.

Figure 54B:
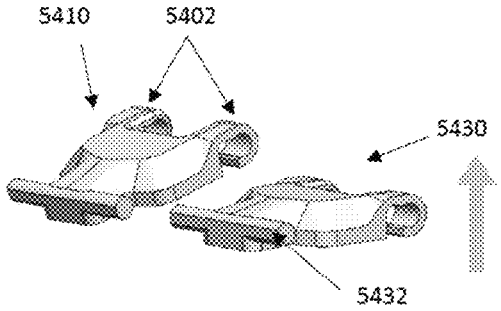
FIGS. 54A-54F schematically illustrate a 'push-and-pull' connection between two adjacent links, according to embodiments of the present disclosure.
Figure 54A:
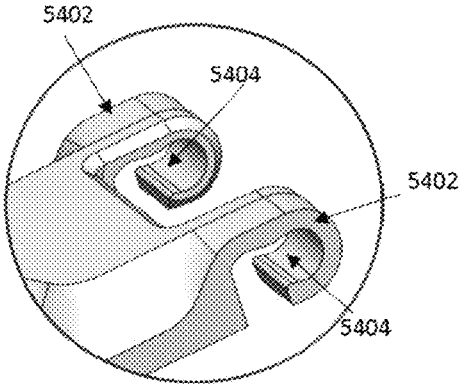
Figure 54C:
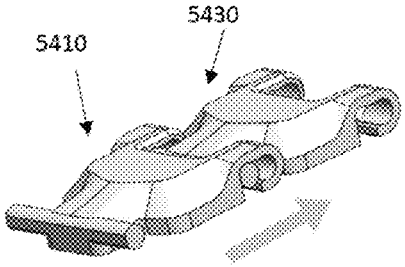
Figure 54D:
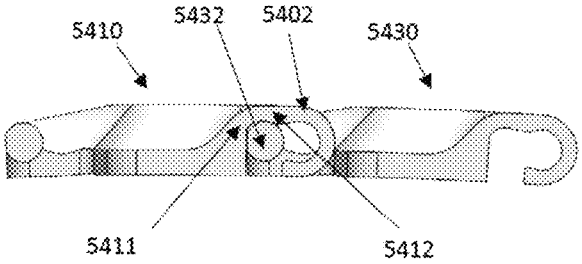
Figure 54E:
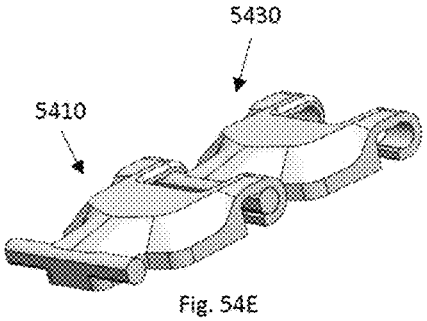
Figure 54F:
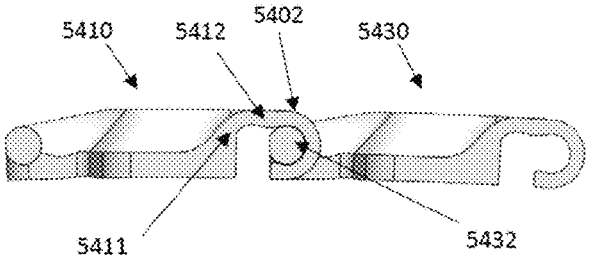
Figure 55A:
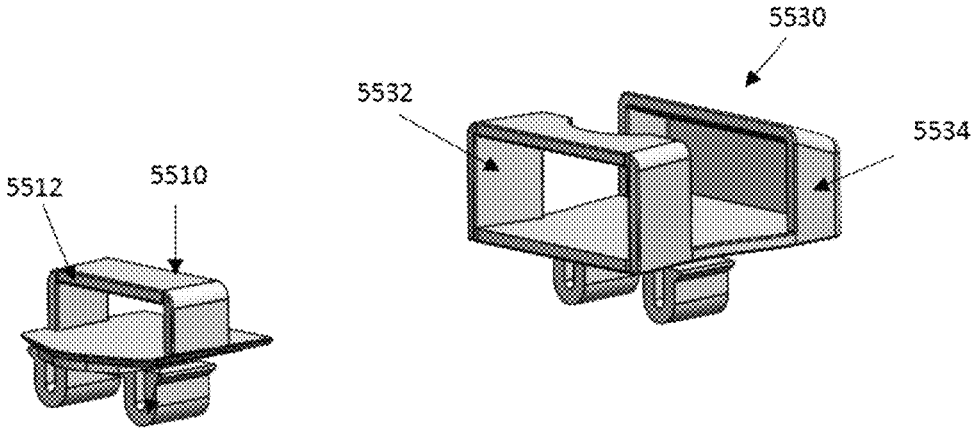
FIGS. 55A-55D illustrate another example of two caps, each incorporating an adaptor configured for carrying an accessory, according to embodiments of the present disclosure.
Figure 55B:
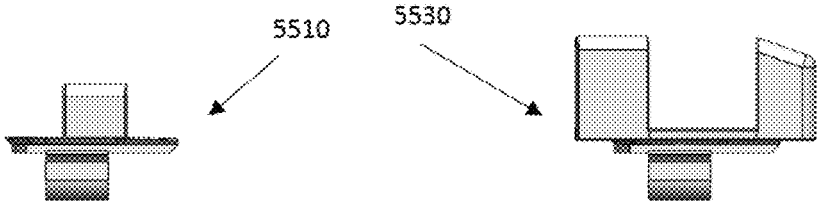
Figure 55C:
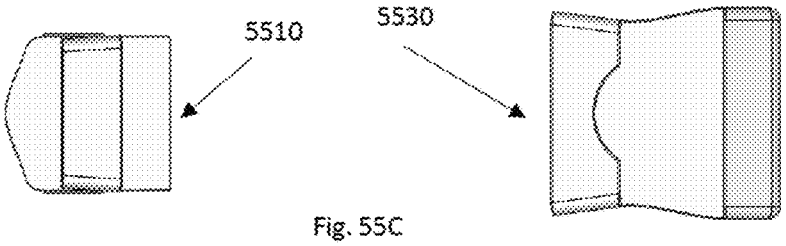
Figure 55D:
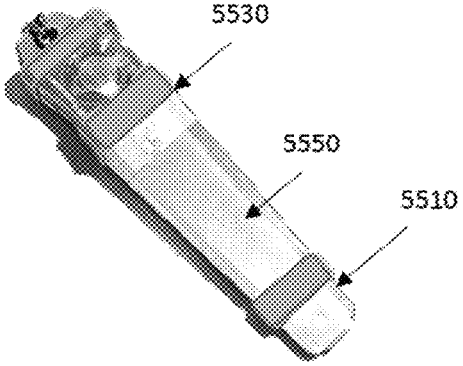
Figure 56A:
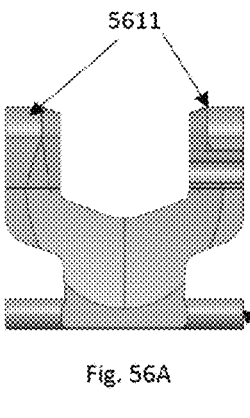
FIGS. 56A-56E schematically illustrate a middle link that has smaller dimensions compared to other links, according to embodiments of the present disclosure.
Figure 56B:
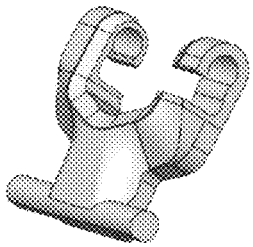
Figure 56C:
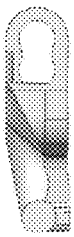
Figure 56D:
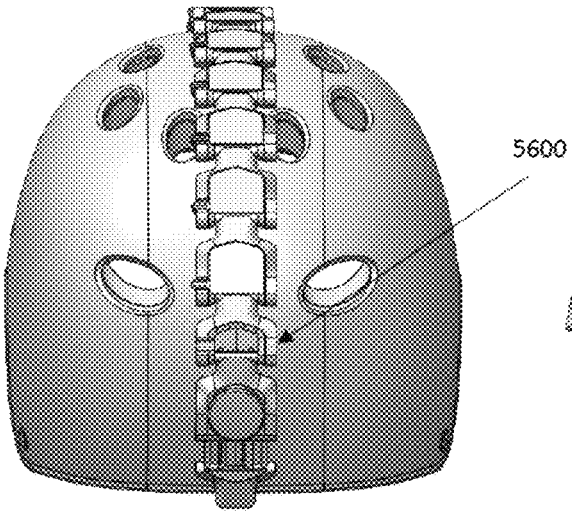
Figure 56E:
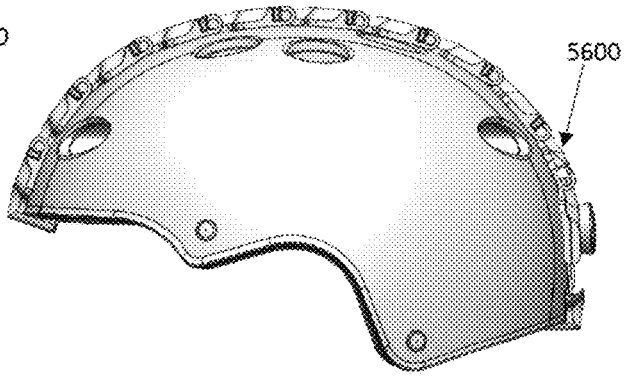

FIG. 54A is an enlarged view of the elongated arms facing the same direction, and FIG. 54B-54C are top perspective views of the 'pull' operation of one link with respect to another. FIG. 54D is a side view of two links connected after the push operation. FIG. 54E is a top perspective view of two links connected after the 'pull' operation and FIG. 54F is a side view thereof.

Two middle links, whereby each may comprise a rod on one end and two hooks that the openings created at the end of each hook are facing the same direction, e.g., middle links 3100, 3300, 3500, may be connected via a 'push-and-pull' connecting method. Any other links, e.g., a first and middle link, or a middle and end link, whereby one comprises a rod and the other comprises two hooks with their opening facing the same direction may be connected via this same connecting method.

In some embodiments, one link 5410 may comprise two hooks 5402, with the openings 5404 created by each of hooks 5402 are facing the same direction, e.g., the first and second openings 5404 are both facing the front side of the link, or the rear side of the link.

Another link 5430 may comprise a corresponding rod 5432 to which the two hooks 5402 may be connected, and which the two hooks 5402 are configured to hug within their openings 5404.

The first connecting operation between such two links may be a 'pull' operation, which comprises rod 5432 of link 5430 to be positioned beneath link 5410, as in FIG. 54B. As illustrated in FIG. 54C, rod 5432 is inserted into both hooks 5402 at once to be positioned to the left of protruding step 5412, i.e., to be located at the beginning of elongated arms 5411. That is, the pushing operation of rod 5432 enables insertion of rod 5432 into the two hooks 5402, which face the same direction. Insertion of rod 5432 into its respective hooks 5402 creates a first "click" sound, indicating such insertion.

As illustrated in FIGS. 54C-54D, once rod 5432 is inserted into the hooks 5402, rod 5432 is first inserted into corresponding hooks 5402 while being positioned along the elongated arm 5411 to the left of protruding step 5412, to create a first click, i.e., connection sound, indicating a first connection between rod 5432 and hooks 5402.

As illustrated in FIGS. 54E-54F, rod 5432 is then pulled into its final position along the elongated arm 5411, which is past step 5412 and under the curved shaped hook ends, which creates a second "click" sound indicating the final connection between rod 5432 and the curved ends of hooks 5402.

Step 5412 may prevent easy disconnection of rod 5432 from hooks 5402, since due to its protruding shape, a user is required to apply force in order to push rod 5432 past step 5412 and away from the curved ends of hooks 5402.

When the second "click" sound is heard, that means that rod 5432 is safely positioned in its final position, which includes rod 5432 being hugged and surrounded by the curved ends of hooks 5402.

FIGS. 55A-55D illustrate another example of two caps, each incorporating an adaptor configured for carrying an accessory, whereby each of the two caps may be connected to a different link, typically adjacent links, such that the two caps, and thereby the two adaptors may be used to carry the same elongated accessory, e.g., an illumination source such as a flash light, though other accessories may be carried by this two part adaptors system. In some embodiments, a first cap 5510 may comprise a U shaped strap 5512, which defines a space between the strap and the body of link 5510 into which part of an accessory may be placed. A second cap 5530 may comprise at least one U shaped strap, e.g., 5532 and 5534, which also defines a space between the strap and the body of link 5530 into which another part of an accessory may be placed. The U-shaped straps may be made of either rigid or flexible material. The exact shape of the strap may be dictated by the accessory that is to be carried by the two caps 5510 and 5530, e.g., flashlight 5550.

FIGS. 56A-56E schematically illustrate a middle link that has smaller dimensions compared to the standard middle link sizes disclosed hereinabove. Typically, the length of middle link 5600 is shorter compared to standard links, which means the distance between rod 5601 and hooks 5611 is smaller compare to other links. Such a smaller middle link

5600 may be used when a length adjustment is required per the entire link-based helmet mounting unit with respect to the external circumference of the helmet to which the link-based helmet mounting unit is connected. Other lengths may be implemented per other middle links, all for the purpose of enabling the proper length adjustment between the link-based helmet mounting unit and the size of the helmet to which it is connected.

Figure 57A:
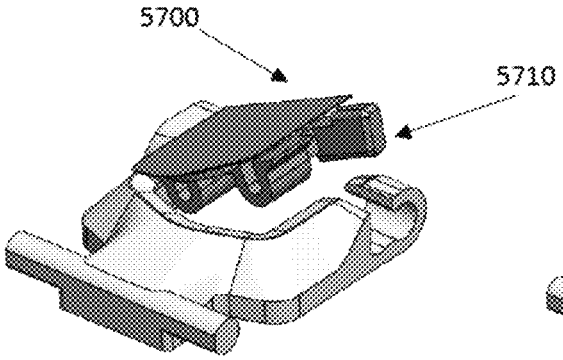
FIGS. 57A-57B illustrate another mechanism enabling extraction of a cap from the space created by the elongated arms of the link, according to embodiments of the disclosure.
Figure 57B:
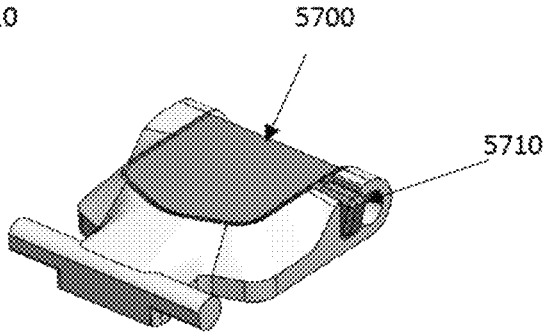

FIGS. 57A-57B illustrate another mechanism enabling extraction of a cap from the space created by the elongated arms of the link, according to embodiments of the disclosure. Instead of squeezable wings, e.g., wings 3704, a different release mechanism may be implemented in order to extract the cap out of the link. This release or extraction mechanism may comprise a push button 5710. During insertion of the extractable cap 5700 into the link, push button 5710 may be pushed into the section of the elongated arms of the link, which is left to the step. This section along the elongated arm is kept free for accepting push button 5710 after a rod is positioned in its final location along the elongated arms, i.e., on the right side of the step, under the curved ends of the hook.

During extraction of cap 5700 away from the link, a user pushes push button 5710, which in turn pushes the protruding tooth away from its corresponding indent, thereby allowing release of the protruding tooth from its indent, and thus enable extraction of cap 5700 from its corresponding link. The push button mechanism 5710 may be implemented in any cap comprising any type of integral adaptor.

The corresponding structures, materials, acts, and equivalents of all means or step plus function elements in the claims below are intended to include any structure, material, or act for performing the function in combination with other claimed elements as specifically claimed. As used herein, the singular forms "a", "an" and "the" are intended to include the plural forms as well, unless the context clearly indicates otherwise. It will be further understood that the terms "comprises" and/or "comprising" and/or "having" when used in this specification, specify the presence of stated features, integers, steps, operations, elements, and/or components, but do not preclude the presence or addition of one or more other features, integers, steps, operations, elements, components, and/or groups thereof.

The terminology used herein should not be understood as limiting, unless otherwise specified, and is for the purpose of describing particular embodiments only and is not intended to be limiting of the disclosed subject matter. While certain embodiments of the disclosed subject matter have been illustrated and described, it will be clear that the disclosure is not limited to the embodiments described herein. Numerous modifications, changes, variations, substitutions and equivalents are not precluded.

The invention claimed is:

1. A helmet mounting unit comprising a link, said link comprising:

a link body;

a first end comprising a rod; and a second end comprising at least one hook connected to the link body via an elongated arm, said elongated arm comprising a curved end;

wherein said at least one hook is configured to connect onto a rod of another link with the curved end hugging the rod of said another link, thereby enabling connection between the plurality of links to form the helmet mounting unit, wherein the at least one hook comprises a protrusion positioned adjacent to the curved end of the at least one hook, said protrusion configured to prevent easy disconnection of the rod from the at least one hook by partially blocking movement of the rod away from the curved end of the at least one hook;

wherein the link comprises an opening within the link body, the opening configured to receive an independent accessory adaptor, said independent accessory adaptor configured for attaching an accessory onto the link via the accessory adaptor, wherein the independent accessory adaptor is an extractable accessory adaptor configured to be inserted into the opening and be extracted from the opening, wherein the extractable accessory adaptor comprises a locking mechanism, the locking mechanism comprising a protruding tooth located on each side of the extractable accessory adaptor, each of the protruding teeth configured to be pushed against a corresponding indent along either side of the link body, wherein, when the extractable accessory adaptor is pushed into the opening within the link body, each protruding tooth is pushed against the protruding teeth corresponding indent to secure the extractable accessory adaptor into the link body.

2. The link of claim 1, wherein the at least one hook comprises two hooks positioned on each side of the second end, wherein each open end of each of the two hooks are positioned towards the same direction or opposite directions.

3. The link of claim 1, wherein the link further comprises an accessory adaptor integral to the link, the accessory adaptor configured for attaching an accessory onto the link via the accessory adaptor.

4. The link of claim 1, wherein each of the protruding teeth is connected to a squeezable wing, the two squeezable wings located on opposite sides of the accessory adaptor, wherein when the squeezable wings are squeezed towards the middle of the extractable accessory adaptor, each protruding tooth is pulled away from its corresponding indent to extract the extractable accessory adaptor from the link body.

5. The link of claim 1, wherein the extractable accessory adaptor is replaceable with other extractable accessory adaptors.

6. A helmet mounting unit for attaching accessories onto a helmet, said helmet mounting unit comprising a plurality of links connected to one another, wherein said plurality of links comprise:

a first link comprising:

a first link body;

a first end comprising a first clip configured to connect the first link to a first edge of the helmet; and a second end comprising at least one hook connected to the link body via an elongated arm, said elongated arm comprising a curved end;

an end link comprising:

an end link body;

a first end comprising an end clip configured to connect the end link to a second edge of the helmet opposite the first edge; and a second end comprising a rod;

a plurality of middle links, wherein each middle link comprises:

a link body;

a first end comprising a rod; and a second end comprising at least one hook connected to the link body via an elongated arm, said elongated arm comprising a curved end;

wherein the first clip is connected to the first edge of the helmet and the at least one hook of the first link is connected onto the rod of the middle link, and wherein the at least one hook of the middle link is connected onto a rod of another middle link via the curved end of the middle link hugging the rod of the other middle link, and so on until a middle link is connected to the end link via the curved end of the middle link hugging the rod of the end link and the end clip is connected to the second edge of the helmet, thereby connecting the plurality of links to one another to form the helmet mounting unit connected onto a circumference of the helmet.

7. The helmet mounting unit of claim 6, wherein the at least one hook of the first and middle links comprises two hooks positioned on each side of the second end of the first and middle links, further wherein each open end of each of the two hooks are positioned towards the same direction or towards opposite directions.

8. The helmet mounting unit of claim 6, wherein the at least one hook of the first and middle links comprises a step along the elongated arm, the step configured to prevent easy disconnection of the rod of a connected link from the at least one hook by partially blocking movement of the rod away from the curved end of the at least one hook.

9. The helmet mounting unit of claim 6, wherein the first and/or middle link further comprise an accessory adaptor integrated as part of the first and/or middle link, the accessory adaptor configured for attaching an accessory onto the first and/or middle link via the accessory adaptor.

10. The helmet mounting unit of claim 6, wherein the first and/or middle link comprises an opening within the first and/or middle link body, the opening configured to receive an independent accessory adaptor, said independent accessory adaptor configured for attaching an accessory onto the first and/or middle link via the accessory adaptor.

11. The helmet mounting unit of claim 10, wherein the independent accessory adaptor is an extractable accessory adaptor configured to be inserted into the opening of the first and/or middle link and be extracted from the opening.

12. The helmet mounting unit of claim 11, wherein the extractable accessory adaptor comprises a locking mechanism, the locking mechanism comprising a protruding tooth located on each side of the extractable accessory adaptor, each of the protruding teeth configured to be pushed against a corresponding indent along either side of the link body of the first and/or middle link, wherein, when the extractable accessory adaptor is pushed into the opening within the first and/or middle link body, each protruding tooth is pushed against its corresponding indent to secure the extractable accessory adaptor into the link body of the first and/or middle link.

13. The helmet mounting unit of claim 12, wherein each of the protruding teeth is connected to a squeezable wing, the two squeezable wings located on opposite sides of the accessory adaptor, wherein when the squeezable wings are squeezed towards the middle of the extractable accessory adaptor, each protruding tooth is pulled away from its corresponding indent to extract the extractable accessory adaptor from the link body of the first and/or middle link.

14. The helmet mounting unit of claim 6, wherein the first and/or middle link comprises an opening within the link body, the opening configured to receive an extractable cover configured to cover the opening.

15. The helmet mounting unit of claim 6, wherein the end link further comprises a tightening mechanism configured to pull the connected links towards the end link and pull the rod of the end link body towards the end clip to thereby tighten the plurality of links onto the external circumference of the helmet between the first and second edges of the helmet.

16. The helmet mounting unit of claim 15, wherein the tightening mechanism comprises a rotatable dial, wherein when the dial is turned in a first direction, the end link body is pulled towards the end clip, which in turn pulls the connected middle and first link towards the end clip, thereby tightening the plurality of links onto the external circumference of the helmet between the first and second edges of the helmet, and wherein the dial is turned in a second opposite direction, the end link body is pushes away from the end clip to thereby untighten the plurality of links and distant them from the external circumference of the helmet.

* * * * *